US007240797B1

(12) United States Patent
Grossman

(10) Patent No.: US 7,240,797 B1
(45) Date of Patent: Jul. 10, 2007

(54) PACKAGING AND DISPENSING SYSTEM FOR SANDWICH FOOD PRODUCTS

(76) Inventor: Victor A. Grossman, 91 Rupert Ave., Staten Island, NY (US) 10314

( * ) Notice: Subject to any disclaimer, the term of this patent is extended or adjusted under 35 U.S.C. 154(b) by 492 days.

(21) Appl. No.: 10/353,107

(22) Filed: Jan. 27, 2003

(51) Int. Cl.
*A45C 11/20* (2006.01)

(52) U.S. Cl. ..... 206/551; 206/568; 206/219; 206/775; 206/476; 206/804; 206/466; 426/115; 426/119; 426/120; 426/124; 229/120; 229/902; 229/904

(58) Field of Classification Search ..... 206/568, 206/219, 775, 476, 551; 426/115, 120, 119, 426/124; 229/120.6, 120.32, 902, 904, 32, 229/120; 220/529
See application file for complete search history.

(56) References Cited

U.S. PATENT DOCUMENTS 3,292,810 A * 12/1966 Schechter ..... 220/4.24
3,539,354 A * 11/1970 Colvin ..... 426/275
3,771,713 A * 11/1973 Davidson ..... 229/120.12
3,830,944 A 8/1974 Dimitriadis et al. ..... 426/113
4,132,344 A 1/1979 Jewell ..... 229/406
4,143,165 A * 3/1979 Daswick ..... 426/113
4,265,216 A * 5/1981 Marshall et al. ..... 126/263.07
4,339,041 A * 7/1982 Roberts et al. ..... 229/222
4,369,885 A 1/1983 Redmond ..... 206/484
4,522,190 A 6/1985 Kuhn et al. ..... 126/263.02
4,585,124 A * 4/1986 Pride ..... 206/559
4,608,259 A * 8/1986 Cortopassi ..... 426/115
4,610,357 A 9/1986 Nakamura ..... 206/449
4,653,685 A 3/1987 Leary et al. ..... 229/406
4,760,950 A 8/1988 Levick ..... 229/103
4,776,459 A * 10/1988 Beckerman et al. ..... 206/467
4,784,054 A * 11/1988 Karos et al. ..... 99/483
4,834,245 A 5/1989 Ohga et al. ..... 206/610
4,834,991 A * 5/1989 Porcello et al. ..... 426/94
4,844,330 A * 7/1989 Roosa et al. ..... 229/120.06
4,877,178 A 10/1989 Eisman ..... 229/114
4,951,866 A * 8/1990 Rusnak ..... 229/120.07
5,012,971 A * 5/1991 Cozzi et al. ..... 229/120.07
5,042,666 A 8/1991 Dolenc ..... 206/606
5,094,355 A 3/1992 Clark et al. ..... 220/4.23
5,131,551 A 7/1992 Wells ..... 220/4.23
5,148,972 A 9/1992 Clayton ..... 229/113
5,205,476 A 4/1993 Sorenson ..... 229/114
5,213,256 A * 5/1993 Cyr ..... 229/120.32
5,312,641 A 5/1994 Castillo ..... 426/633
5,323,926 A 6/1994 Pomroy et al. ..... 220/526

(Continued)

*Primary Examiner*—Eugene Kim
*Assistant Examiner*—Dolores R. Collins
(74) *Attorney, Agent, or Firm*—Zaretsky & Associates PC; Howard Zaretsky

(57) ABSTRACT

A sealed dispensing apparatus suitable for packaging and dispensing a single service portion of a food product. The food product is contained within an inner container cavity formed by an outer cover and a center member. Draw means are provided for transferring a force from the user to the outer cover, whereby the force peels the outer cover from the center section, thus folding the outer cover over itself as it is removed from the center section. The food product is dispensed when the inner container is opened by removing the outer cover from the center member. An optional outer container seals and holds portions of bread or other sandwich portions while the inner container is located therebetween. Box means holds the combination formed by the inner container and the outer container as well as optional condiments.

17 Claims, 35 Drawing Sheets

U.S. PATENT DOCUMENTS 5,507,579 A 4/1996 Sorenson ..... 383/207
5,567,455 A * 10/1996 Alsbrook, Sr. ..... 426/115
5,632,379 A 5/1997 Frost ..... 206/541
5,655,707 A 8/1997 Jensen ..... 229/160.2
5,816,485 A 10/1998 Bernstein ..... 229/120
5,875,956 A 3/1999 Benarrouch ..... 229/110
5,938,110 A 8/1999 Bernstein ..... 229/125.28
6,007,264 A * 12/1999 Koptis ..... 401/132
6,093,431 A 7/2000 Sullivan et al. ..... 426/118
6,165,521 A 12/2000 Mayfield ..... 426/90
6,245,368 B1 * 6/2001 Sullivan et al. ..... 426/118
6,260,736 B1 * 7/2001 Adams et al. ..... 222/383.1
6,294,209 B1 * 9/2001 Andersson ..... 426/115
6,440,051 B1 8/2002 Lauzon et al. ..... 493/194
6,655,526 B2 * 12/2003 Urman et al. ..... 206/223
6,892,513 B1 * 5/2005 Barr et al. ..... 53/458
2003/0207000 A1 * 11/2003 Merriman et al. ..... 426/124
2004/0084348 A1 * 5/2004 Nash et al. ..... 206/562

* cited by examiner

PACKAGING AND DISPENSING SYSTEM FOR SANDWICH FOOD PRODUCTS

FIELD OF THE INVENTION

The present invention relates generally to packaging and dispensing systems for food products, and more particularly relates to a single-step apparatus for storing, handling, and dispensing individual sandwich-sized servings of food products, and a method for the same.

BACKGROUND OF THE INVENTION

There is currently an increasingly large consumer demand for low-cost sanitary foods which are packaged and ready-to-eat. A variety of techniques and materials have been used for packaging various types of food products in order to provide for their safe storage, shipping, and handling, as well as to provide for their easy consumption.

One common type of ready-to-eat food is the sandwich (or sandwich-type foods such as hamburgers, hotdogs, pita-sandwiches, falafel sandwiches, gyros, subs, heros, tacos, burritos, etc., which will hereinafter be collectively referred to as sandwiches). Sandwiches find widespread use in fast-food-type operations. Additionally, sandwiches are commonly used for school lunches and other packaged meals (e.g., in airline meals, and in vending machines).

The bread in sandwiches usually absorbs moisture from the sandwiches' fillings. This moisture adversely affects the sandwiches' taste and texture. Accordingly, when moist fillings such as egg salad or tuna salad are used, the sandwiches must be consumed within a relatively short period of time, which is inconvenient and uneconomical. Sandwiches which are intended to last for several hours or more are generally made with relatively dry fillings, such as turkey, salami, or ham.

In the airline industry, it is typical that from the time the food is prepared by a caterer until the time the food is served to passengers aboard an aircraft, four or more hours will have passed. Because of this delay, airlines typically serve sandwiches which have substantially dry fillings, and avoid sandwiches which contain moist fillings such as tuna salad or egg salad.

A large number of moist and/or sticky products are commonly used as sandwich fillers. Moist and/or sticky sandwich fillers include egg salad, tuna salad, chicken salad, and peanut butter and/or jelly, as well as various condiments such as mustard, ketchup, and tomatoes. Sandwiches made using many of these products require refrigeration or special handling to insure that they do not spoil. However, refrigeration at times may be inconvenient or unavailable. Moreover, refrigeration adversely affects the taste of the bread and therefore may not be desirable or advantageous.

Although there are a number of prior art methods to deal with the aforementioned problems associated with sandwiches containing moist and/or sticky fillings, none of them provide for an easily-dispensed, sanitary, long-lasting, fresh-tasting sandwich.

One common prior art method requires that the sandwich filler be packed separately from the bread. Although this method does keep the bread from absorbing moisture from the filling, it requires that the user make the sandwich after unpacking the bread and unpacking the filler, which is inconvenient. Additionally, the extra handling involved in making the sandwich increases the likelihood that the sandwich will become contaminated, and requires the use of utensils which may be unavailable.

Another method uses an array of chemicals to seal meat that is used in sandwiches and to inhibit bacterial growth. The completed sandwiches are then vacuum-sealed. However, because chemicals are added to the food product, the flavor and/or consistency of the food is altered. Additionally, this system does not provide for individual selection of various combinations of breads and fillers.

U.S. Pat. No. 4,653,685 to Leary, et al., entitled "Dual compartment sandwich package," discloses a dual compartment sandwich package fabricated of foamed polystyrene or the like and adapted to retain therein in appealing and acceptable form a sandwich including a hot meal portion, such as a hamburger, and a cool trimmings portion, such as lettuce and tomato. The package comprises two compartments, one for containing the hot meal portion and the other to retain the cool trimmings portion. While this product maintains the sandwich components in an acceptable condition for a longer period of time than a fully assembled sandwich would be, it requires a larger container (which is about twice as large as a single-compartment container) and additional materials, and also requires the user to assemble the sandwich before use, thus adding inconvenience and increasing the likelihood of contamination during assembly.

U.S. Pat. No. 5,312,641 to Castillo, entitled "Non-spread peanut butter slices and method of making," discloses a non-spread, sliced peanut butter product containing chunky peanut butter, powdered egg white, flour, and an emulsifier. The ingredients are mixed together, and pressed or extruded into sheets which are about the length and width of a bread slice and about 0.2 inches thick. However, this product has a different composition and texture from conventional peanut butter and requires that the user handle the product when applying it to the bread.

U.S. Pat. No. 6,165,521 to Mayfield, entitled "Food products utilizing edible films and method of making and packaging same," discloses an edible material thin film which is applied to at least one side of a sticky or moist food product. The food product with edible material thereon may be used to make sandwiches, or stored without additional protection. However, because this material is added to the food product, it alters the flavor and/or consistency of the food and is therefore not desirable. Additionally, the invention does not provide for a sanitary holding means before the food product is applied to a desired object, such as a slice of bread. Moreover, the invention does not provide for the inclusion of gravy or other liquids with the food product.

Thus, there is a need for an easy-to-use packaged food dispenser which dispenses sandwiches that are fresh, sanitary and that have bread that is not soggy. Additionally, there is a need for a dispenser that can dispense packaged foods which does not require the use of utensils to remove the food from the package and apply it to the desired object. Furthermore, there is a need for a dispenser which can dispense packaged foods (such as sandwiches) from vending machines (and refrigerators and the like) while extending the life of the food. Moreover, there is a need for a package and dispenser which are ideally suited for fast-food meals, airline meals, and meals for armed-forces personnel.

SUMMARY OF THE INVENTION

The present invention provides a packaging and dispensing system that overcomes the disadvantages of the prior art discussed above. The packaging and dispensing system comprises a sealed dispenser which keeps the food (hereinafter filler, sandwich contents or simply contents) contained therein fresh and which provides for easy application of the filler (without utensils) to a desired surface (such as slices of bread or a plate), while minimizing the possibility of contamination. The present invention is ideally suited for the packaging and dispensing of sandwich fillers, sandwiches, and the like. The sealed dispenser can be used alone or can be used with other packaging means (e.g., an outer container, an outer box means, etc.).

While the present invention can be used with many products (e.g., deli meats, hotdogs, hamburgers, corn-on-the-cob, etc.), it is particularly suited for packaging of single-serve portions of moist and/or sticky foods (such as tuna salad or egg salad) within sandwiches. Additionally, the present invention, or individual units of it, may be used alone or in combination with each other to dispense combinations of individual single-service portions. Additionally, the present invention, when constructed utilizing suitable materials, can be used to store foods when cooling and/or warming them, during other phases of preparing and handling them, and while serving them. For example, a hotdog vendor can use the present invention to cook and dispense hotdogs (with or without the buns) without coming into contact with, and possibly contaminating, the hotdog filler and/or bun.

The current invention comprises an inner container and an optional outer container. The inner container contains the filler and comprises a center member, a holding means, an outer cover, and one or more draw members. The outer cover has an inner periphery and an outer periphery as well as one or more ends (e.g., a first end and a second end). The outer periphery of the outer cover is releasably attached to the center member so that the combination formed by the outer cover and the center member forms a cavity for holding the filler. The draw member(s) is/are attached to the end(s) of the outer cover. One or more optional tab members, suitable for grasping, are attached to the draw member. The draw member transfers a force from the tab member to the outer cover or from the user to the outer cover, which force peels the outer cover from the center section, thus folding the outer cover over itself as it is removed from the center section.

In alternative embodiments, the outer cover comprises at least two sheets. For example, the outer cover can be comprised of a first sheet and a second sheet. The first sheet and the second sheet are releasably attached to each other, as described infra, so as to form a continuous sheet which is shaped and sized similarly to the single outer cover as discussed supra. The first sheet and the second sheet have an inner and an outer periphery. An attachment means sealably secures parts of the outer peripheries of both the first sheet and the second sheet to the center member so that the combination formed by the first sheet, the second sheet, and the center member forms a cavity for holding the filler. A first draw member is attached to the first end of the first sheet and a second draw member is attached to the second end of the second sheet (wherein the first end of the first sheet and the second end of the second sheet when attached to each other correspond to the corresponding parts of the outer cover). The first draw member operates to transfer a force from the user to the first sheet, which force peels the first sheet from the center member (and optionally separates the first sheet from the second sheet). Likewise, a second draw member is attached to the second sheet and acts to transfer a force from the user to the second sheet, which force peels the second sheet from the center member.

In yet other alternative embodiments, the center member (or parts thereof) is formed integrally with the outer cover from the same sheet of material. The center member is attached to the outer cover via one or more weakened lines. A holding means is attached to the center member. The outer cover is folded over itself so as to form a cavity for holding the filler. The center member is then attached to itself and/or to the outer cover so as to seal the cavity. In use, the outer cover is removed from the center member (at the weakened lines). Alternatively, the outer cover can comprise two or more portions. The first sheet and the second sheet are releasably attached to each other as described infra, so as to form a continuous portion which is shaped and sized similarly to the single outer cover as discussed supra. The first sheet and the second sheet have an inner and an outer periphery. The center member is releasably attached to either or both the first sheet and the second sheet so that the combination formed by the first sheet, the second sheet, and the center member forms a cavity for holding the filler. A first draw member is attached to the first sheet and a second draw member is attached to the second sheet. The first draw member operates to transfer a force from the user to the first sheet, which force peels the first sheet from the center member. Likewise, the second draw member is attached to the second sheet and acts to transfer a force from the user to the second sheet, which force peels the second sheet from the center member, thus exposing the filler.

The optional outer container is suitable for holding the combination that is formed by the slices of bread or other sandwich portions (hereinafter, the sandwich halves), and the inner container, which is located between the sandwich halves. Without limitation, the outer container may be constructed from a flexible material (e.g., paper, foil, plastic, laminates, suitable polymers, or the like), a rigid or substantially rigid material (e.g., plastic, cardboard, foam, rigid polymers, etc.), or a combination of these or similar materials.

Either or both the outer container and the inner container can be held within an outer box means. The outer box means can also hold additional items such as a drink container, a snack container (e.g., one containing crackers or the like), and other desired items as are common in prepackaged meals such as Lunchables™ by Oscar Meyer Foods, Madison, Wis., Giggles to Go™ Sandwich Lunch Kit by Venetian Bakery™, Northlake, Ill., or airline meals as are commonly served aboard commercial flights. Without limitation, the box means may be constructed from a non-rigid material (e.g., paper, foil-backed paper, plastic, solid polymers, or the like), a rigid or substantially rigid material (e.g., plastic, cardboard, foam, solid polymers etc.), or a combination of these or similar materials.

In use, one or more inner containers are placed between the sandwich portions (e.g., slices of bread, the sandwich halves, etc.). The inner containers are then opened by removing the outer cover from the center member as discussed supra, thereby opening the cavity. The complete sandwich is then removed from the center member.

Alternatively, one or more inner containers are placed in proximity to a desired object (e.g., a plate or a single slice of bread). The inner container(s) is (are) then opened by peeling the outer cover from the center member thereby releasing the filler(s) onto the desired object.

It is further contemplated that the outer cover may be partially peeled away from the center member, thus partially exposing the filler contained within the cavity. The filler is then removed or eaten directly from the partially-opened cavity.

One method of this invention comprises the packaging of a sandwich filler within the inner container and sealing the outer cover of the inner container. The inner container is then optionally placed between two sandwich portions for final assembly of both the sandwich portions and the filler portion into a single sandwich by the consumer, and for consumption by the consumer.

Another method of this invention comprises the packaging of a sandwich filler within the inner container and securing the inner container within the outer container for final assembly for use by the consumer.

The inner container can be placed within the optional outer container so that the combination formed by the sandwich slices and the inner container is held in a desired position for storage, shipping and/or dispensing.

The inner container is ideally suited for dispensing the filling without the need for utensils, while minimizing the possibility of contaminating the sandwich.

It is an object of the current invention to provide for a sealed package which can be dispensed from vending machines and the like.

It is a further object of the current invention to provide for a sealed package which will keep a sandwich and its filling fresh for a longer period of time than if the sandwich and its filling were packaged with conventional methods.

It is a further object of the current invention to provide for a sealed package for a filling or other food product without the need for refrigeration.

It is a further object of the current invention to provide for a sealed package for a filling which can be easily opened and consumed.

It is a further object of the current invention to provide for a sealed individual serving of a filling. The individual serving which is contained within the inner container is then easily combined with two slices of bread to form a sandwich. The sandwich may be contained within an optional outer container.

It is a further object of the current invention to provide for the ability to keep the filler separate from the bread, thus preserving both the bread and the filler.

It is a further object of the current invention to provide for a modular sealed dispenser system wherein a plurality of inner containers can be stacked upon, and used with, other like inner containers which hold various fillers.

It is a further object of the current invention to provide for a sealed inner container with an outer cover which substantially cleans itself upon removal of the outer cover from the center member.

It is a further object of the current invention to provide for a package means for sandwich fillers in which the package is constructed from inexpensive materials and may be manufactured in large quantities at low cost, is easy to open and use, and permits the efficient utilization of the food product contained within the package.

Additional objects and advantages of the current invention will be set forth in the description which follows.

There is thus provided in accordance with the present invention an apparatus for packaging a sandwich filler comprising a center member adapted to provide space for the sandwich filler, an outer cover having a first end and a second end, the outer cover releasably attached to the center member so as to form a cavity for the sandwich filler, and a removal means attached to the first end and the second end of the outer cover such that pulling the removal means away from the center member causes the separation and removal of the outer cover from the center member, thereby exposing the sandwich filler contained therein.

There is also provided in accordance with the present invention an apparatus for packaging a sandwich filler comprising an outer cover having a first end and a second end, the outer cover folded over the sandwich filler forming a first portion and a second portion, the first portion peripherally sealed to the second portion so as to form a cavity for the sandwich filler and removal means attached to the first end and the second end of the outer cover such that pulling the removal means causes tearing of the first portion from the second portion, thereby causing the removal of a portion of the outer cover, thereby exposing the sandwich filler contained therein.

There is further provided in accordance with the present invention an apparatus for packaging a sandwich filler comprising a first center member and a second center member arranged so as to provide space for the sandwich filler, a first outer cover and a second outer cover, the outer periphery of the first outer cover releasably attached to a first side of the first center member and the second center member, the outer periphery of the second outer cover releasably attached to a second side of the first center member and the second center member so as to form a cavity for the sandwich filler, a removal means attached to the first outer cover and the second outer cover such that pulling the removal means causes the separation and removal of the first outer cover and the second outer cover from the first center member and the second center member, thereby exposing the sandwich filler contained therein, a first holding means attached to the first center member, and a second holding means attached to the second center member, wherein once the first outer cover and the second outer cover are removed, pulling the first holding means and the second holding means in opposite directions causes the first center member to separate from the second center member.

There is also provided in accordance with the present invention an apparatus for packaging a filler comprising a center member adapted to provide space for the filler, an outer cover having a first end and a second end, the outer cover releasably attached to the center member so as to form a cavity for the filler, and a removal means attached to the first end and the second end of the outer cover such that pulling the removal means away from the center member causes the separation and removal of the outer cover from the center member, thereby exposing the filler contained therein.

BRIEF DESCRIPTION OF THE DRAWINGS

The invention is herein described, by way of example only, with reference to the accompanying drawings, wherein:

FIG. 11B is a sectional-view illustration of the sixth embodiment of the present invention as shown in FIG. 11B, including an optional blocking member;

DETAILED DESCRIPTION OF THE INVENTION

Figure 1:
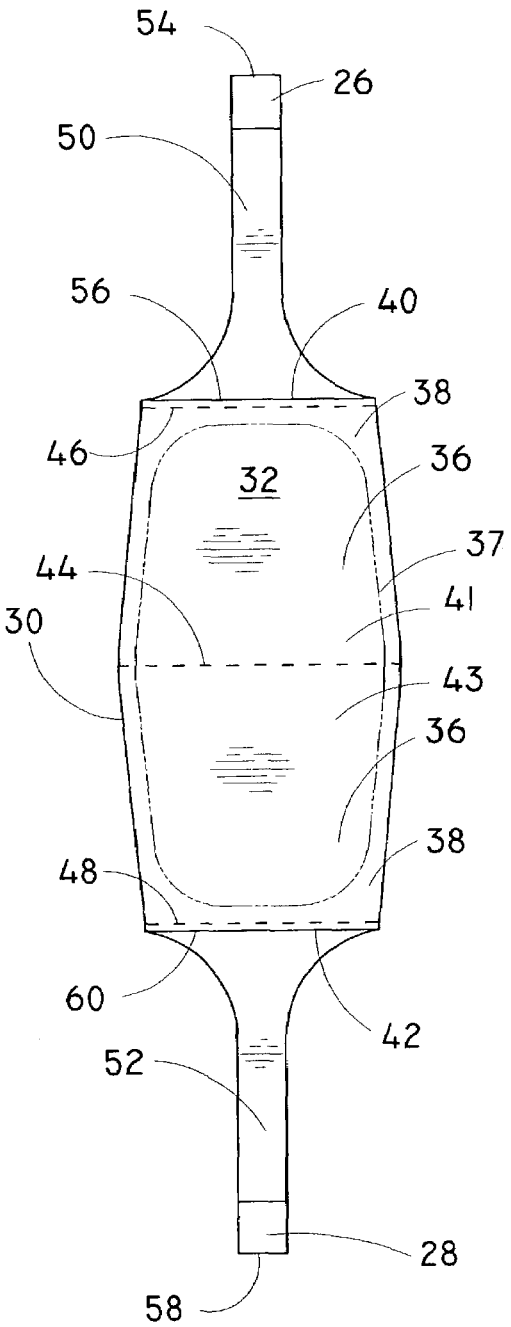
FIG. 1 is a top-view illustration of a single-piece outer cover and attached draw members according to a first embodiment of the present invention.

The following terms and definitions apply throughout this document.

The term "adhesive" is used to denote all suitable types of adhesives, including but not limited to pressure-sensitive adhesives, transfer adhesives, adhesive coatings, thermal adhesives, cohesives, epoxies, and glues, as well as thermal bonding, pressure bonding and other suitable methods of bonding the desired materials together.

The term "weakened line" is used to denote perforated, scored or other types of lines which are sufficiently weakened so that a desired force will cause separation of the weakened line. Additionally, tear strips, reinforcing cords or other suitable objects can be placed in close proximity to the weakened line so as to enhance the separation of the weakened line.

The terms "sandwich halves" and "sandwich portions" are used to denote bread slices, pita slices, cut rolls, or other objects which are placed on either side of the inner container and onto which the filler is deposited. Moreover, when using pita slices, the inner container may be placed within the pita slices or between them.

The terms "draw means" and "removal means" refer to draw members and/or other force-transmitting members for the removal of the outer cover. For instance, a draw member may be replaced by a rigid element which extends in any way, as desired, and which transmits a force from a desired object to the outer cover. The terms "filler," "sandwich contents" or "contents" refer to a sandwich filler (e.g., a hamburger, hotdog, deli slices, peanut butter, tuna, etc. as has been described elsewhere in this document) or other desired object which is placed within the dispenser's cavity and dispensed by the inner container.

The term "holding means" refers to holding members or other means which are attached to either or both the center member and the outer cover. The primary function of the holding means is to keep the outer cover and the inner container in position during removal of the outer cover from the inner container. Throughout this document, in embodiments where the holding member(s) or holding means is attached only to the center member, it will be assumed that the holding members or holding means is attached to the outer cover.

The term "tab member" refers to a tab or handle designed to facilitate grasping and pulling the draw member (or other draw means). The tab member can be made integrally with the draw member from the same material as the draw member, or can be made of another type of material, such as a rigid plastic or cardboard. The tab member may be embossed, shaped, colored, or otherwise formed so as to indicate its proper use and so as to enable the user easily to grasp and pull it. Tab members include the first and second tab as well as the jointly formed common tab, as will be discussed infra.

In a majority of the embodiments, the adjacent interior portions of the outer cover are either fixably or releasably attached to each other except at those points where the center member intervenes between them, at which points the outer cover is either fixably or releasably attached to the center member. Throughout this document, in embodiments that employ a center member which is placed between and is releasably attached to the first portion and the second portions of the outer cover, it will be assumed that the first portion is attached to the second portion of the outer cover. The one or more center members are placed at selected locations or continuously along the outer perimeter of the outer cover. Moreover, in some embodiments the center member can, at select locations, be attached to the exterior surface of the outer cover.

Note that throughout the present invention, interchangeability of components is contemplated and the corresponding terms throughout this specification including the claims may therefore be substituted for one another as desired as would be reasonable to one skilled in the art. For example, a first sheet and a second sheet may be substituted for the outer cover, in which case an attachment means must be included.

The present invention is applicable to food-storage dispensers and the like, and is characterized by an inner container which is comprised of a center member, one or more outer covers, at least one draw member, and a holding means. It will be appreciated that the filler is completely contained within the inner container without the need for additional packaging.

It will be further appreciated by one skilled in the art that the various embodiments of the present invention may be constructed using different materials, such as paper, cardboard, plastic, foam, aluminum foil, paperboards, laminates, other types of solid polymers, and other materials of suitable construction.

A top-view illustration of a single-piece outer cover and attached draw members according to a first embodiment of the present invention is shown in FIG. 1. The outer cover 30 has an interior side 32 and an exterior side (not shown), an inner periphery 36 and an outer periphery 38, opposed first and second ends 40 and 42 respectively, mid fold 44, and folds 46 and 48. The inner periphery and outer periphery are separated by line 37. A removal means comprises two draw members, a first draw member 50, and a second draw member 52, both of which are attached to the outer cover 30. The first draw member 50 includes a first end 54, an opposed second end 56, and an optional first tab 26 which is located adjacent to the first end 54. The second end is attached to the first end of the outer cover adjacent to fold 46. Likewise, the second draw member includes a first end 58, an opposed second end 60, and an optional second tab 28 which is located adjacent to the first end, the second end being attached to the second end of the outer cover adjacent to fold 48. Ideally, the first draw member and the second draw member are constructed from the same sheet of material as the outer cover. But, without limitation, it is contemplated that the first draw member as well as the second draw member may be made separately from the outer cover and attached thereto. Although the first draw member and/or the second draw member may be constructed from a rigid or semi-rigid material, it is preferred that the first draw member and the second draw member be constructed from a flexible material which is sufficiently strong so that it is not damaged during storage or use. The outer cover 30 may be constructed from any flexible material (e.g., Mylar, polyester, other polymers, etc.) as desired, provided that it has the desired characteristics. Those portions of the outer cover which lie between the mid fold and the first end of the outer cover are known as the first portion 41, while those portions of the outer cover which lie between the mid fold and the second end of the outer cover are to be known as the second portion 43.

Figure 2:
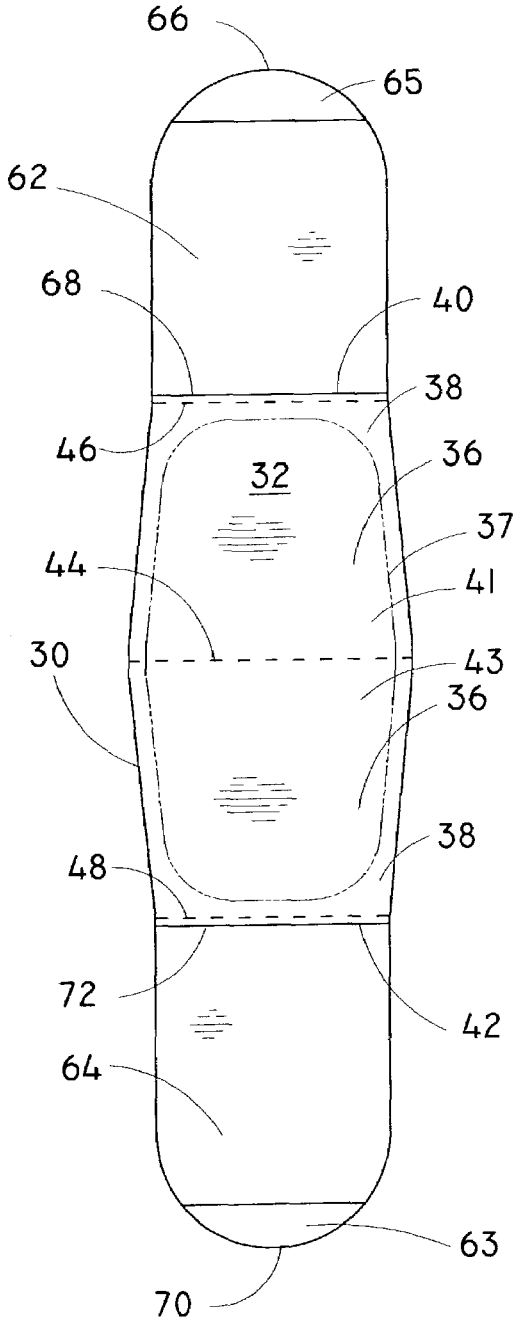
FIG. 2 is a top-view illustration of an alternative single-piece outer cover and attached draw members according to a first embodiment of the present invention.

A top-view illustration of an alternative single-piece outer cover and attached draw members according to a first embodiment of the present invention is shown in FIG. 2. This embodiment is essentially similar to the embodiment shown and described in FIG. 1 and the accompanying text, a difference being that both the first draw member 62 and the second draw member 64 are laterally substantially the same width as that of the outer cover 30 at its distal ends 40 and 42. Draw members which are substantially the same width as that of the outer cover at its distal ends are also known as full-width draw members throughout this document. The first draw member includes a first end 66, an opposed second end 68, and a first tab 65 which is located adjacent to the first end. The second end is attached to the first end of the outer cover adjacent to fold 46. Likewise, the second draw member includes a first end 70, an opposed second end 72, and a second tab 63 which is located adjacent to the first end, the second end being attached to the second end of the outer cover adjacent to fold 48.

When an inner container is placed between the sandwich halves, full-width draw members prevent the lateral edges of either or both the outer cover and the draw members from dragging on the adjacent sandwich half during removal of the outer cover from the center member. This is the preferred embodiment when using soft breads for the sandwich halves and should be used when the lateral edges of the outer cover stick to the sandwich halves.

Figure 3:
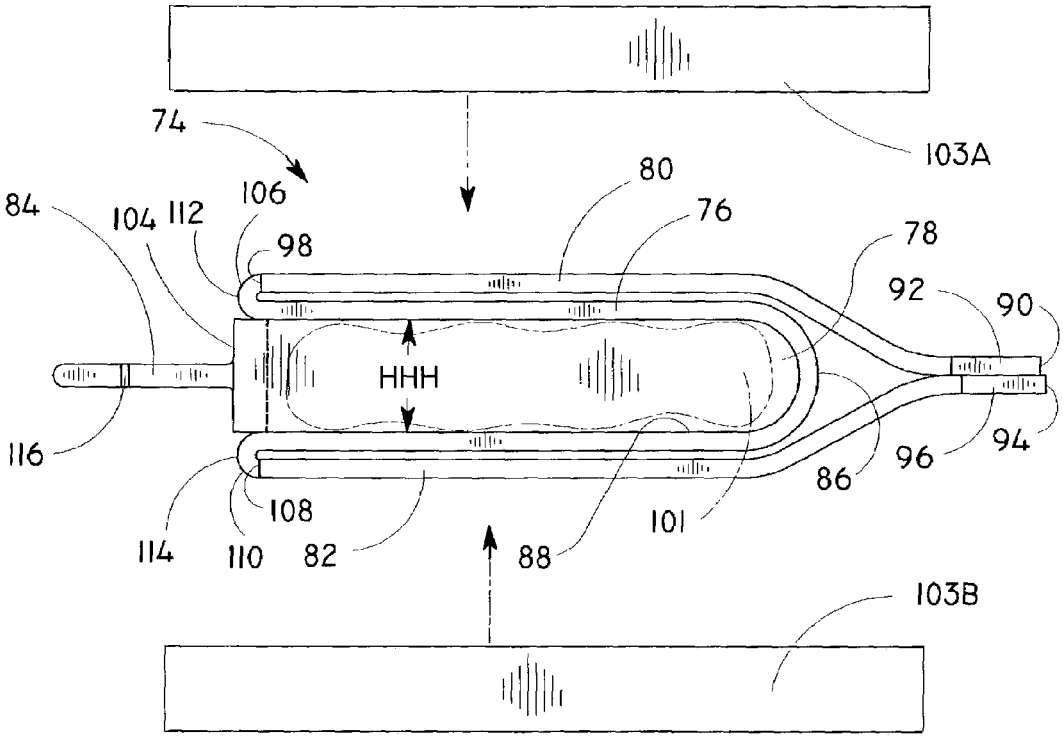
FIG. 3 is a side-view illustration of a first embodiment of the inner container of the present invention having a single outer cover.

A side-view illustration of a first embodiment of the inner container of the present invention having a single outer cover is shown in FIG. 3. The inner container, generally referenced 74, is constructed so as to hold a desired quantity of filler 101. The inner container is placed between two optional sandwich halves 103A and 103B so that a complete and ready-to-eat sandwich is formed after the inner container is opened (by removing the outer cover 76) and the center member and the sandwich halves (with the filling therebetween) are separated from each other.

The inner container comprises the outer cover 76, a center member 78, the first draw member 80, the second draw member 82, and a holding member 84. The outer cover is folded back over itself in the area that is adjacent to, and located along, the mid fold 86, so that the interior side 88 of the outer cover faces itself and so that the outer periphery of the outer cover is substantially aligned with and superposes itself. Alternatively, the outer periphery of the outer cover can be offset such that it does not have to be substantially aligned with itself (this will be desirable if using asymmetrically shaped center members). The outer periphery of the outer cover is releasably attached to the center member using a suitable sealing process (described infra) so as to form a cavity for holding the filler. Suitable sealing methods include thermal, pressure, adhesive, pressure-sensitive-adhesive, and other suitable methods as are known in the art, or combinations thereof, as will be discussed infra.

The outer cover is shaped and sized such that the outer periphery of the outer cover covers that area of the center member to which the outer cover is to be attached. In alternative embodiments, the outer cover is shaped and sized such that its outer periphery extends beyond the outer periphery of the center member.

The center member has a height HHH which is preferably sufficient so that the outer cover preferably does not bulge substantially due to the thickness of the filler contained within the inner container.

The first draw member and the second draw member are used as a means for removing the outer cover from the center member. The first end 90 of the first draw member extends far enough beyond the edge of the combination formed by the center member and the outer cover so that the first end is easily accessible to a user, and is provided with an optional first tab 92. The first tab should be shaped and sized such that a user may easily grasp the tab when using the invention. The second end 98 of the first draw member is attached to the first end 106 of the outer cover adjacent to fold 112.

The first end 94 of the second draw member extends beyond the perimeter of the outer cover so that it is easily accessible to a user, and is provided with an optional second tab 96. The second tab should be shaped and sized similarly to the first tab such that a user may easily grasp the tab when using the invention. The second end 108 of the second draw member is attached to the second end 110 of the outer cover adjacent to fold 114.

If desired, the lengths of the first draw member and the second draw member can differ so that the first end of the first draw member and the first end of the second draw member are offset (as shown).

In alternative embodiments, the first draw member and the second draw member are formed from a single sheet of material which is folded at a location that is adjacent to the first end of the first draw member so as to form a first draw member and a second draw member.

In yet other alternative embodiments, the first draw member and the second draw member are joined together in the area adjacent to the first end of the first draw member and the first end of the second draw member. Furthermore, if desired, the first tab and the second tab may be attached to each other or combined so as to form a single pull tab which is suitable for grasping. Such a pull tab provides an easy way for a user to grab and remove the outer cover thus exposing the sandwich contents to the bread.

A means for holding the inner container is provided. The means for holding the inner container should be attached to the center member (or, in alternative embodiments, can be releasably attached to the outer cover itself) and should be capable of maintaining a force which approximately is equal to the force exerted by the draw members when the inner container is being opened. In alternative embodiments, suitable holding means include straps, tabs, or other protrusions which are attached to, or formed integrally with, the center member, and which maintain the desired position of the center member during use of the invention (e.g., during filling and/or dispensing). Other suitable holding means include indentations (e.g., perforations, knurling, etc.) in (or attached to) the center member which would enable the user to grasp the center member. In yet other alternative embodiments, the holding means can comprise an adhesive which is attached to the inner container.

The holding means holds the inner container in a desired position when the outer cover is removed from the center member of the inner container (thus opening the inner container). Additionally, the holding means can be used for storing (e.g., hanging on a refrigerator shelf), holding (e.g., when taking the inner container out of a refrigerator etc.), and transporting the inner container. Furthermore, the means for holding can be used to hold those parts of the inner container which are still contained within the two sandwich halves after the outer cover is removed from the inner container.

A suitable holding means comprises a holding member 84. The holding member is shaped and sized such that it can slide into an optional opening or retention slot (as will be described infra) and includes a locking means such as notches 116 which are shaped and sized so as to lock the holding means into place for use, as will be described infra. Moreover, if required, the holding member should flex sufficiently to allow the notches to lock into place. Additionally, in alternative embodiments, the holding member is shaped and sized such that the user may grasp it for handling. In alternative embodiments, the locking means is an adhesive or other bond. In yet other alternative embodiments, the locking means may be attached directly to the center member, in which case the holding member is unnecessary.

The holding member is constructed from a flexible material and is attached to the base member 104 of the center member using pressure bonding, thermal bonding, adhesive, pressure-sensitive adhesive, or other suitable bonding methods as are known in the arts and which are compatible with the materials used. In alternative embodiments, the holding member may be formed integrally with the center member from the same sheet of material. Alternatively, the holding member may be constructed from a rigid material.

In other alternative embodiments, the holding means can be located on the same side as either or both the first tab and the second tab. In alternative embodiments, the first and second ends of the outer cover can extend so that they touch each other and, if desired, can also be releasably attached to each other, preferably using a pressure-sensitive adhesive or other suitable bond as is known in the art. In yet other alternative embodiments, one or more center members may be combined and used jointly when forming the inner container.

In other alternative embodiments, the center member is a flat sheet of material and has no substantial height. For example, parts of the center member (e.g., the side members) may be partially made integrally with the outer cover from the same sheet of material. The outer cover is separated from the center member by a weakened line (e.g., a score, tear-strip or other suitable method as is known in the art). The base member is then attached to the outer cover, and during separation of the outer cover from the base member, the side members are formed.

In use, the inner container is filled by attaching the lower portion of the outer cover to the center member so as to form a cavity for containing the filler. The filler is then placed on the lower portion of the outer cover, and the outer cover is then releasably attached to the center member. The optional upper and lower sandwich halves are then placed adjacent to the upper and lower sides of the inner container and, optionally, held in position using an optional outer container or box means etc. as will be described infra. Alternatively, the filler is placed on a portion of the outer cover, and the outer cover is then releasably attached to the center member. The optional sandwich halves are then applied as described supra.

Figure 4:
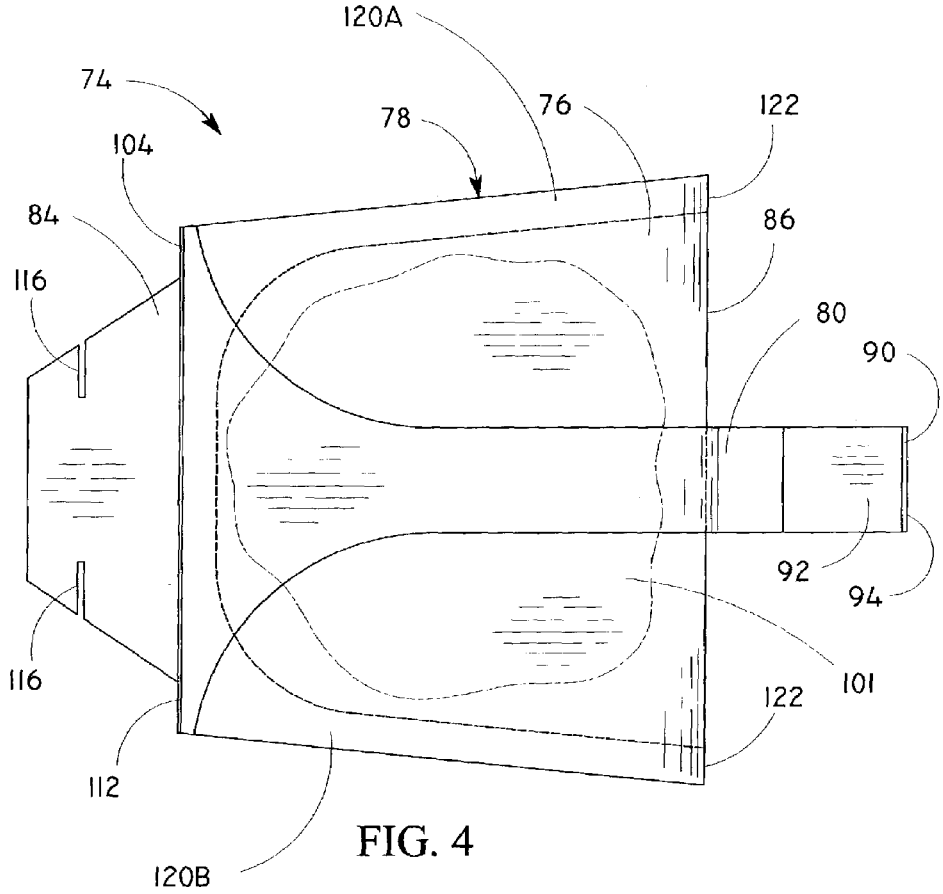
FIG. 4 is a top-planar-view illustration of the first embodiment of the inner container of the present invention, as shown in FIG. 3, having a single outer cover and a filler.

A top planar-view-illustration of the first embodiment of the inner container of the present invention, as shown in FIG. 3, having a single outer cover and a filler, is shown in FIG. 4. The inner container 74 is shown with the filler 101 contained therein. The center member 78 comprises a base member 104 and spaced-apart side members 120A and 120B which extend outward from the base member. The side members diverge slightly from each other as they extend outward from the base member (so that they avoid contacting the filler as much as possible when the center member is removed from the optional sandwich). The side members have ends 122 which are located opposite the base member. The ends of the side members are rounded, or otherwise shaped, so as to allow a peel-stress-type bond during removal of the outer cover 76 from the center member in the area of the ends. Alternatively, the side members extend outward parallel to each other or in other directions (e.g., the side members can be semi rounded, etc).

The draw members which are used are depicted as shown in FIG. 1 above. But, if bread or another soft substance is used for the sandwich halves, then wider draw members or full-width draw members (as shown in FIG. 2) should be used to provide for a smoother opening of the inner container as described supra.

In alternative embodiments, the side members may extend outward from the base member parallel to each other. In yet other alternative embodiments, the side members join each other at both ends so as to form a ring-like structure. In other embodiments, either or both side members are eliminated. In yet other alternative embodiments, one or more side members, or parts thereof, may be removable from the center member. In other alternative embodiments, a cross member is attached to the outer cover adjacent to the outer cover fold 86, and extends between the side members so as to provide additional rigidity to the outer cover (especially in those embodiments which use a multipart outer cover). The cross member can be optionally attached to either or both the outer cover and the center member.

In alternative embodiments, the base member or the bond between the base member and the outer cover, can be curved, "V" shaped, or shaped in some other way that will reduce the force required to break the bond between the outer cover and the base member. For example, the side members may form a "V" shape meeting at the center of the "V," in which case the base member is eliminated.

Figure 5:
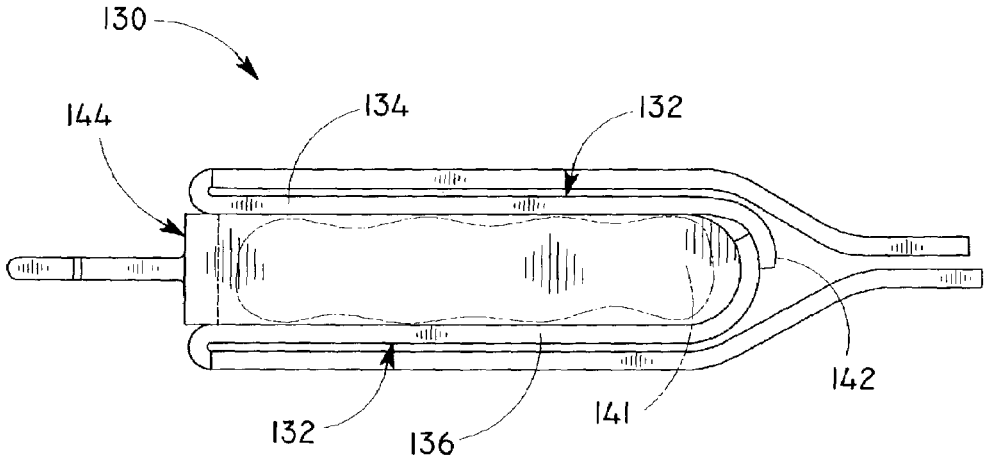
FIG. 5 is a side-view illustration of a second embodiment of the inner container of the present invention, having a two-piece outer cover.

A side-view illustration of a second embodiment of the inner container of the present invention, having a two-piece (multipart) outer cover, is shown in FIG. 5. The inner container, generally referenced 130, is similar to the inner container as shown in FIG. 4 and described above, but has a two-piece outer cover 132 which comprises a first sheet 134 and a second sheet 136. The outer cover is attached to the center member 144 similarly to the way it is attached in the first embodiment of the present invention. The first sheet is attached to the second sheet using a pressure-sensitive adhesive or other means (e.g., adhesives, thermal bonding, pressure bonding, a weakened line such as a perforated or scored line, etc.) as is known in the art. The first sheet is preferably attached to the second sheet in the area that is adjacent to the outer cover fold 142 so as to maintain a peel-stress-type bond between the outer cover and the center member 144 during removal of the outer cover from the center member. Alternatively, with adequate discretion, the first sheet is connected to the second sheet in other locations. In use, the first sheet is first separated and removed (to expose the filler 141) from the center member, and then the second sheet is optionally removed. In use, both the first sheet and the second sheet can be removed from the center member without having to separate both portions from each other. The inner container may also be used as a plate by removing only the first sheet and eating out of the container formed by the second sheet and the attached center member.

Figure 6A:
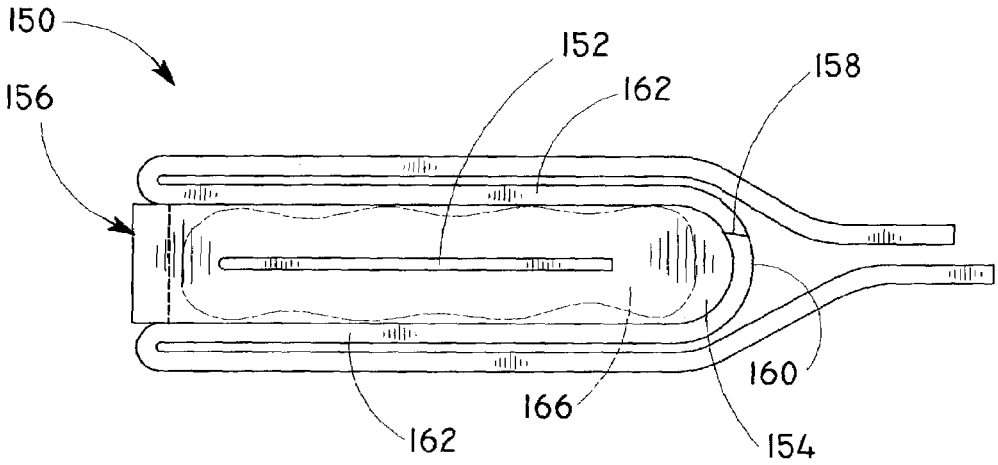
FIG. 6A is a side-view illustration of a third embodiment of the inner container of the present invention having a single outer cover.

A side-view illustration of a third embodiment of the inner container of the present invention having a single outer cover is shown in FIG. 6A. The inner container, generally referenced 150, is essentially similar to the inner container which is shown in FIG. 3 above and described in the corresponding text, with a difference being the inclusion of engaging tabs 152 which are attached to the side members 154 of the center member 156. Additionally, an optional weakened line 158 (e.g., a perforated or scored line), which runs transversely across the width of the outer cover 162 so that it extends to both side members, and is adjacent to the mid fold 160 of the outer cover, is included so the outer cover may be split or separated into two or more portions (e.g., a first sheet and a second sheet) if desired. A filler 166 is contained within the inner container.

Figure 6B:
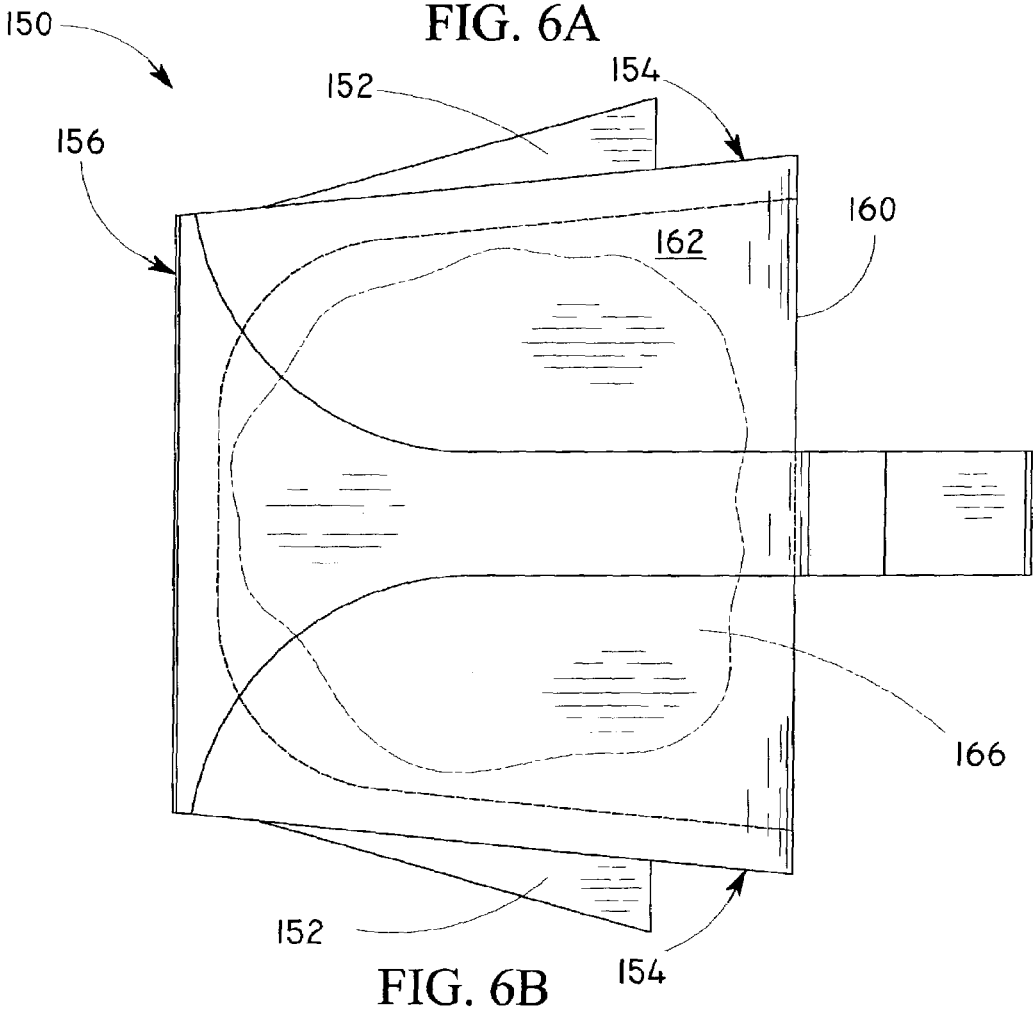
FIG. 6B is a top-planar-view illustration of a third embodiment of the inner container of the present invention, as shown in FIG. 6A, having a single outer cover and a filler.

A top-planar-view illustration of a third embodiment of the inner container of the present invention, as shown in FIG. 6A, having a single outer cover and a filler, is shown in FIG. 6B. The holding members are shaped such that they can lock into side notches of an optional outer container, or can be held by the user's hand.

Figure 7:
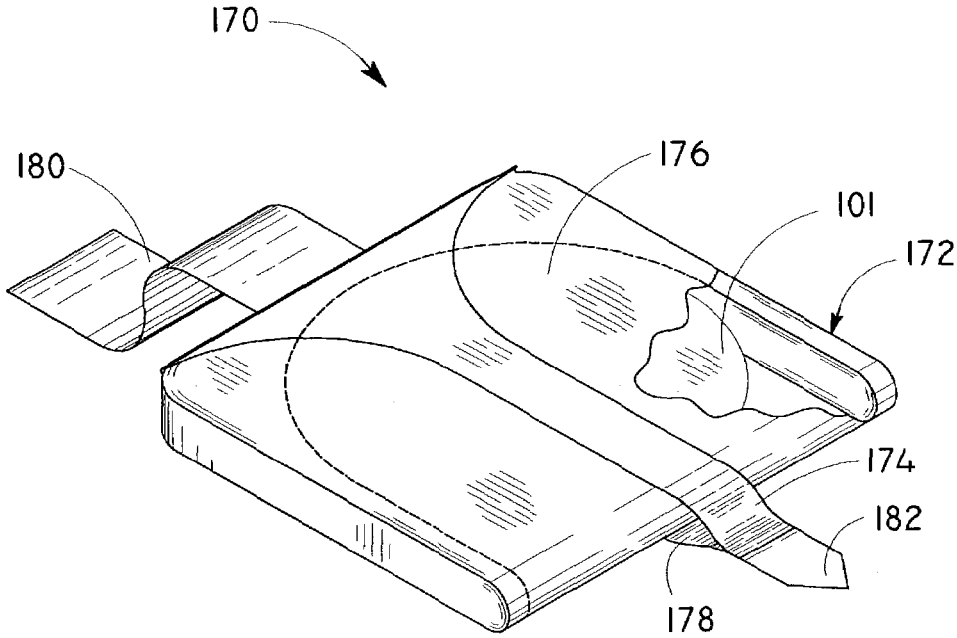
FIG. 7 is a perspective-view illustration of a fourth embodiment of the inner container of the present invention with a partial cutaway of the outer cover.

A perspective-view illustration of a fourth embodiment of the inner container of the present invention with a partial cutaway of the outer cover is shown in FIG. 7. The inner container, generally referenced 170, comprises a center member 172, an outer cover 176, a holding member 180, a first draw member 174, and a second draw member 178. The optional narrow-width draw members are shown for clarity, and in actual embodiments, it is preferred that full-width draw members be used. The outer periphery of the outer cover is releasably attached to the center member using a pressure-sensitive adhesive or other means (e.g., adhesives, thermal bonding, pressure bonding, a weakened line such as a perforated or scored line, etc.) as is known in the art. A flexible holding member is attached to the center member. In alternative embodiments, the holding member is formed integrally with the center member from the same sheet of material. In yet other alternative embodiments, the holding member is rigid. The holding container should be sufficiently wide, and should be placed, so that the center member does not significantly deform when the inner container is opened. In alternative embodiments, the holding member comprises a flexible section and a base section which is rigid. The base section is attached to the center member. The first end of the first holding member and the second end of the second holding member are releasably attached to each other so as to form a common tab 182.

Figure 8A:
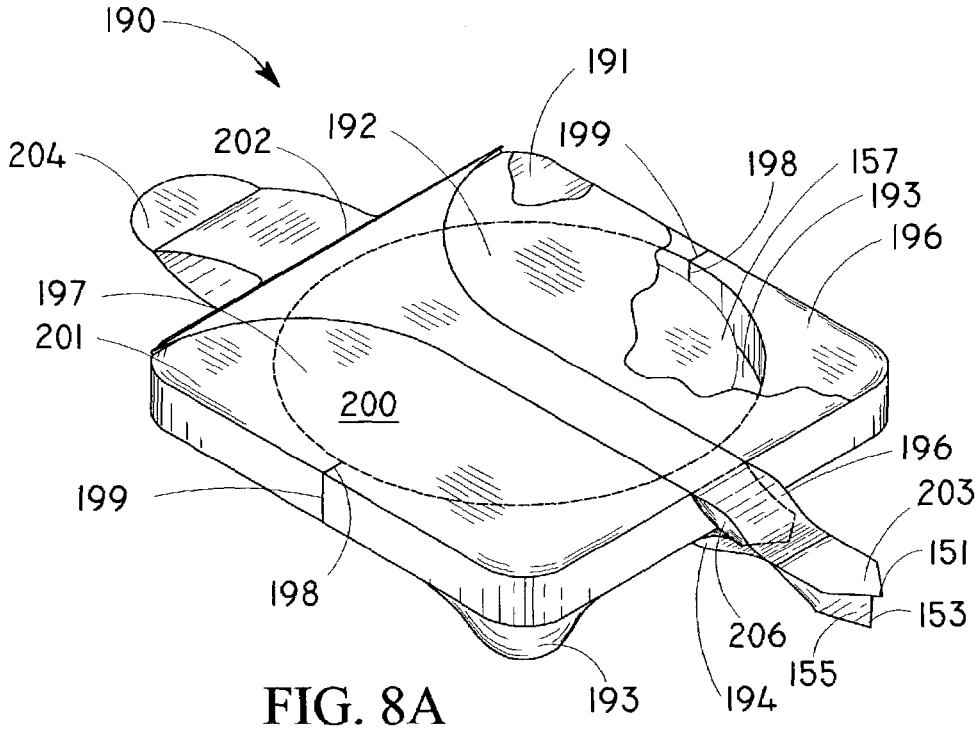
FIG. 8A is a perspective-view illustration of a fifth embodiment of the inner container of the present invention having a two-part center member and using a two-part outer cover.

A perspective-view illustration of a fifth embodiment of the inner container of the present invention having a two-part center member and using a two-part outer cover, is shown in FIG. 8A. The inner container 190 comprises a first center section 191, a second center section 196, a first outer cover 192, a second outer cover 193 (shown peeled back), a first draw member 196, a second draw member 194, and a means for holding.

The first center section has distal ends 198. The second center section has distal ends 199. The distal ends of the first center section are located adjacent to the distal ends of the second center section so that the first and second center sections encircle the desired filler.

The first outer cover (seen with partial sections cut away) has an interior side, an exterior side 200, an inner periphery 197, an outer periphery 201, and a first end 202 which projects from the outer perimeter of the outer periphery of the first outer cover. The second outer cover (seen peeled away from the second center section) is shaped and sized similarly to the first outer cover and has an interior side, an exterior side, an inner periphery, an outer periphery, and a second end which projects from the outer perimeter of the outer periphery of the second outer cover.

The first draw member extends from the first end of the first outer cover, and comprises a first end and an opposed second end 151, and an optional first tab 203. The second end of the first draw member is attached to a first end of the first outer cover. Likewise, the second draw member 194 extends from the second end of the second outer cover and comprises a first end 153, an opposed second end, and a second tab 155. The second end of the second draw member is attached to the second end of the second outer cover.

The outer periphery of both the first outer cover and the second outer cover are releasably attached (e.g., using adhesive, etc.) to both the first center section and the second center section so that the interior sides of both the first outer cover and the second outer cover face each other, and such that a cavity suitable for holding a filling is formed. The first tab and the second tab superpose each other and are attached to each other so as to form a common tab.

The means for holding the first and the second center sections comprises a first holding member and a second holding member. The first holding member 204 is attached to the first center section and provides a means for handling the inner container both before and after use. A second holding member 206 is provided for separating and removing the second center section from the first center section after the first and second outer covers are removed. After the first and second outer covers are removed from the center member, the center sections are removed from each other by pulling the holding members in opposite directions. If desired, the center member is then slid away from the filler 157. Narrow draw members are shown for clarity, and, in actual embodiments, full-width draw members are preferred.

A locating means (e.g., a weakened line, a tab, a hinge, a notch, a friction fitting, or other suitable locating method) is used to positively locate the center sections relative to each other so that after the outer covers are removed from the first and second center sections, the center sections are held adjacent to each other until they are separated from each other by the user. For example, adhesive tape having a desired strength can be attached to both the first center section and the second center section adjacent to, and across, the distal ends of both center sections. The tape should be sufficiently strong such that the center sections remain attached to each other during removal of the outer covers. After the outer covers have been removed, pulling the first and second holding members in opposite directions will break the tape and allow the center sections to be pulled apart from each other.

In alternative embodiments, one side of the adjacent distal ends of the first and second center sections are hingedly connected, while the other side is releasably attached so that after the first and second outer covers are removed from the first and second center sections, the first and second center sections can be pivoted (rather than separated) and then removed from the filler.

In alternative embodiments, only a single outer cover is used. This outer cover is wrapped around the second holding member such that the mid fold of the outer cover is adjacent to the second holding member.

In yet other alternative embodiments, the adjacent distal ends of the first and second center sections are hingedly connected to each other while the other pair of adjacent distal ends are releasably attached to each other so that after the outer covers are removed from the first and second center members, the first and second center members can be pivoted and removed from the filler. In yet other alternative embodiments, the first center member is attached to the second center sections at a weakened line (e.g., a score, perforation, etc.) and, if desired, they are separated from each other by pulling their holding members in opposite directions. In further alternative embodiments, the first and second center members are releasably attached to each other using a friction fit (e.g., a tab and a notch or other engaging means).

Figure 8B:
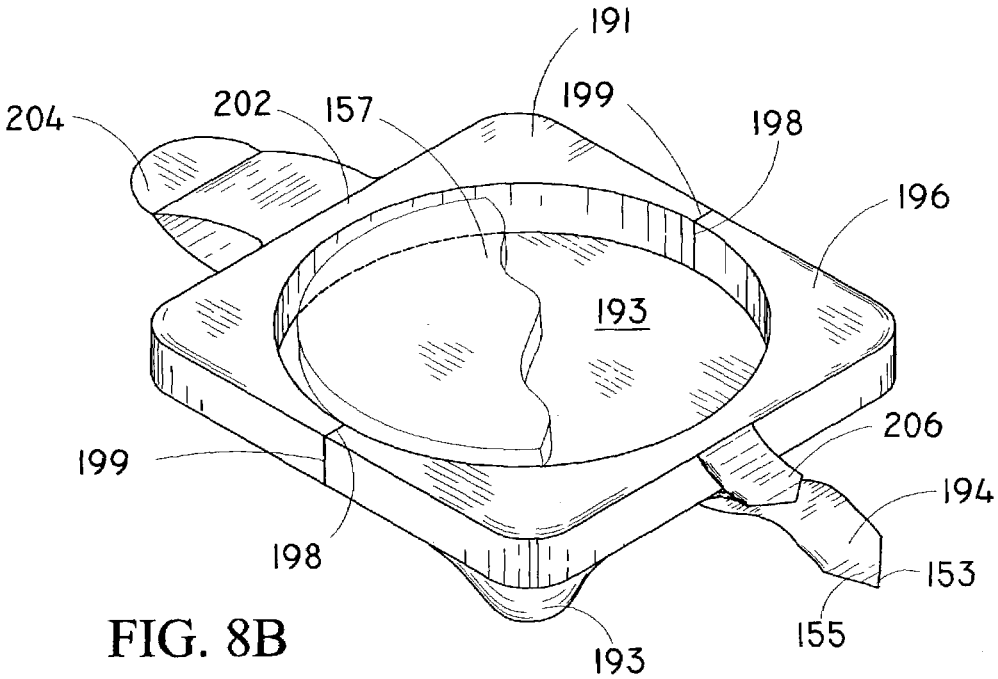
FIG. 8B is a perspective-view illustration of the fifth embodiment of the inner container of the present invention, as shown in FIG. 8A, with the first outer cover and attached draw member removed.

A perspective-view illustration of the fifth embodiment of the inner container of the present invention, as shown in FIG. 8A, with the first outer cover and attached draw member removed, is shown in FIG. 8B. The lower sheet 193 is seen under the filler 157 (which is partially cut away).

Figure 8C:
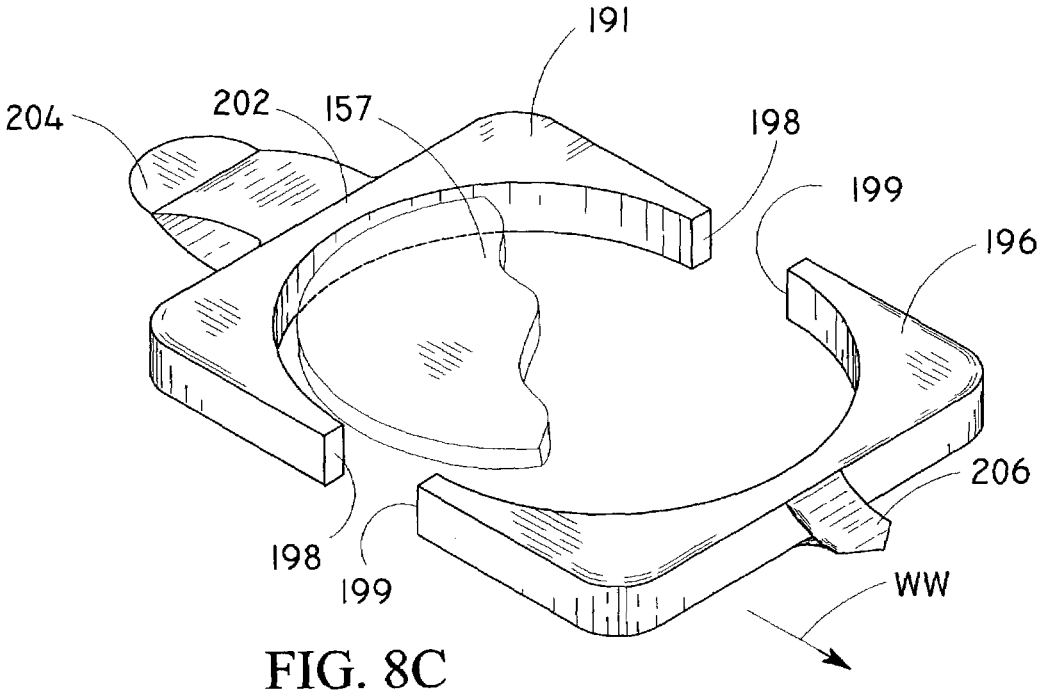
FIG. 8C is a perspective-view illustration of the fifth embodiment of the inner container of the present invention, as shown in FIG. 8A, with the outer covers removed and the center sections separated from each other.

A perspective-view illustration of the fifth embodiment of the inner container of the present invention, as shown in FIG. 8A, with the outer covers removed and the center sections separated from each other is shown in FIG. 8C. The second center section is held by the second holding member and is pulled in direction of arrow WW away from the first center section. The filler is partially cut away.

Figure 9:
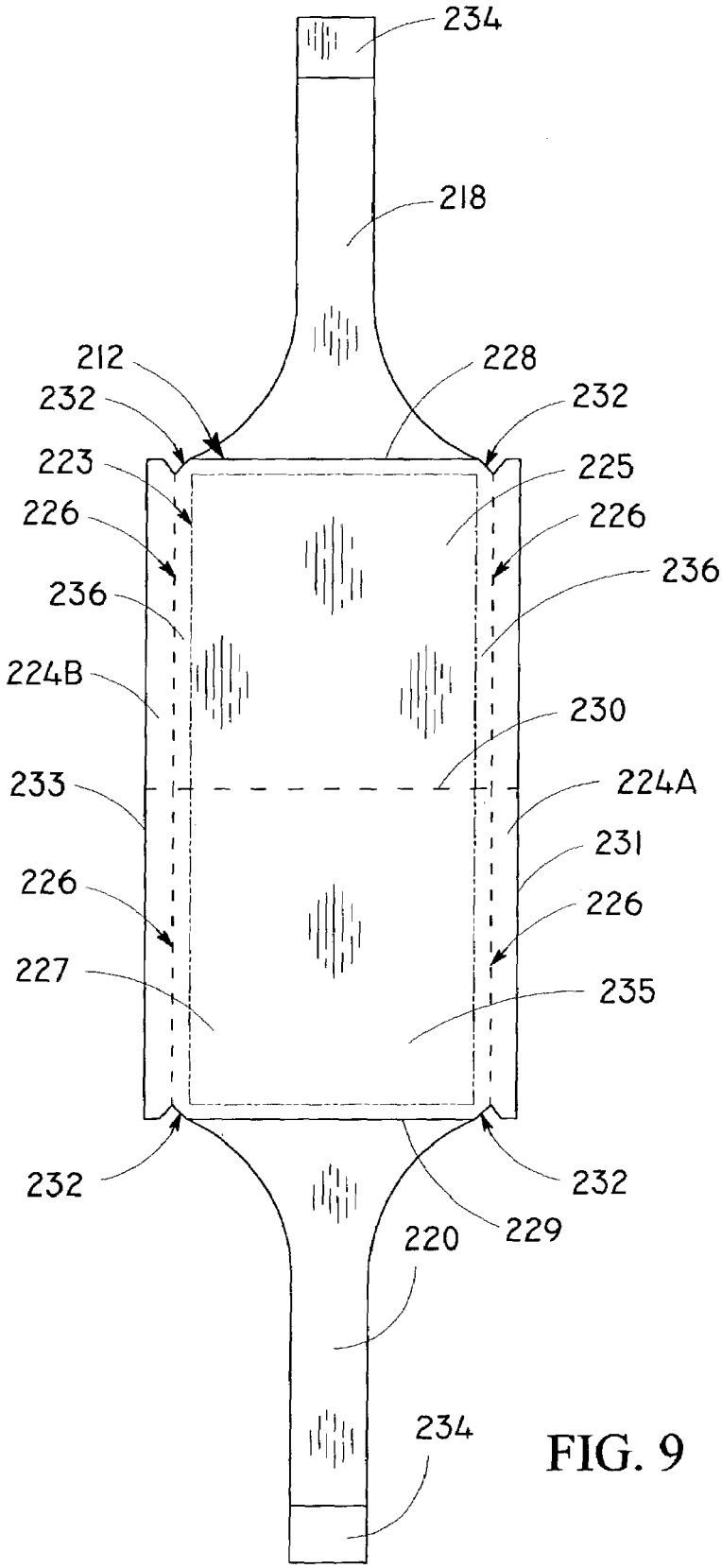
FIG. 9 is a top-view illustration of the single-piece outer cover and attached draw members according to the sixth embodiment of the present invention.

A top-view illustration of the single-piece outer cover and attached draw members according to the sixth embodiment of the present invention is shown in FIG. 9. The outer cover 212 has an inner periphery 235, an outer periphery 236, and first and second ends 228 and 229 respectively. The inner periphery and outer periphery are separated by line 223. The side extensions 224A and 224B extend along the longitudinal edge of the outer cover between the first and second ends of the outer cover. The side extensions are releasably attached to a portion of the outer perimeter of the outer cover at the weakened lines 226, and, preferably, run parallel to each other but, in alternative embodiments, can assume other shapes. The weakened lines can be formed by scoring (e.g., kiss cut, etc.), perforating, including a tear strip, or other suitable method. For instance, depending upon the material used, the weakened lines can be formed by the natural progression of a tear line. For example, when using cellophane (such as is commonly used in potato-chip packaging), a natural tear line will progress from the separation notches to the midfold. Those portions of the outer cover which lie between the mid fold and the first end of the outer cover are known as the first portion 225, while those portions of the outer cover which lie between the mid fold and the second end of the outer cover are to be known as the second portion 227.

In alternative embodiments, the holding means is formed by extending the side extensions at longitudinal edges 231 and 233 (which extend along the longitudinal length of the side extensions between the first and second ends of the outer cover) by any desired length.

Figure 10:
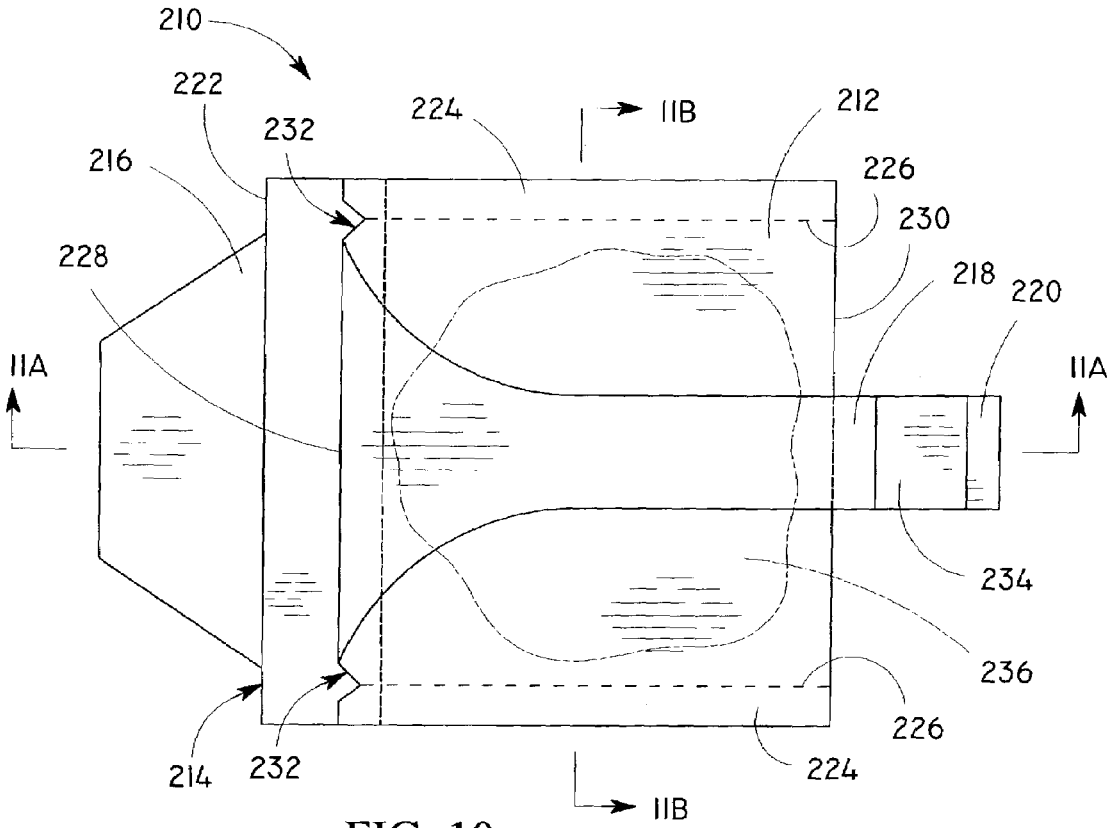
FIG. 10 is a top-planar-view illustration of a sixth embodiment of the inner container of the present invention having a composite center member and a single-piece outer cover.

A top-planar-view illustration of a sixth embodiment of the inner container of the present invention having a composite center member and a single-piece outer cover is shown in FIG. 10. The inner container, generally referenced 210, comprises the outer cover 212 (which will be described in more detail infra.), a retained portion 214, a holding member 216, a first draw member 218, and a second draw member 220. The retained portion comprises a base member 222 and two side members 224. The side members are releasably attached to the outer cover at weakened lines 226 (e.g., by scoring, perforating, tear cord, etc.) and are attached to the base member using any suitable bond (e.g., adhesives, thermal bonding, pressure bonding, etc.) so that the side members do not separate from the base member. The side members are formed from two side extensions which are formed integrally with the outer cover from the same sheet of material (as will be described infra.) and extend between the first and second ends 228 and 229 of the outer cover respectively, and the mid fold 230 of the outer cover.

Alternatively, the outer cover, holding member, retained portion and first and second draw members are all formed integrally from the same sheet of material. The different portions of the single sheet of material are assigned different names to illustrate the different functions performed by each portion. Further, the weakened lines may be eliminated and optional 'V' notches used to direct the tearing forces along the length of the outer cover (dashed lines 226). The forces are applied when the draw members are pulled so as to remove most of the outer cover to expose the sandwich filler therein while a small retained portion remains behind.

The outer cover is folded over itself (at the mid fold) and is releasably attached to the base member (which is formed integrally with the holding member from the same sheet of material—and is actually a part of the holding member) using any suitable bond (e.g., adhesive, thermal bonding, pressure, pressure-sensitive adhesive bonding, etc.). The adjacent opposed surfaces of the side extensions are attached to each other using a suitable bonding method (e.g., adhesives, thermal bonding, pressure, pressure-sensitive adhesive bonding, etc.) so as to form the completed side members. Optional separation notches 232 are located adjacent to the ends of the outer cover and intersect the weakened lines. The separation notches act to concentrate forces transferred from the draw members to the weakened lines so as to cause the weakened lines to tear. The separation notches are shown as large V-shaped cutouts but, in actuality, can be any type of weakened line. The holding member is attached to the center member. The first and second draw members are formed integrally with the outer cover from the same sheet of material. Optional tab means suitable for grasping are attached to the first and second draw members. Filler 236 is located within the inner container.

Figure 11A:
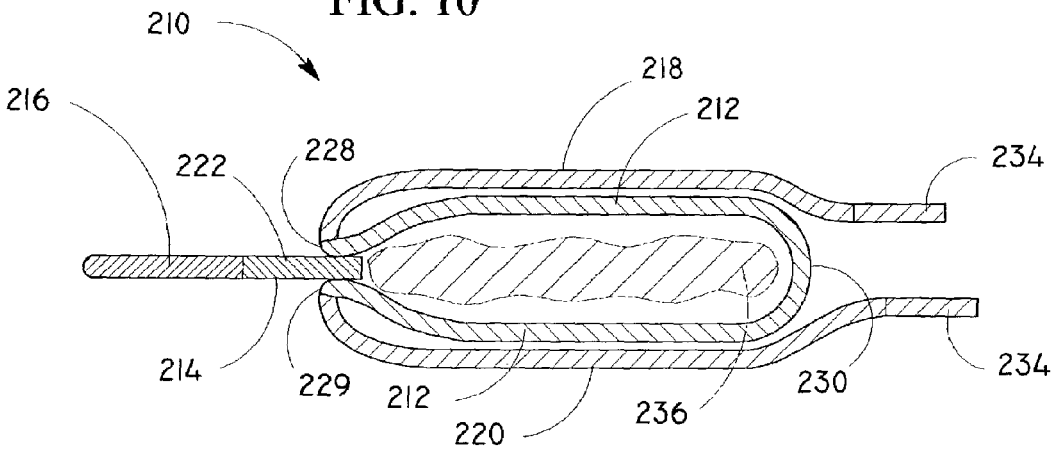
FIG. 11A is a sectional-view illustration of the sixth embodiment of the present invention taken along line 11A—11A of FIG. 10.

A sectional-view illustration of the sixth embodiment of the present invention taken along line 11A—11A of FIG. 10 is shown in FIG. 11A. The outer cover (and the attached side extensions) is folded at the mid fold (which is actually a sharp fold and not a gradually rounding fold as shown) and is attached to the base member as described supra, thus forming two side members. The adjacent interior portions of the side extensions are attached to each other, thus forming the side members. Each side member extends from the base member (to which it is attached) to the mid fold. Each draw member includes a tab means 234 which is suitable for grasping.

Figure 11B:
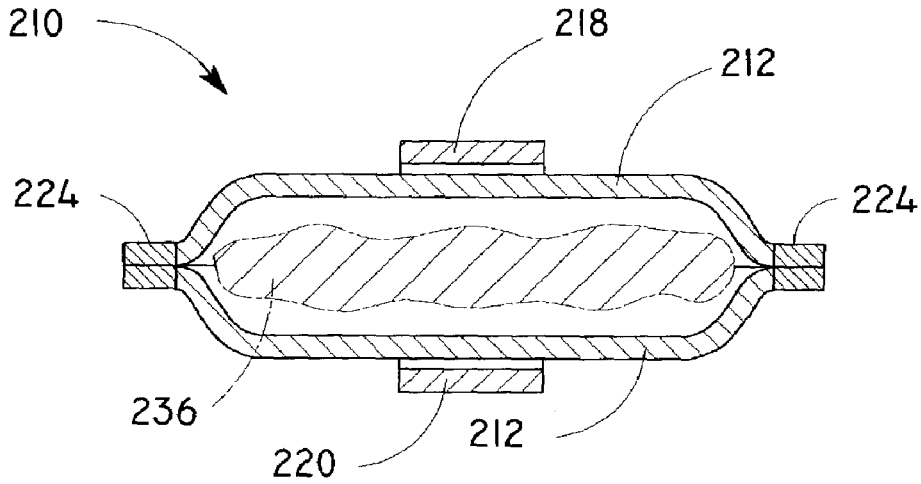
FIG. 11B is a sectional-view illustration of the sixth embodiment of the present invention taken along line 11B—11B of FIG. 10.

A sectional-view illustration of the sixth embodiment of the present invention taken along line 11B—11B of FIG. 10 is shown in FIG. 11B. The outer cover (and the attached side extensions) is folded at the mid fold, and the adjacent interior portions of the side extensions are attached to each other, thus forming the side members. In alternative embodiments, the weakened lines can be located closer to the interior portions of the container so that the outer cover can fold neatly over itself as it is separated from the side members. Additionally, an optional blocking member (not shown) can be inserted within the cavity of the inner container so as to equalize the exterior thickness and/or rigidity of the package in desired areas. Blocking members are desirable when using vacuum packaging and a thick filler. Blocking members can be placed at selected locations or continuously along the outer perimeter of the outer cover. Moreover, if desired, blocking members can be attached to the center member and/or the outer cover so that they can be removed when opening the package.

Figure 11C:
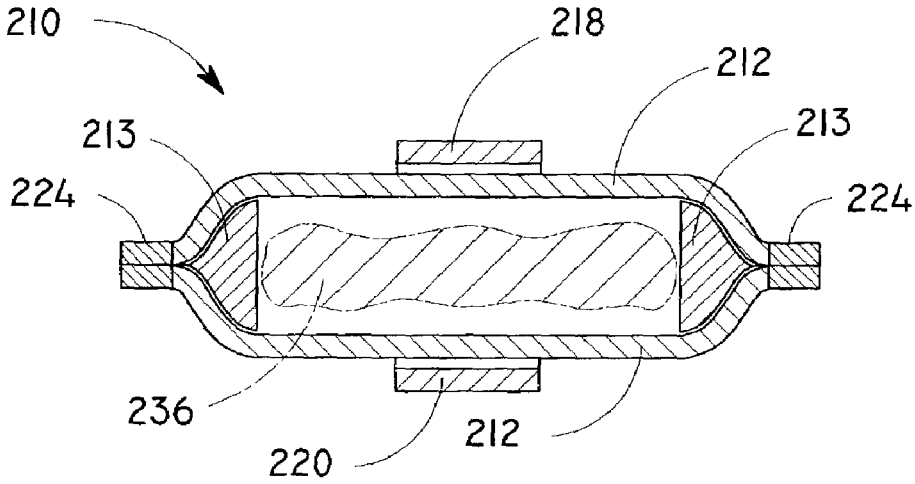
FIG. 11C is a sectional-view illustration of the inner container of FIG. 11B with blocking members inserted within the interior cavity.

A sectional-view illustration of the inner container of the present invention, as shown in FIG. 11B, with blocking members inserted within the interior cavity, is shown in FIG. 11C. The blocking members 213 are placed in the interior region of the inner container and extend substantially along the length of the side members so as to equalize the thickness of the package. The blocking members may be shaped and sized as desired.

Figure 12:
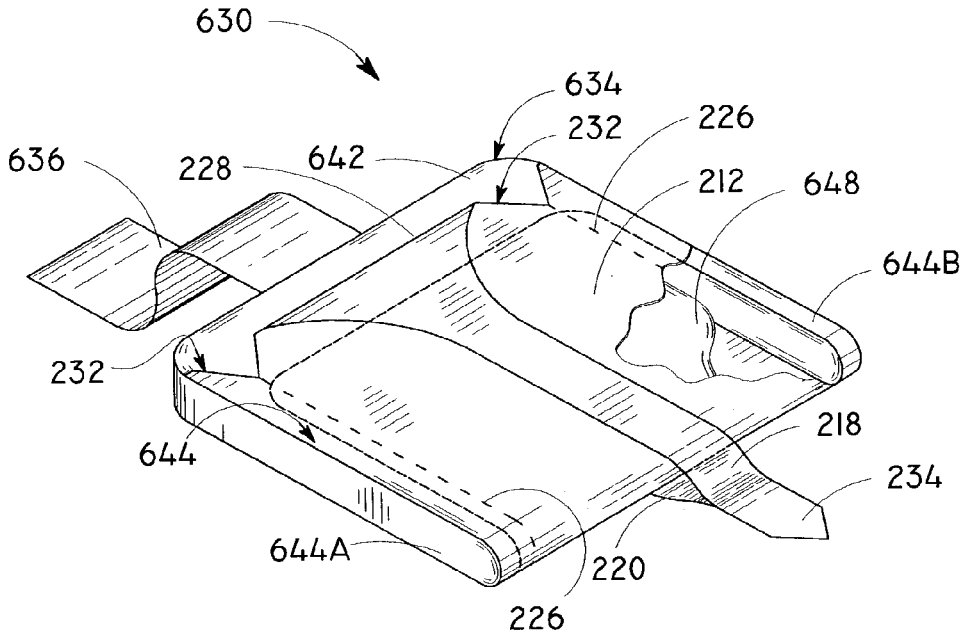
FIG. 12 is a perspective-view illustration of a seventh embodiment of the inner container of the present invention having a composite center member and a single-piece outer cover.

A perspective-view illustration of a seventh embodiment of the inner container of the present invention having a composite center member and a single-piece outer cover is shown in FIG. 12. The inner container, generally referenced 630, comprises the outer cover 212, the center member 634, a holding member 636, a first draw member 218, and a second draw member 220. The center member 634 comprises a base member 642 and two center side members 644A and 644B. The outer cover is the same as the outer cover as shown and described in FIG. 9 above. The outer cover and the adjacent side extension are partially cut away to view a side member and the filler 648 contained within the inner container.

The outer cover 212 is folded over itself (at the mid fold) and is releasably attached (in the area that lies between the weakened lines 226 and is adjacent to the first and second ends 228 and 229 respectively) to the base member 634 using a suitable bond (e.g., adhesive, thermal bonding, pressure, pressure-sensitive adhesive bonding, etc.). The side extensions of the outer cover are attached to the adjacent side member of the center member using a suitable bond (e.g., adhesive, thermal bonding, pressure, pressure-sensitive adhesive bonding, etc.) thus forming the completed side members. In use, the outer cover separates from the side members at the weakened lines.

Figure 13:
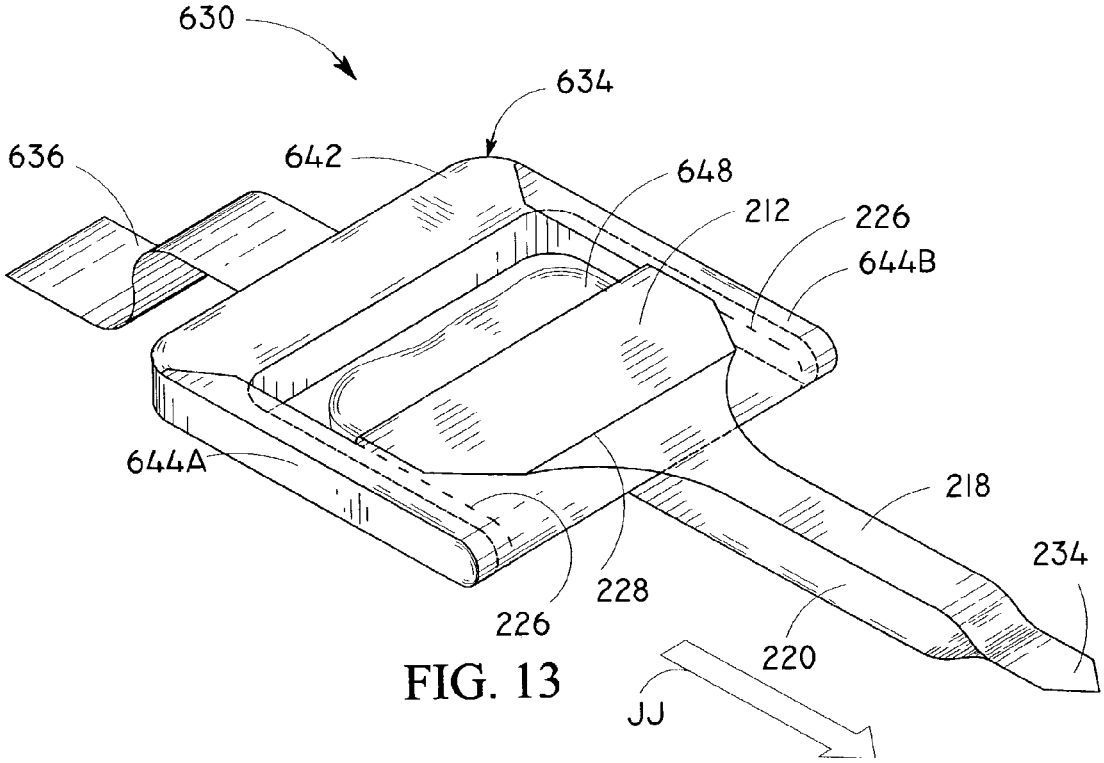
FIG. 13 is a perspective-view illustration the inner container of the present invention, as shown in FIG. 12, as the outer cover is separated from the center member.

A perspective-view illustration of the inner container of the present invention, as shown in FIG. 12, as the outer cover is separated from the center member, is shown in FIG. 13. The outer cover is pulled in the direction of arrow JJ (by the draw members), which causes the outer cover to separate from the center member and to separate at weakened lines 226, and peel back over itself, thus exposing the filler. Continued pulling on the draw members causes the outer cover to fully separate from the center member. In alternative embodiments, parts of the center member can be attached to the exterior side of the outer cover adjacent to the side members.

Figure 14A:
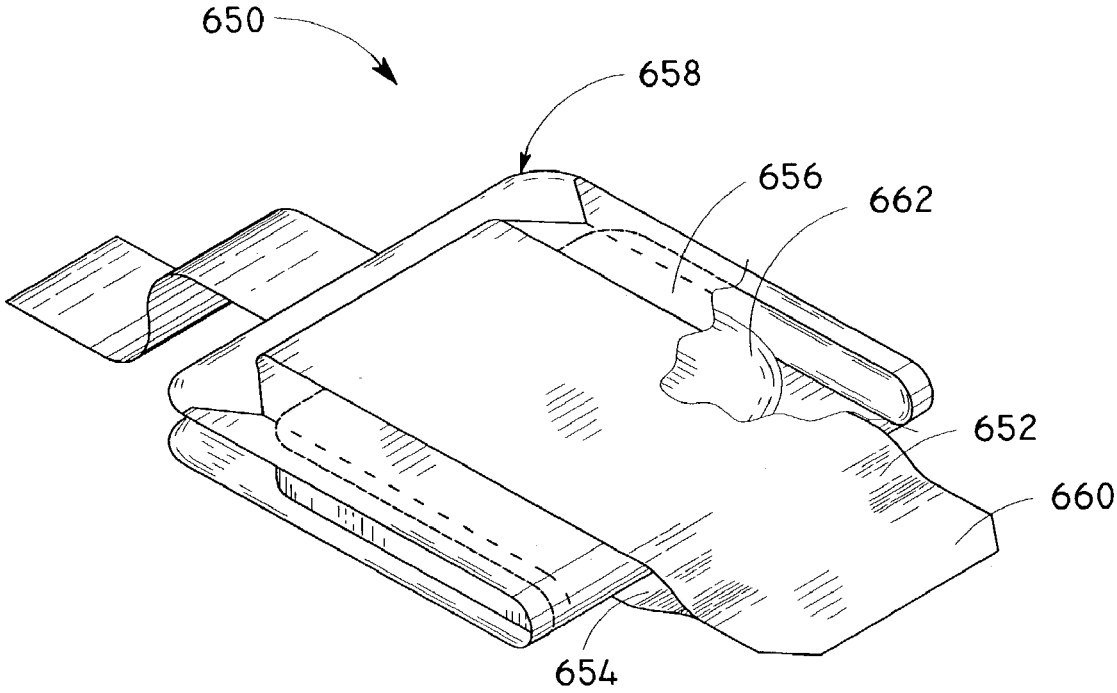
FIG. 14A is a perspective-view illustration the inner container of the present invention, as shown in FIG. 12, having a full-width draw member.

A perspective-view illustration of the inner container of the present invention, as shown in FIG. 12, having full-width draw members is shown in FIG. 14A. The inner container, generally referenced 650, is essentially similar to the inner container which is shown in FIG. 12 above and is described in the corresponding text, with a difference being the substitution of full-width first and second draw members 652 and 654 respectively, which are attached to the outer cover 656. An additional difference is the use of a hollowed-out (rather than solid) center member 658. Optional tab means comprises a common tab 660. Filler 662 is located within the inner container.

Figure 14B:
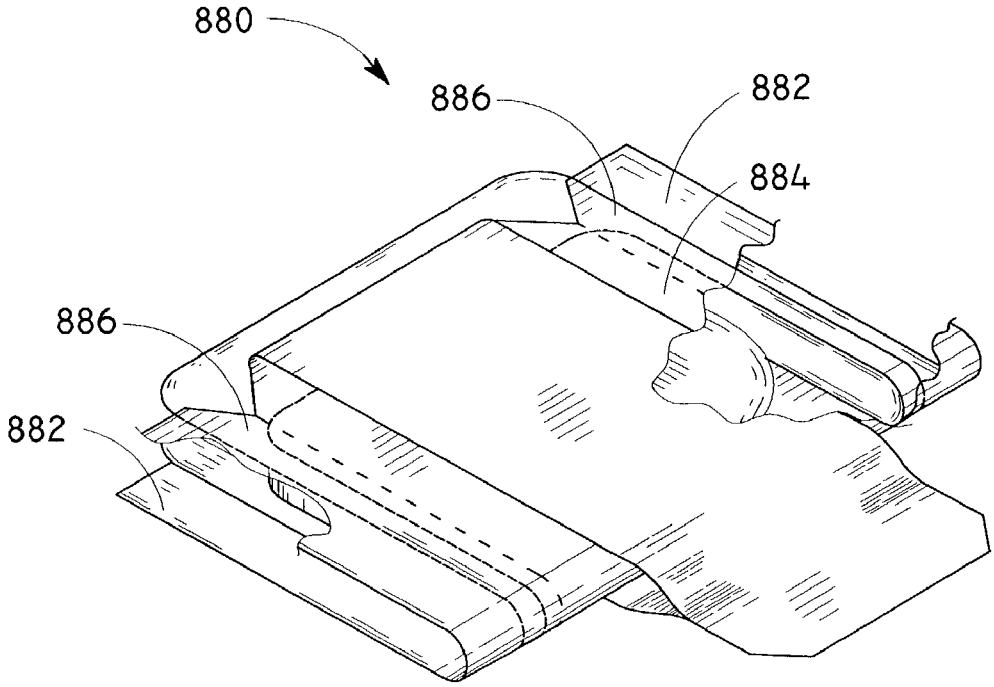
FIG. 14B is a perspective-view illustration of the inner container of the present invention, as shown in FIG. 14A, having a holding means which is formed integrally with the outer cover.

A perspective-view illustration of the inner container of the present invention, as shown in FIG. 14A, having a holding means which is formed integrally with the outer cover, is shown in FIG. 14B. The inner container, generally referenced 880, is essentially similar to the inner container which is shown in FIG. 14A above and is described in the corresponding text, with a difference being the substitution of holding members 882 (shown with partial sections cut away) which are attached to, and formed integrally with, the side extensions of the outer cover 884 (which is also partially cut away for better illustration).

Figure 15:
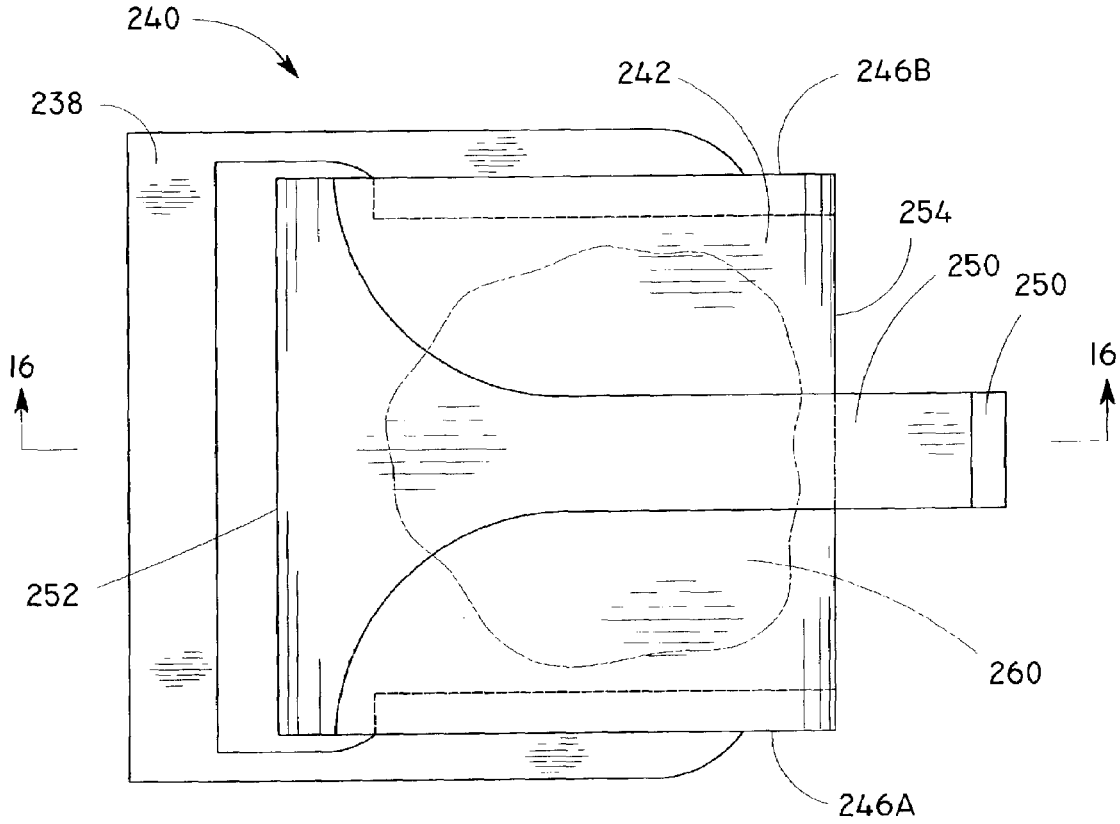
FIG. 15 is a perspective-view illustration of an eighth embodiment of the inner container of the present invention using a composite center member.

A perspective-view illustration of an eighth embodiment of the inner container of the present invention using a composite center member is shown in FIG. 15. The inner container, generally referenced 240, comprises an outer cover 242, a center member, a holding means, and two draw members 250. The outer cover 242 is similar to the outer cover as shown in other embodiments of the present invention and has an inner periphery, an outer periphery, an interior side, and a first end and a second end 252 and 253 respectively. The draw members are formed integrally with the outer cover from the same sheet of material and are attached to the outer cover. The center member comprises two side members 246A and 246B. The side members are held in position relative to each other (when the outer cover is removed) by the holding means. A suitable holding means comprises a holding member 238 which is attached to each of the side members and extends around the external perimeter of the outer cover and center member. The holding means should be sufficiently rigid so that the side members do not substantially flex during opening of the inner container. The outer cover is folded at mid fold 254 and is releasably attached (e.g., using adhesive, thermal bonding, pressure bonding, pressure-sensitive adhesive, etc.) to the side members so as to form a cavity for containing the filler 260.

Figure 16:
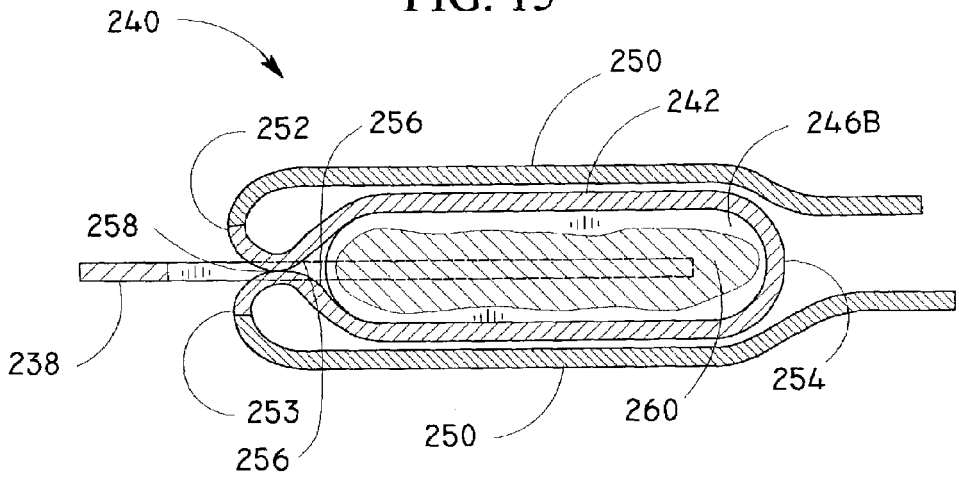
FIG. 16 is a sectional-view illustration of the eighth embodiment of the inner container as shown in FIG. 15.

A sectional-view illustration of the eighth embodiment of the inner container taken along line 16—16 of FIG. 15 is shown in FIG. 16. The outer cover is folded at the mid fold and is releasably attached to the side members as discussed above. Portions of the interior side 256 of the outer cover which are adjacent to each other at the first and second ends 252 and 253 respectively of the outer cover, are releasably attached to each other at bond 258 using pressure sensitive adhesive bonding or other suitable bonding method as discussed elsewhere in this document so that pulling on the draw members separates the bond 258 and also causes the outer covers to separate from the side members.

Figure 17:
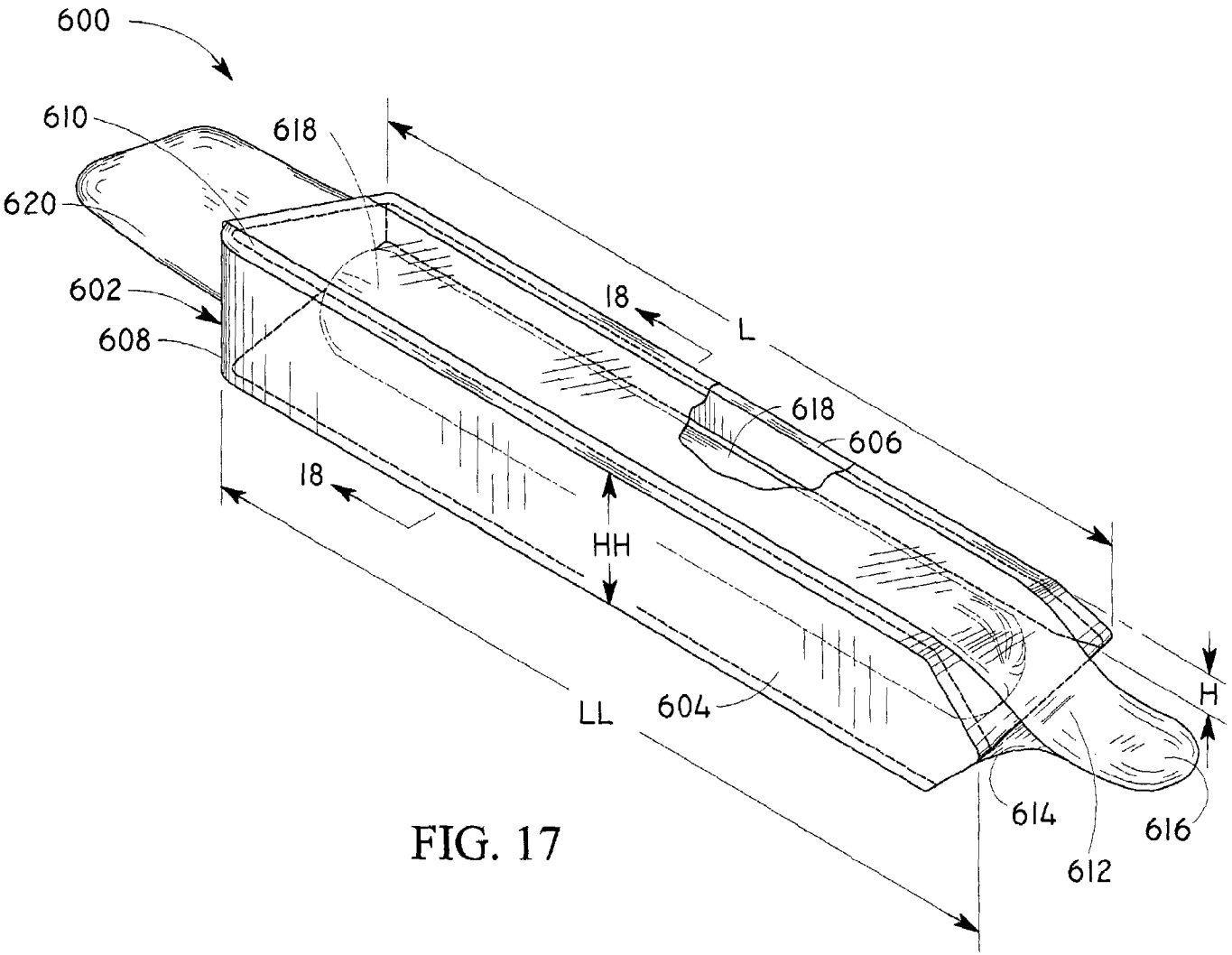
FIG. 17 is a perspective-view illustration of a ninth embodiment of the inner container of the present invention with a partial cutaway of the outer cover and the first draw member.
Figure 18:
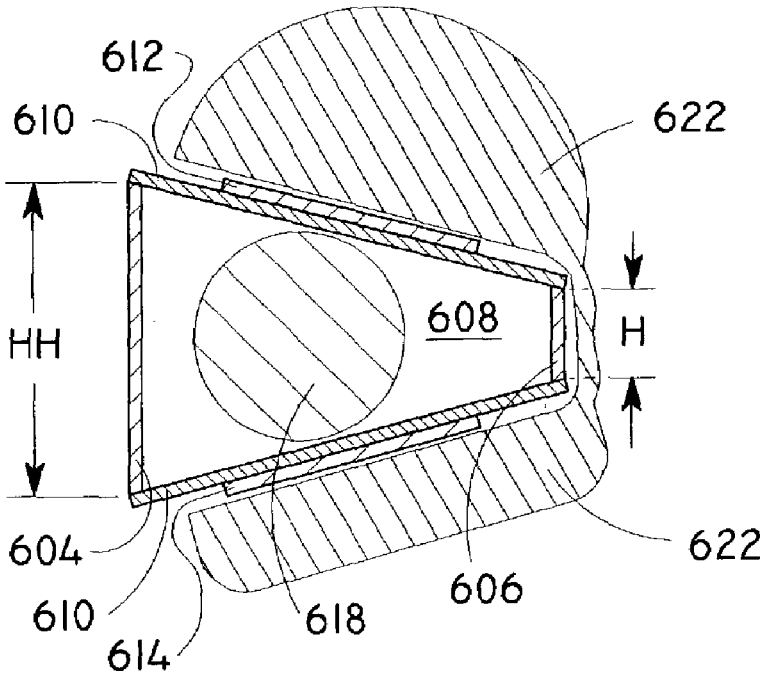
FIG. 18 is a cross-sectional-view illustration of the ninth embodiment of the inner container of the present invention, taken along line 18—18 of FIG. 17.

A perspective-view illustration of a ninth embodiment of the inner container of the present invention with a partial cutaway of the outer cover and the first draw member is shown in FIG. 17. The inner container, generally referenced 600, is essentially similar to the inner container which is shown in FIG. 3 above, and which is described in the corresponding text, with a difference being the use of an asymmetric center member rather than a symmetric or substantially symmetric one. This embodiment is particularly suitable for long items (e.g., hotdogs and the like) which are placed within an opened bun in which each of the two sandwich portions are connected to each other (as opposed to buns or other types of bread or rolls in which each sandwich portion is fully separated from the other). The center member 602 comprises a first side member 604, a second side member 606, and a base member 608. The first side member has a height HH and a length LL. The second side member has a height H and a length L. Heights H and HH are not equal to each other, so as to result in the inner container being wedge-shaped (when viewed from the side member ends to the base member as shown in FIG. 18 below). Additionally, lengths L and LL are not equal to each other, so that the outer cover 610 can be releasably attached to the center member without having to bend or fold the outer cover. Alternatively, the outer cover can be folded and attached to itself as desired. The base member is attached to both the first side member and the second side member. In alternative embodiments, the length of the first side member is substantially the same as the length of the second side member.

The outer cover is shaped and sized such that its outer periphery can be releasably attached to the center member (e.g., as shown the outer cover has a slight V-bend which is centered on the mid fold). A first draw member 612 and a second draw member 614 are attached to the outer cover. The first tab of the first draw member and the second tab of the second draw member are attached to each other so as to form an optional common tab 616. A filler (e.g., a hotdog as shown) 618 is contained within the inner container. A holding means comprising a holding member 620 is attached to the base member. The inner container is optionally heat stable and can be placed in an oven or other suitable device to cook or warm the filler if so desired. Additionally, the side members and/or the outer cover can be made from an optional transparent material so that the user can view the filler if so desired. In alternative embodiments, the inner container includes an optional weakened area or line which opens to release excess pressure when heating the inner container.

A cross-sectional-view illustration of the ninth embodiment of the inner container of the present invention, taken along line 18—18 of FIG. 17, is shown in FIG. 18. The inner container is shaped so that it can be at least partially inserted into an opened hotdog bun 622 as shown. The first side member has a height H and the second side member has a height HH. Heights H and HH are unequal, so as to result in the inner container being wedge-shaped. The filler (e.g., the hotdog) is contained within the inner container.

Figure 19:
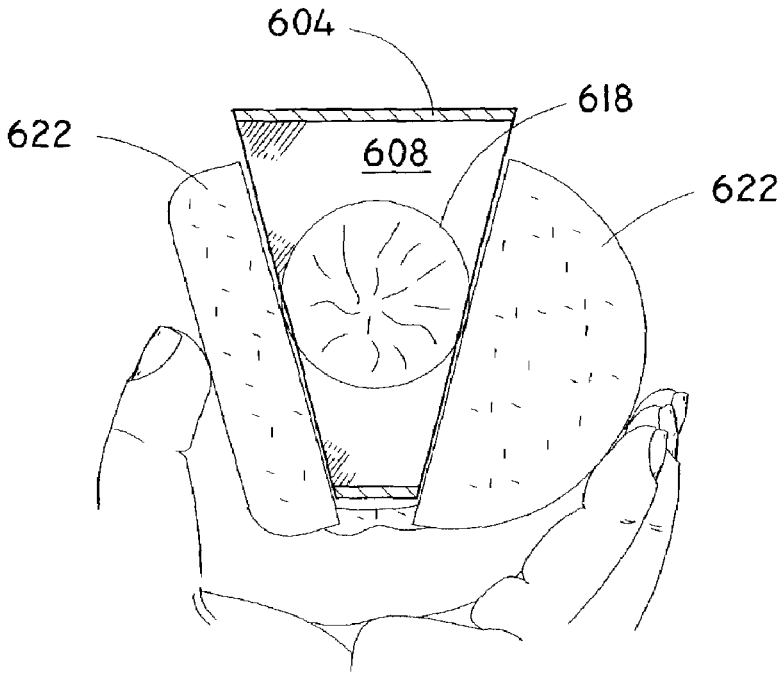
FIG. 19 is a side-view illustration of the ninth embodiment of the inner container as shown in FIG. 18 inserted within a hotdog bun, with the outer cover opened and removed.

A side-view illustration of the ninth embodiment of the inner container inserted within a hotdog bun, with the outer cover opened and removed, is shown in FIG. 19. The hotdog bun is optionally held with the open side facing up such that the filler (hotdog) contained within falls into the bun when the outer cover of the inner container is removed as shown.

Figure 20:
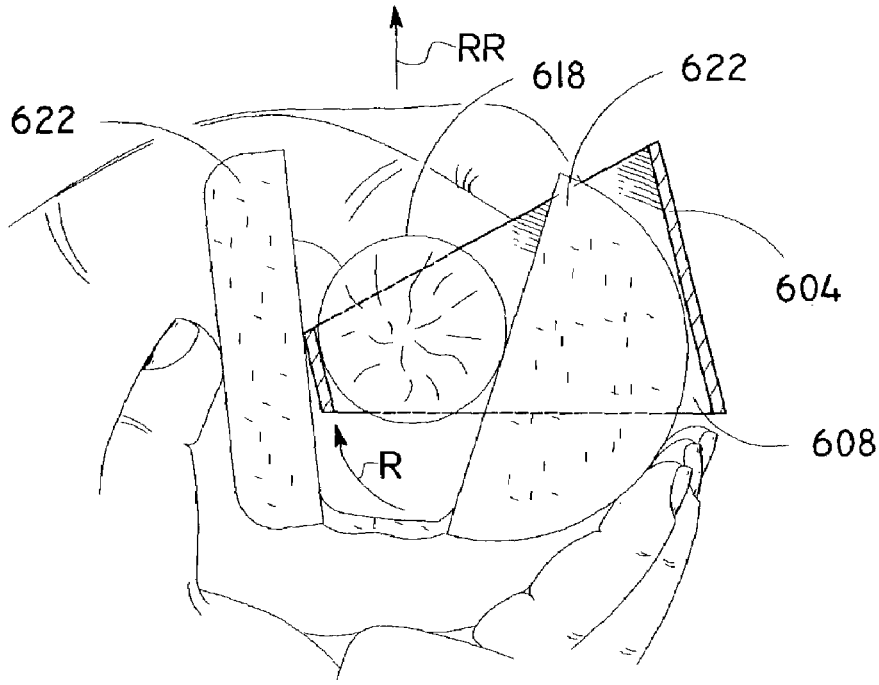
FIG. 20 is a side-view illustration of the ninth embodiment of the inner container as shown in FIG. 19 as it is removed by rotating the inner container.

A side-view illustration of the ninth embodiment of the inner container as shown in FIG. 19 as it is removed by rotating the inner container is shown in FIG. 20. In this embodiment, the center member has rigid side members, allowing the center member to be rotated about its longitudinal axis (such as in direction R) and then removed from the filler and the bun by pulling in direction RR after the outer cover is removed. Alternatively, the inner container can be removed from the bun by pulling the inner container and the combination formed by the filler and the bun in a direction which is either parallel to, or substantially parallel to, the longitudinal axis of the inner container as shown and described elsewhere in this document.

Figure 21A:
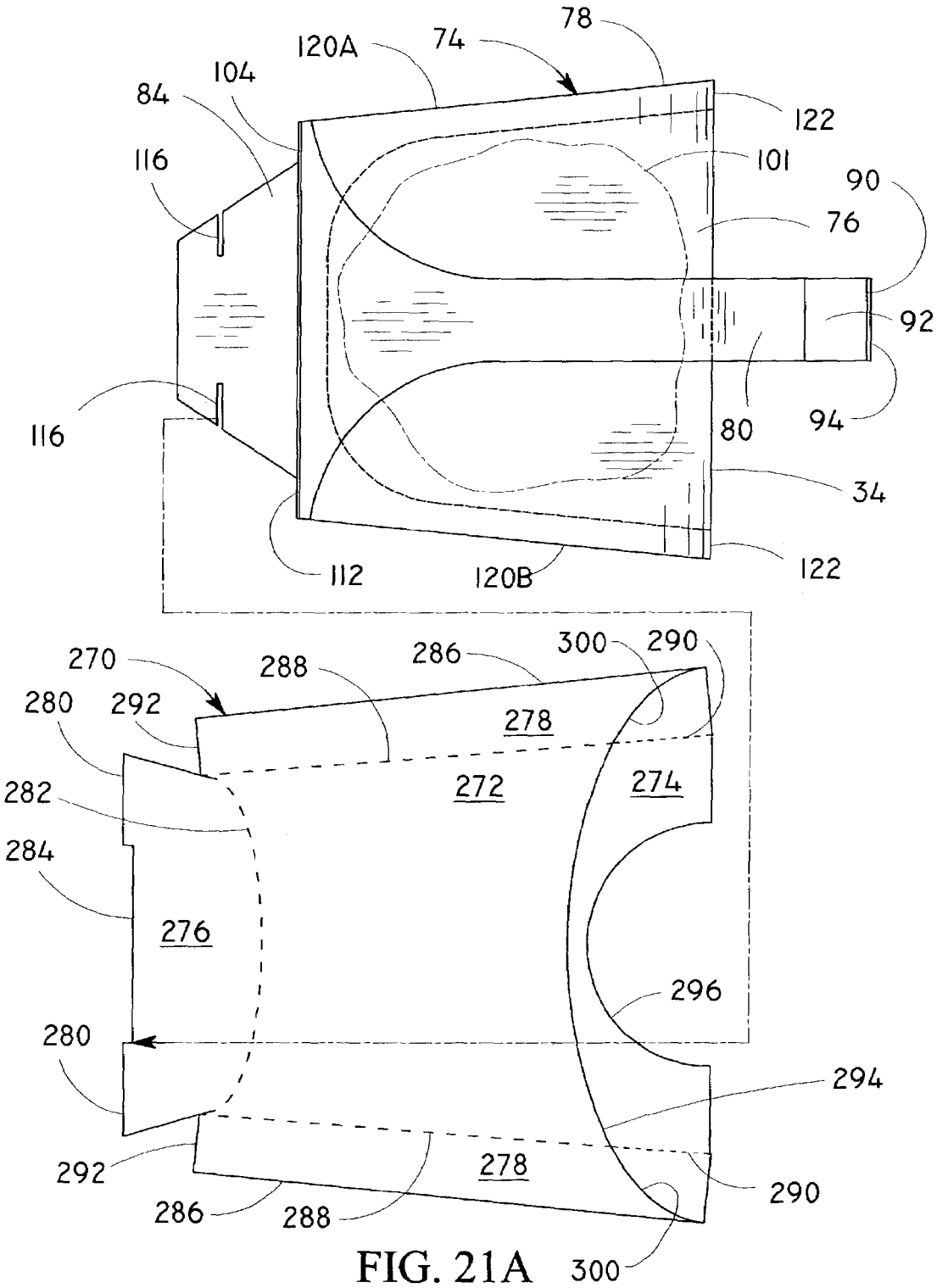
FIG. 21A is an exploded top-planar-view illustration of a first embodiment of an outer container, with the inner container as shown in FIG. 4.

An exploded top-planar-view illustration of a first embodiment of an outer container, with the inner container as shown in FIG. 4 above, is shown in FIG. 21A. The outer container 270 is a pop-open box which is common in the art, and is shown folded flat. The outer container is formed from a unitary blank of a semi-rigid material (e.g., cardboard, treated-paper, plastic, solid polymers, laminates, etc.) and includes a first side panel 272, a second side panel 274, a bottom panel 276, and side panels 278. The bottom panel is symmetrically folded about the bottom fold 280, and terminates at the first fold 282 which is adjacent to the first side panel, and on the other side terminates at the second fold (which is superposed by the first fold 282 and is shown as 283 in FIG. 21B infra), which is adjacent to the second side panel. An optional retention slot 284 is provided to retain the holding member 84 by engaging the notches 116 of the holding member. Alternatively, retention slots can be located adjacent to the side fold and retain holding members which are located on the side members of the center member as shown elsewhere in this document. Alternatively, adhesive or other suitable bonding method can be used to attach the inner container to the outer container.

The side panels of the outer container include side folds 286. The side panels are folded about their side folds and terminate on one side at the first fold 288 which is adjacent to the first side panel, and on the other side, at the second fold 290, which is adjacent to the second side panel. The side panels further include a side portion bottom 292 which is optionally cut so that the outer container remains upright if placed in an upright position and a side panel top 300, both of which extend from the first fold to the second fold and are folded about the side fold 286. The first side panel has a free edge 294 which extends between the first folds 288, and has an indentation which extends toward the first fold. Likewise, the second side panel has a free edge 296 which extends between the first folds, and has an indentation which extends toward the bottom panel. Alternatively, either or both of the free edges can be shaped as desired. The outer container has an opening which is located opposite the bottom panel, and which is defined by the free edges 294 and 296 of the first side panel and the second side panel respectively, and the side panel top 300 of the side panels 278. The outer container should be sized such that it holds the sandwich halves tightly and prevents the sandwich halves from moving when the outer cover is removed from the center member. Each second fold 290 extends from the adjacent side panel top to the side panel bottom, running substantially parallel to the adjacent first fold.

The inner container 74 is similar to the inner container which is shown in FIGS. 3 and 4, and is shown with narrow draw members for illustrative purposes only. The outer container receives and retains the inner container. The holding member 84 of the inner container is received by and held in place by a retention slot 284 which engages the notches 116 of the inner container. In alternative embodiments, an optional adhesive (e.g., heat bonding, etc.) can be used to attach the inner container to the outer container. In alternative embodiments the holding members may extend around the exterior portions of the outer container.

In one method of use, the inner container is filled and then inserted into the opening of the outer container so that the holding member slides into and engages the retention slot so that the inner container is firmly attached to the outer container. The outer container is then unfolded and the bottom panel is firmly positioned to hold the outer container in the opened position. Sandwich halves are then placed on either or both sides of the inner container and are held in position by the outer container.

Figure 21B:
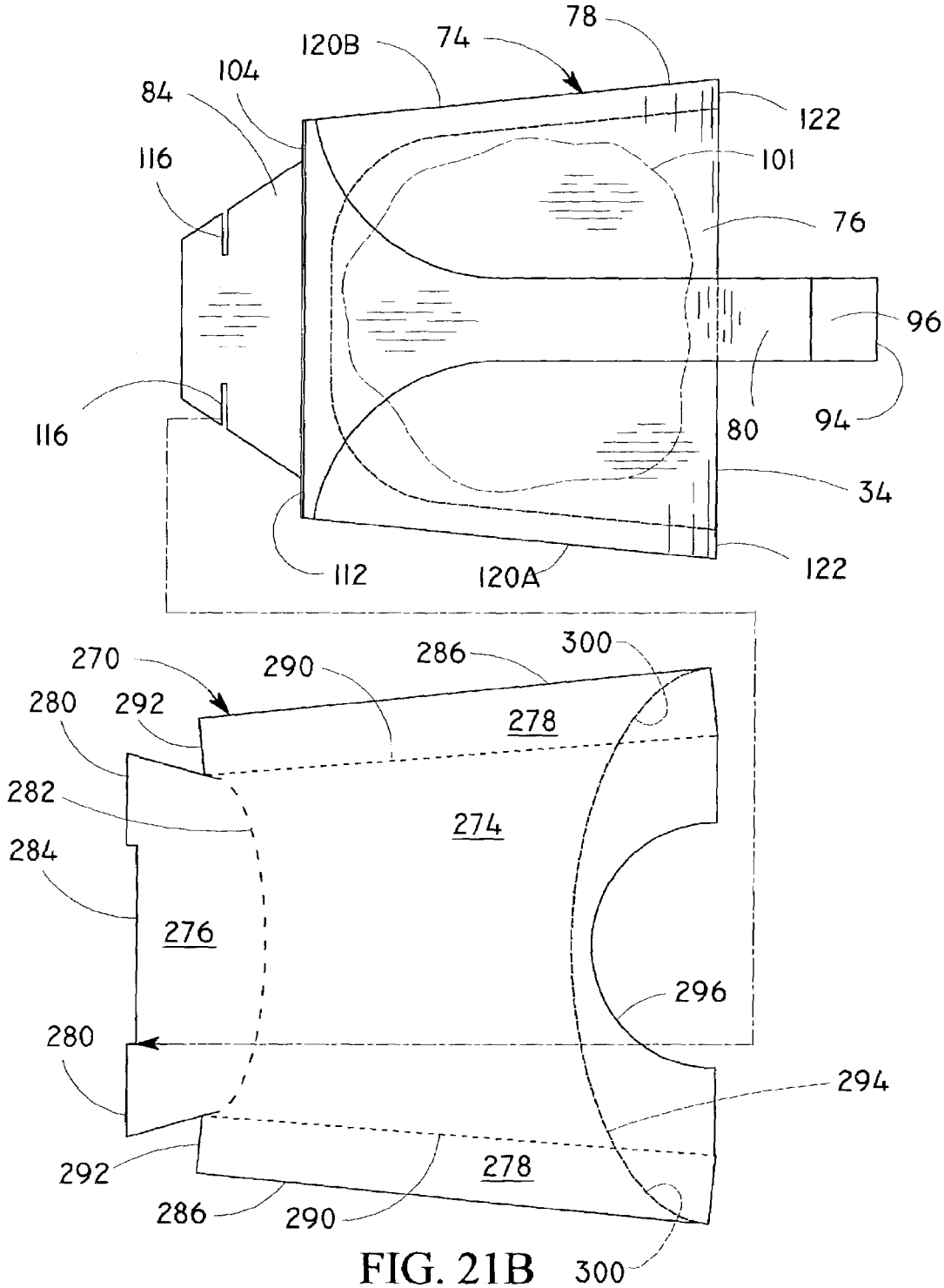
FIG. 21B is an exploded bottom-planar-view illustration of the outer container with the inner container as shown in FIG. 21A.

An exploded bottom-planar-view illustration of the outer container with the inner container as shown in FIG. 21A above, is shown in FIG. 21B. Both the outer container 270 and the inner container have been reversed so that the opposite sides are shown.

Figure 22:
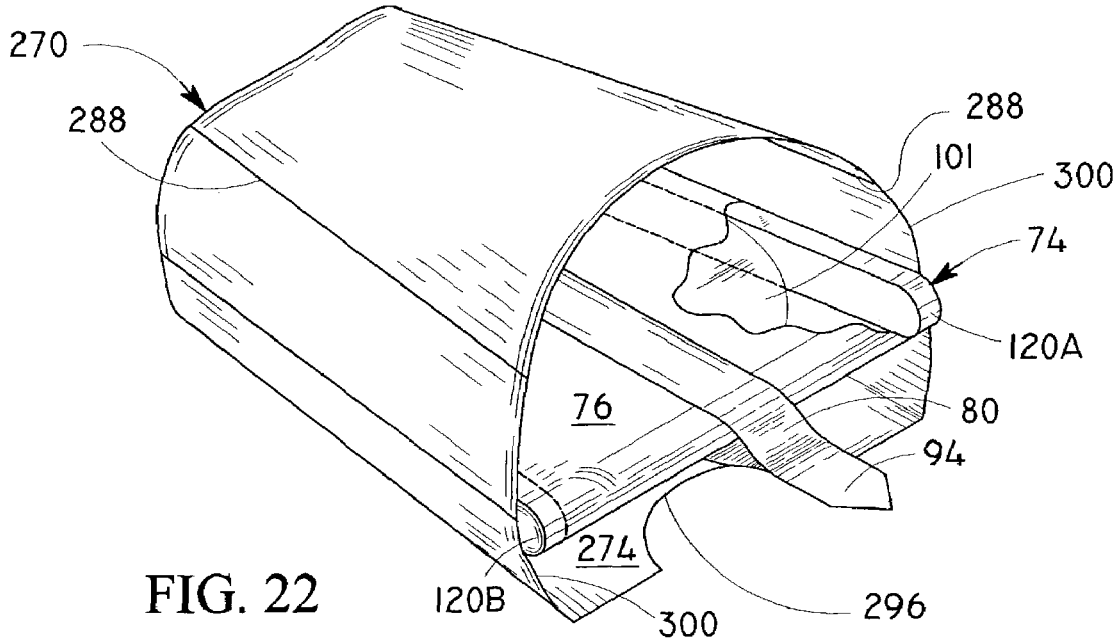
FIG. 22 is a perspective-view illustration of an opened outer container with the attached inner container of FIG. 21A.

A perspective-view illustration of an opened outer container with the attached inner container of FIG. 21A is seen in FIG. 22. The inner container contains a filler 101. In use, the inner container may be removed and opened, so that the filler is dispensed. Alternatively, sandwich halves can be inserted on either or both sides of the inner container so as to form a complete, ready-to-eat sandwich after removal of the outer cover.

Figure 23:
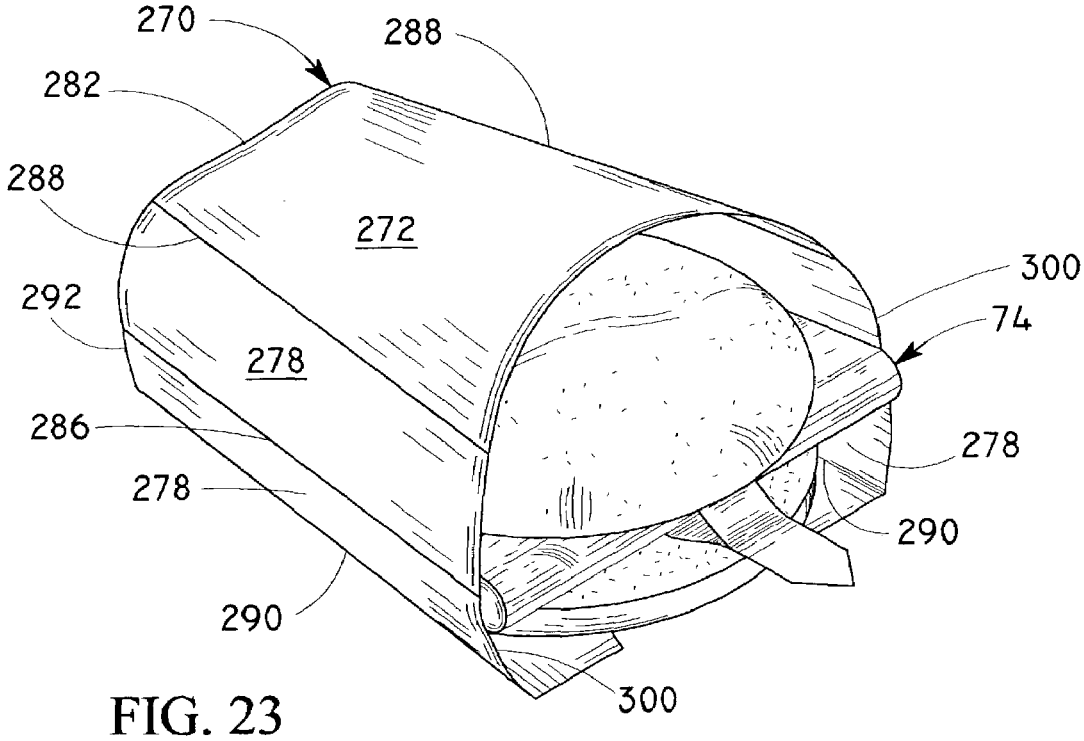
FIG. 23 is a perspective-view illustration of an opened outer container with the attached inner container of FIG. 22 and sandwich halves.

A perspective-view illustration of an opened outer container with the attached inner container of FIG. 22 and sandwich halves is seen in FIG. 23. In use, the user holds the outer container and pulls the tabs of the draw members in a direction opposite that of the bottom panel, which causes the outer cover to peel away and separate from the center member, thus forming a complete, ready-to-eat sandwich which is removed from the outer container before consumption.

Figure 24A:
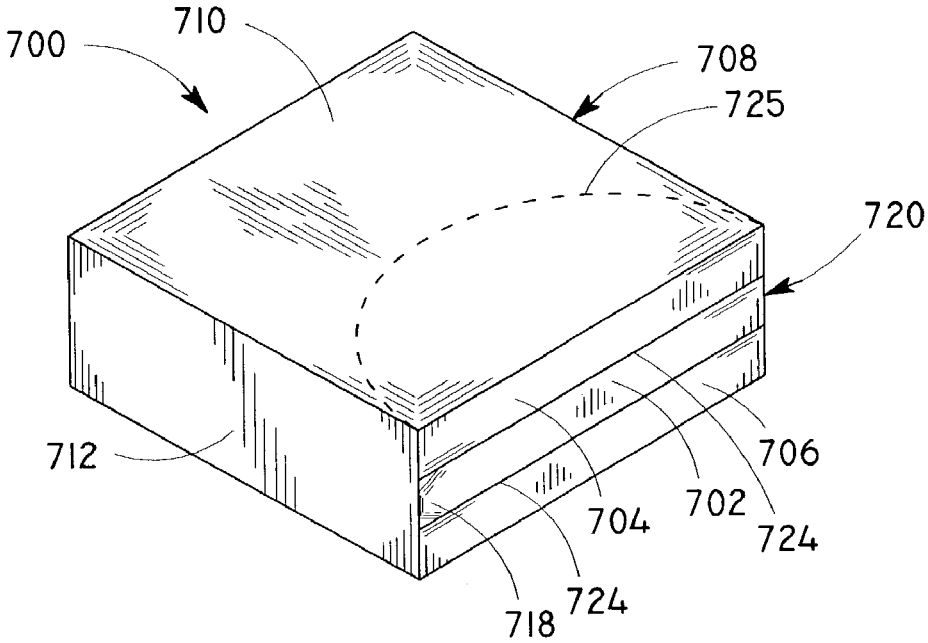
FIG. 24A is a perspective-view illustration of a second alternative embodiment of an outer container incorporating a box-type container.

A perspective-view illustration of a second alternative embodiment of an outer container incorporating a box-type container is shown FIG. 24A. The outer container 700 is a box-type outer container which comprises a body portion 708 and a front portion 720, and is constructed from a unitary blank of a semi-rigid material (e.g., cardboard, treated-paper, paperboard, polypropylene, or foamed or other types of solid polymers, plastics, laminates, etc.). The body portion comprises a top panel 710, a bottom panel, side panels 712, a rear panel, and a cavity. The front portion comprises a first flap 704, a second flap 706, a third flap (which is located directly behind the second flap), a removable flap 702, and optional side flaps. The inner container and sandwich halves are contained within the outer container. The removable flap is constructed from the same sheet of material as the outer container and is connected to the first and second flaps via weakened lines 724 (e.g. perforated, scored, adhesives, etc.). Alternatively, the removable flap is constructed from a separate sheet of material and is releasably bonded to the body portion to seal the cavity. The removable flap further comprises a removal tab 718 which is suitable for grasping.

Figure 24B:
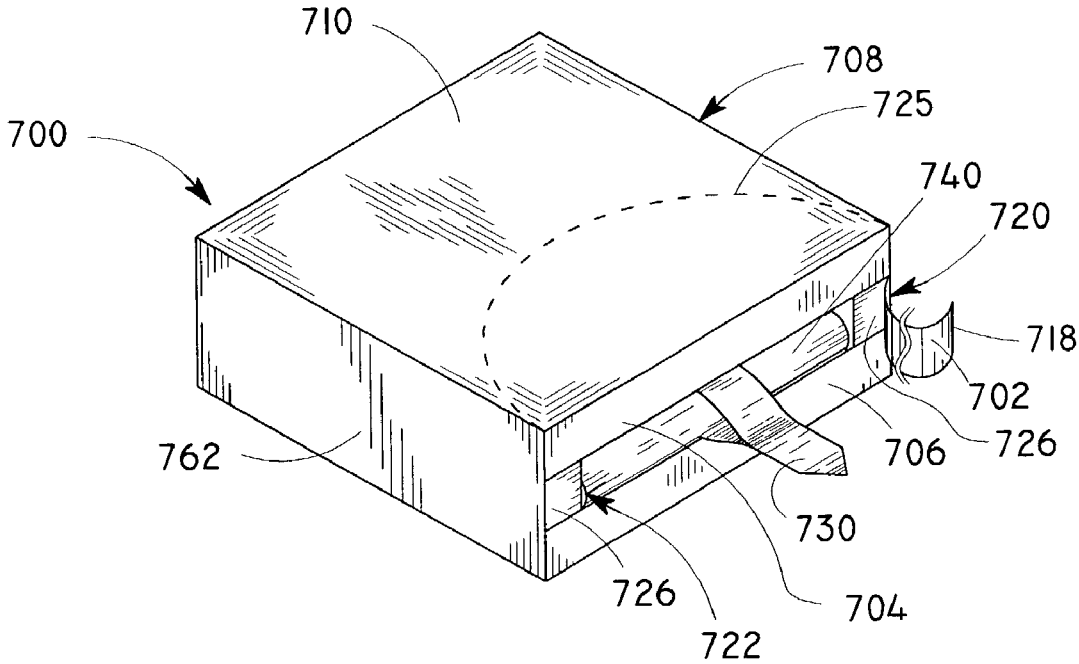
FIG. 24B is a perspective-view illustration of the outer container of FIG. 24A with the removable flap peeled back to expose a common tab and minor opening.

A perspective-view illustration of the outer container of FIG. 24A with the removable flap peeled back to expose a common tab and a minor opening is shown in FIG. 24B. The removable flap is removed to reveal a minor opening which is located on the front portion and is defined by the inner perimeter of the opening formed by the first flap, the second flap, and the side flaps 726. The minor opening should be large enough so that the outer cover 740 can pass through it without requiring undue force when the inner container 738 is opened, but should be small enough so that the sandwich halves are contained within the cavity of the outer container as the outer cover is removed. Peeling back and removing the removable flap further exposes the common tab 730, the inner container, and the side flaps. The side flaps and the first and second flaps remain in the closed position until after the outer cover is removed from the inner container. Portions of the first and second flaps which face the side flaps are optionally releasably attached to each other using an adhesive or other suitable bond. If desired, an optional weakened line 725 (shown as a semicircle for clarity but which can be shaped as desired) can be placed on either or both the top panel and the side panels. The top panel can thus be fully or partially separated at the weakened line and peeled back over itself which would provide better access to the sandwich contained within the body portion. In alternative embodiments, only the body portion is used without the front portion.

Figure 24C:
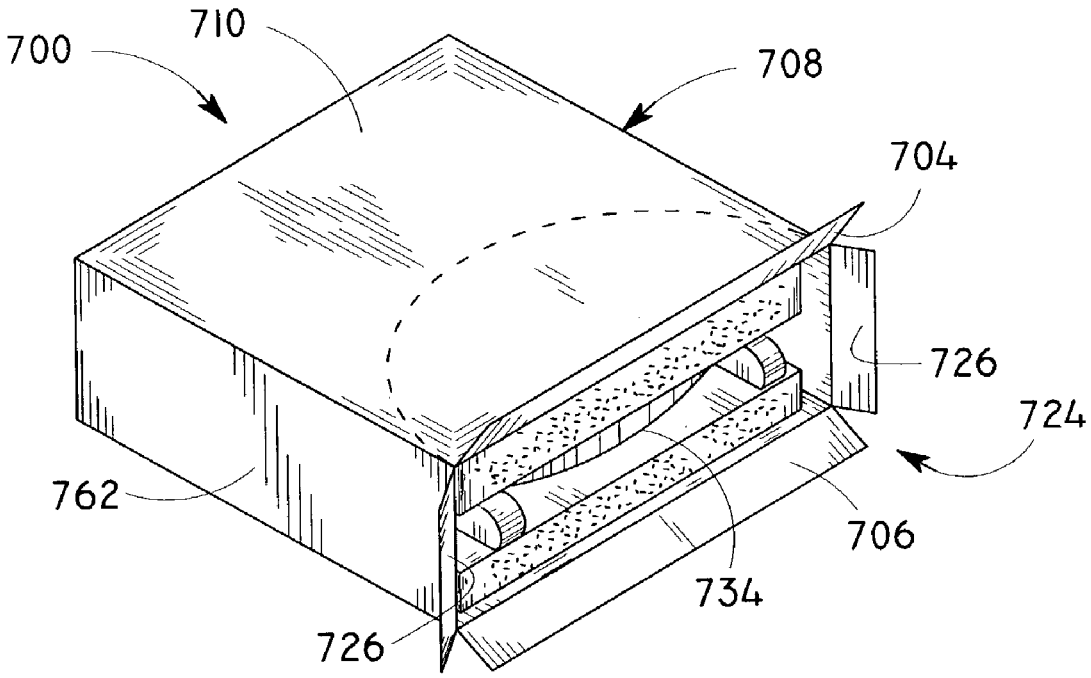
FIG. 24C is a perspective-view illustration of the outer container of FIG. 24B with the first and second flaps opened to expose the completed sandwich contained within.

A perspective-view illustration of the outer container of FIG. 24B with the first and second flaps opened to expose the completed sandwich contained within is shown in FIG. 24C. After the removable flap and outer cover have been removed, the first flap, the second flap, and the side flaps are opened and folded back to expose the completed sandwich contained within the cavity. The top portion (with the attached first flap) can be peeled back and partially or fully separated at the weakened line 725 to provide better access to the sandwich contained within the body portion. The user can then remove the completed sandwich from the inner and outer container by reaching into the cavity of the outer container and grasping the sandwich halves and pulling them away from both the inner container and the outer container. The center member is shown slightly separated from the side panels for clarity. In alternative embodiments, the center member is in contact with the side panels.

Figure 24D:
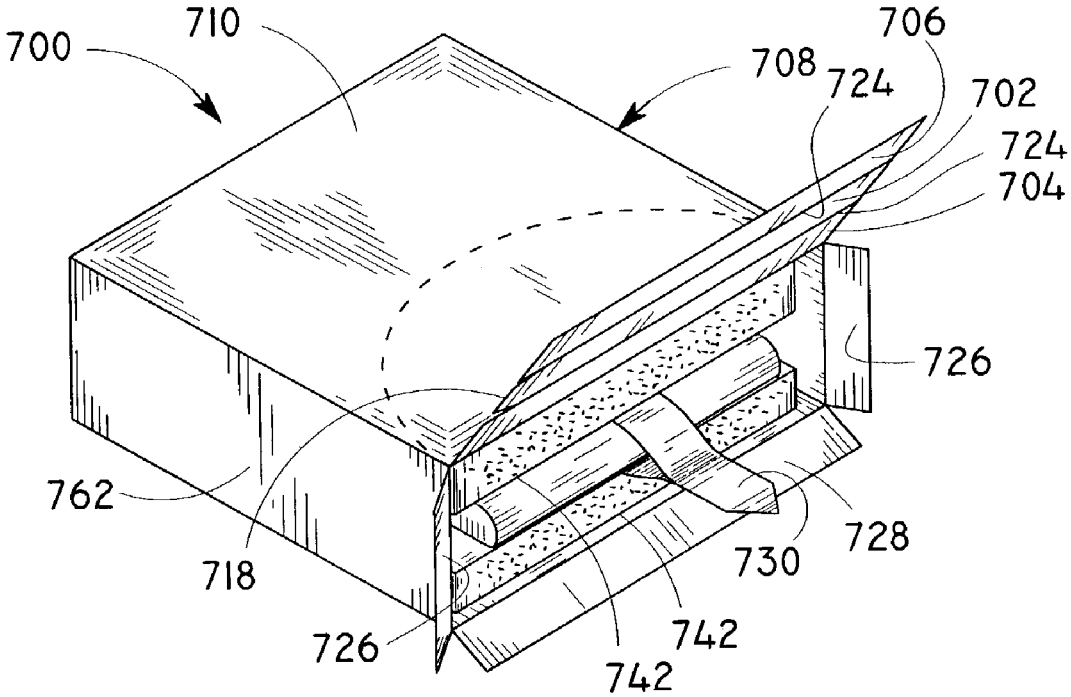
FIG. 24D is a perspective-view illustration of the outer container of FIG. 24A before the front panel is closed.

A perspective-view illustration of the outer container of FIG. 24A before the front panel is closed is shown in FIG. 24D. When sealing the package, the side flaps are closed first, after which the bottom flap is closed. The combination formed by the first flap, the removable flap, and the second flap is then closed. The second flap 706 is then attached to the adjacent third flap using an adhesive or other suitable bond so as to form a composite second flap. The combination formed by the attached second and third flaps is collectively referred to as the second flap.

The third flap is sized similarly to the second flap, but may be larger or smaller than the second flap if desired. The first and second flaps are sized such that they retain the sandwich halves in position when the outer cover is removed from the inner container. Additionally, the first and second flaps (as well as the optional side flaps) should not interfere with the movement of the outer cover as it is being removed from the inner container.

Figure 25A:
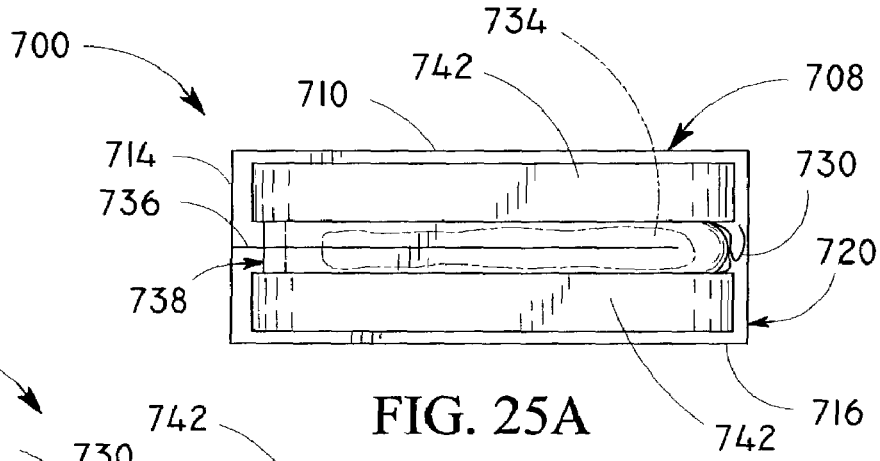
FIG. 25A is a side-view illustration of the outer container of FIG. 24A with the enclosed inner container and sandwich halves.

A side-view illustration of the outer container of FIG. 24A with the enclosed inner container and sandwich halves is shown in FIG. 25A. A side panel has been removed for clarity. The inner container is located between the sandwich halves 742 within the outer container cavity. The holding means comprises a holding member 736 which is attached to the body portion using an adhesive or other suitable method (e.g., locking tabs, etc.). The proportions of the inner container and the outer container should be such that the sandwich halves are held adjacent to the inner container and do not move excessively when the unopened outer container is handled. The optional common tab is contained within the outer container cavity and is resilient so that it extends beyond the perimeter of the outer container when the removable flap is removed. A filler 734 is contained within the inner container. In alternative embodiments, the side flaps can have cutouts which allow for the outer cover to be removed without undue friction. In yet other alternative embodiments, the front portion can be attached to the body portion using weakened lines which extend from the front portion to the side panels, in which case the side flaps are optional.

Figure 25B:
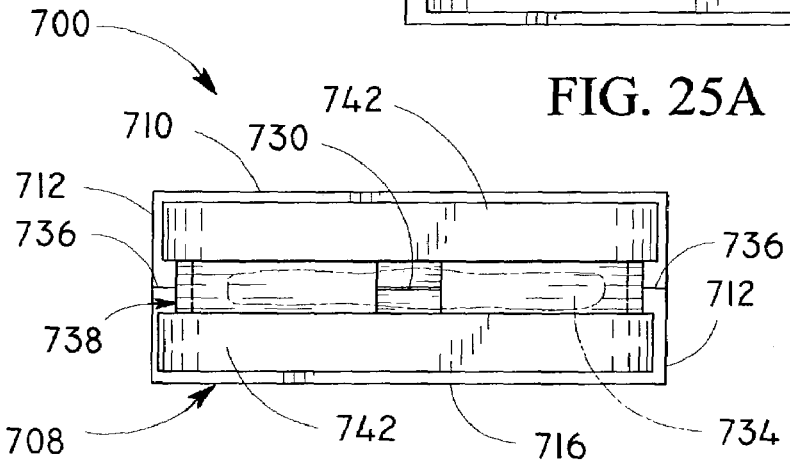
FIG. 25B is a front-view illustration of the outer container of FIG. 24A with the enclosed inner container and sandwich halves.

A front-view illustration of the outer container of FIG. 24A with the enclosed inner container and sandwich halves is shown in FIG. 25B. The front portion has been removed for clarity. The inner container is seen between the sandwich halves and is contained within the outer container's cavity. The common tab is centrally located.

Figure 25C:
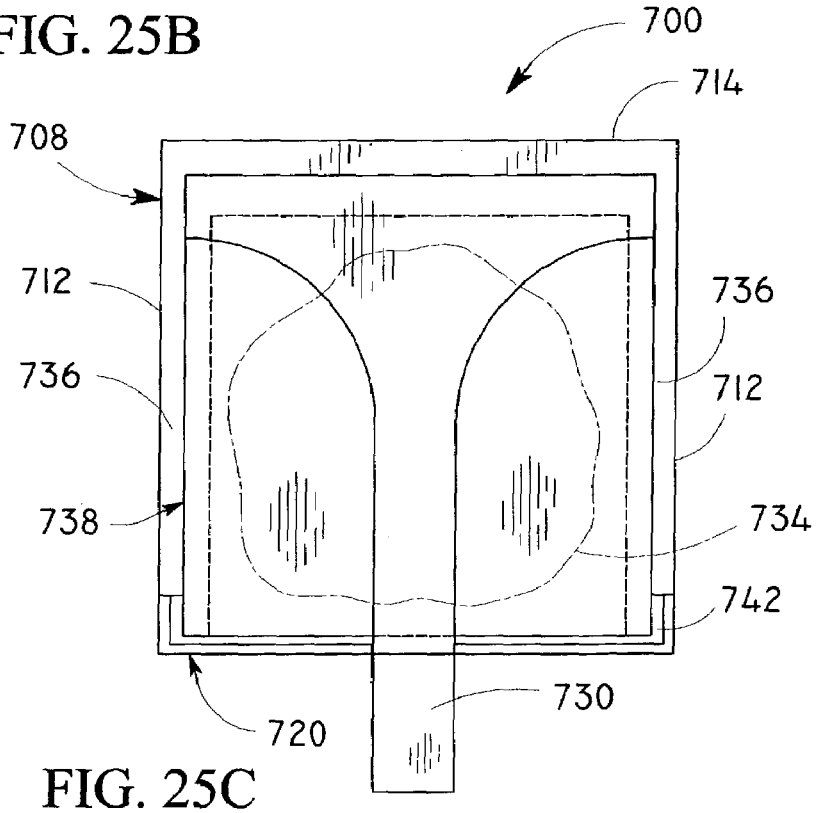
FIG. 25C is a top-view illustration of the outer container of FIG. 24A with the enclosed inner container.

A top-view illustration of the outer container of FIG. 24A with the enclosed inner container is shown in FIG. 25C. The top panel and the adjacent sandwich half have been removed for clarity. The holding member extends substantially around the inner container so that the inner container is positively attached to the outer container. Optional narrow-width draw members are shown for illustration only.

Figure 26A:
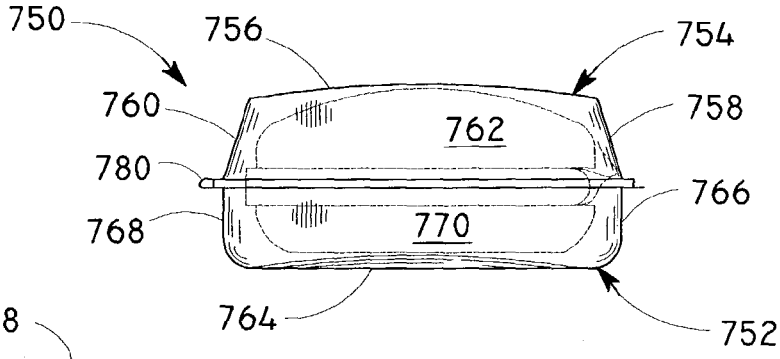
FIG. 26A is a side-view illustration of a third alternative embodiment of an outer container incorporating a clamshell-type container.

A side-view illustration of a third alternative embodiment of an outer container incorporating a clamshell-type container is shown FIG. 26A. The outer container, generally referenced 750, is generally square in shape, and is formed from a unitary blank of material (e.g., polypropylene, foamed or other types of polymers, paper, foils, laminates, or other suitable material). The outer container has a tray portion 752 and a cover portion 754. The tray portion is hingedly attached to the cover portion at hinge 780. A locking means is incorporated to seal the cover portion to the tray portion. Suitable locking means include, without limitation, tabs and/or interference fits as are common in the art. The cover portion comprises a top panel 756, a front panel 758, a rear panel 760, two side panels 762, a first rim, and a first cavity. The tray portion comprises a bottom panel 764, a front panel 766, a rear panel 768, two side panels 770, a second rim, and a second cavity. The combined sizes of the top cavity and the bottom cavity should be great enough to hold the inner container and sandwich halves but not so great that the sandwich halves and the inner container move around unnecessarily during handling. The first cavity is defined by the top panel, the front panel, the rear panel, and the side panel of the cover portion. The second cavity is defined by the bottom panel, the front panel, the rear panel, and the side panels of the bottom portion. The inner container is flexibly attached via the holding means to the outer container. Suitable holding members include flexible members and hinges as described elsewhere in this document. For example, a suitable holding member comprises a flexible member with a pair of notches which is attached to the hinge. The inner container is attached to the outer container either before or after the sandwich half is inserted into the second cavity. The inner container is described elsewhere in this document.

Clamshell-type containers are well-known in the art. See, for example, U.S. Pat. No. 5,131,551, to Wells, entitled "One-piece merchandising container," U.S. Pat. No. 4,653,685, to Leary, et al., entitled "Dual compartment sandwich package," and U.S. Pat. No. 4,132,344, to Jewell, entitled "Foam sandwich package," all of which are incorporated herein by reference in their entirety.

Figure 26B:
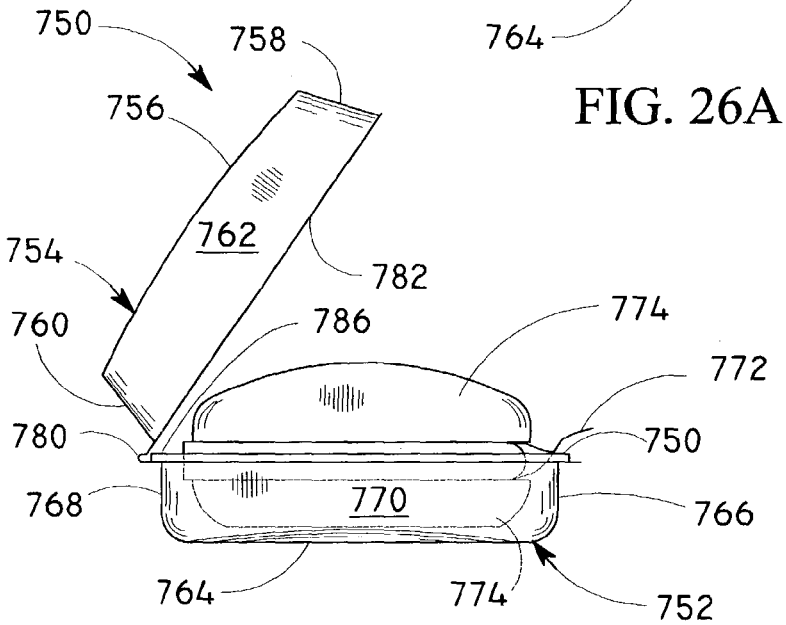
FIG. 26B is a side-view illustration of the outer container of FIG. 26A with the cover portion opened and including an attached inner container and sandwich halves.

A side-view illustration of the outer container of FIG. 26A with the cover portion opened and including an attached inner container and sandwich halves is shown in FIG. 26B. The first rim 782 and second rim 786 define the opening to their respective cavities, and are fitted with optional flanges which are suitable for friction fitting the cover portion and the tray portion together in the closed position. An optional common tab 772 protrudes beyond the perimeter of the outer container so that it can be easily grasped. The inner container is between the sandwich halves 774.

Figure 26C:
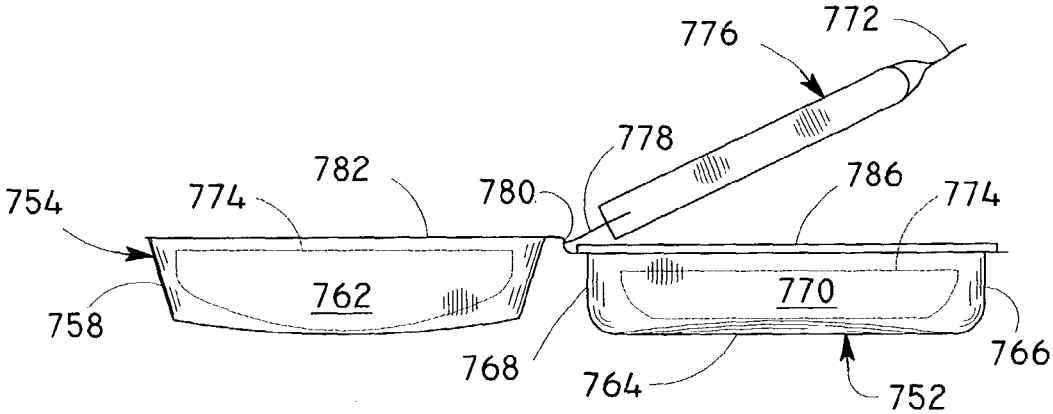
FIG. 26C is a side-view illustration of the outer container of FIG. 26A with the cover portion opened showing the attachment of the inner container.

A side-view illustration of the outer container of FIG. 26A with the cover portion opened showing the attachment of the inner container is shown in FIG. 26C. The sandwich halves are inserted within the first and the second cavities. The inner container 776 is flexibly attached to the outer container (using a flexible holding member 778) so that the completed sandwich can be removed from the combination formed by the inner container and the outer container after the outer cover is removed. The inner container can optionally fit within the second cavity so that the completed sandwich can be stored above the inner container and so that the outer container with the attached inner container may be stacked prior to inserting the sandwich halves.

Figure 26D:
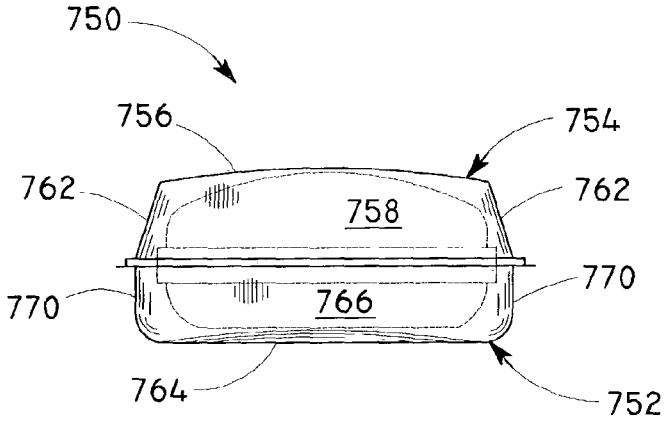
FIG. 26D is a front-view illustration of the outer container of FIG. 26A.

A front-view illustration of the outer container of FIG. 26A is shown in FIG. 26D. The optional common tab is centrally located. In use, the cover portion is partially opened to expose the common tab. The outer cover is then removed by pulling on the common tab with one hand while the other hand holds the outer container in place. During removal of the outer cover, the cover portion and the tray portion keep the sandwich halves in position relative to each other and to the filler. After removal of the outer cover, the cover portion is fully opened and the completed sandwich is removed from the center member and the outer container. The center member then optionally falls to the bottom of the second container so that the completed sandwich can be partially placed within the second cavity during consumption by the user.

Figure 26E:
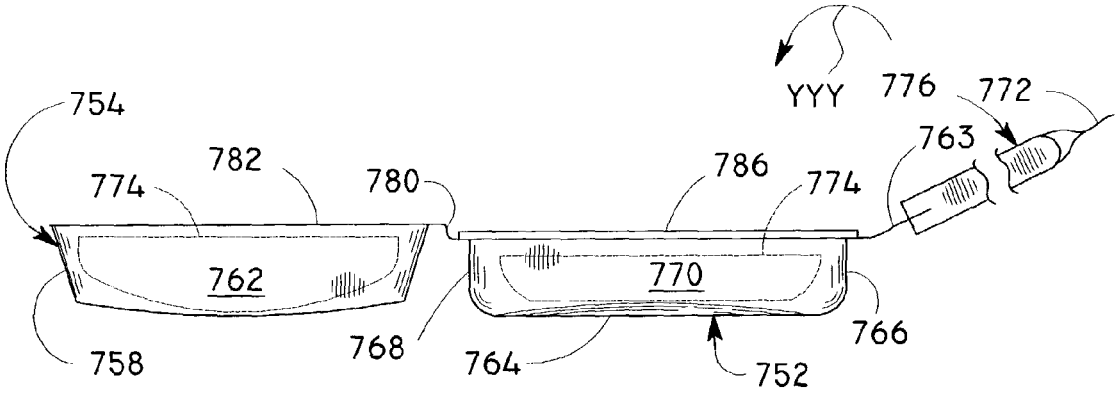
FIG. 26E a side-view illustration of an alternative embodiment of the outer container of FIG. 26A with the cover portion opened and showing the hingedly attached inner container.

A side-view illustration of an alternative embodiment of the outer container of FIG. 26A with the cover portion opened and showing the hingedly-attached inner container is shown in FIG. 26E. This embodiment is similar to the inner container as shown in FIGS. 26A through 26D and described above, but uses an inner container which is rotated so that it is flexibly attached to the outer container at a location which is adjacent to the front panel 766 using a flexible holding member 763 so that the completed sandwich can be removed from the combination formed by the inner container and the outer container after the outer cover is removed. The inner container can optionally fit within the second cavity so that the completed sandwich can be stored above the inner container and so that the outer container with the attached inner container may be stacked prior to inserting the sandwich halves. The inner container is rotated in the direction of arrow YYY and placed between the sandwich halves. The optional common tab is located proximate to the hinge 780. The center member of the inner container can be optionally formed integrally with the outer container from the same sheet of material. This embodiment is suitable for vacuum-formed containers which are made from a semi-rigid material (e.g., polyethylene, polymers, or other suitable materials).

Figure 27A:
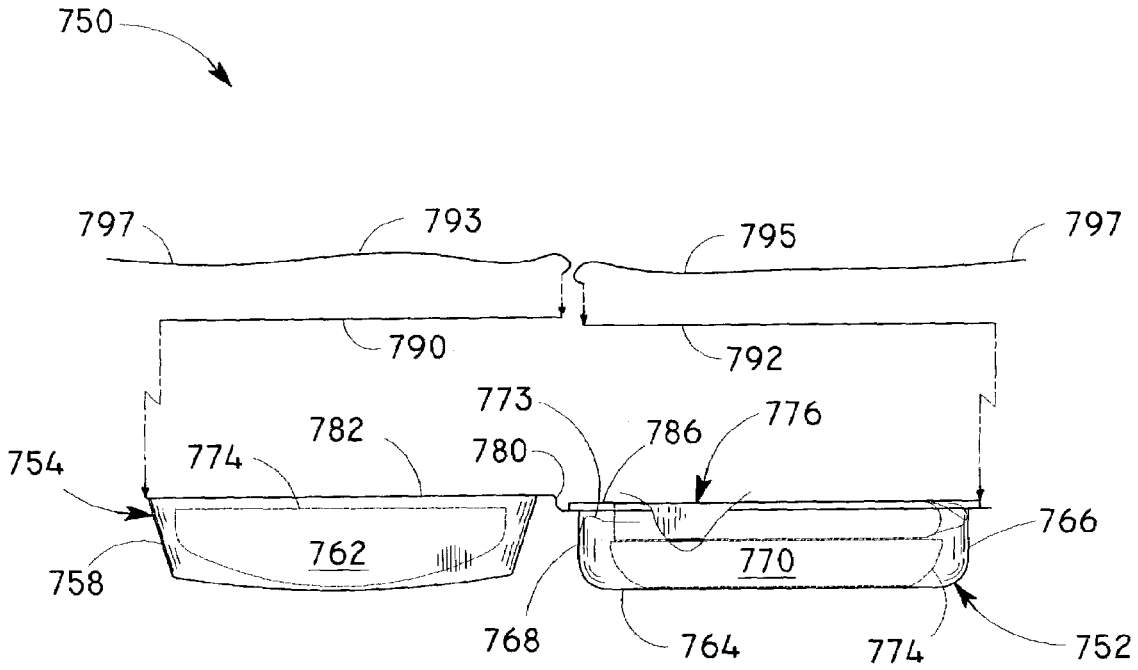
FIG. 27A is an exploded side-view illustration of an alternative embodiment of the outer container of FIG. 26A with the cover portion opened and including optional cavity seals.

An exploded side-view illustration of an alternative embodiment of the outer container of FIG. 26A with the cover portion opened and including optional cavity seals is shown in FIG. 27A. This embodiment is suitable for warming the contents of the inner container (e.g., the filler) using heat lamps as is common in fast-food establishments. The first and second cavity seals 790 and 792 cover the first and second cavities, respectively. The cavity seals comprise one or more tightly-fitting flexible sheets of material (e.g., cellophane, mylar, polyester, etc.) which are releasably attached to the rims (751 and 753) of the cover portion and the tray portion respectively, so that the moistness (and cleanliness) of the sandwich halves contained within the first and second cavities is maintained during heating (and storage, if desired). Optional pull transmitting members 793 and 795 are attached to the cavity seals and transmit a force from the user to the attached cavity seal, which force separates and removes the cavity seals from the rim to which they are attached. The pull transmitting members include a first end and a second end. The first end of each pull transmitting member includes a tab 797 which is suitable for grasping, while the second end of each pull transmitting member is attached to the outer periphery of the adjacent cavity seal. The pull transmitting members optionally extend diagonally across the cavity seal so that only a small portion of the cavity seal is separated from the body or cover portion when the cavity seals are opened initially, thus reducing the force necessary to separate and remove the cavity seals from the outer container. In alternative embodiments, only a single pull transmitting member is used. In other alternative embodiments, the pull transmitting members are attached to each other. In yet further alternative embodiments, the pull transmitting member(s) are formed integrally with the cavity seals from the same sheet of material.

In alternative embodiments, a heat pad like that disclosed in U.S. Pat. No. 4,522,190, to Kuhn, et al., entitled "Flexible electrochemical heater," can be placed proximate to, or incorporated into, the inner container and can be activated before use of the current invention, thus providing a portable heated meal.

The inner container 776 (seen behind the partial cutaway view of the side panel 770) should fit flush (below the rim) of the second cavity in which it is placed, so that the second cavity seal fits flush over the opening of the cavity. The cavity seals are peeled off the tray portion and the cover portion before consumption. Alternatively, a single cavity seal may be used to seal both the first cavity and the second cavity. Suitable methods of releasably attaching the cavity seal to the container include thermal bonding, pressure bonding, adhesive bonding, or other suitable methods of bonding. Alternatively, the cavity seal comprises a semi-flexible sheet of material (e.g., polypropylene, paper, foam, or other types of polymers, etc.) which is slidably engaged with a flange around the entire outer container or with the flange around each rim. See, for example, U.S. Pat. No. 5,213,256, to Cyr, entitled "Container Assembly Having a Removable Insert/Divider," incorporated herein by reference in its entirety. In yet other alternative embodiments, the cavity seal comprises a semi-flexible sheet of material (e.g., polypropylene) which is molded and friction fit to a flange (or other suitable member) of the cover portion and tray portion. If using a molded cavity seal, then the inner container does not have to fit flush within the cavity in which it is placed.

The cavity seal and outer cover are made from a clear or translucent material so that the customer can view the sandwich halves and filler before purchase, if desired. Alternatively, the opacity of the cavity seal and/or the outer cover can vary (e.g., the cavity seal can be reflective or opaque). For example, the first cavity seal can be made from a reflective material to reflect heat while the second cavity seal and the outer cover of the inner container can be made of a clear material to transmit heat and allow the user to view the filler contained within the inner container. In order to provide for a hermetic seal of the second cavity, the holding member 773 is optionally attached to the rear panel so that it is contained entirely within the interior of the second cavity.

In use, the cover portion is partially closed, the cavity seals are removed to expose the common tab (or other tab means), and the outer cover is removed from the inner container as described elsewhere in this document. In alternative embodiments, the cavity seals can be removed either when the clamshell is closed or opened.

In alternative embodiments, the common tab extends through a slot provided in the front panel. The slot should be shaped and sized such that the outer cover can be pulled through the slot when opening the inner container. The common tab is optionally releasably attached to the front panel so as to seal the slot in the second cavity. In use, the cover portion is folded upon the tray portion before the cover portions and the outer cover are removed from the inner container.

Figure 27B:
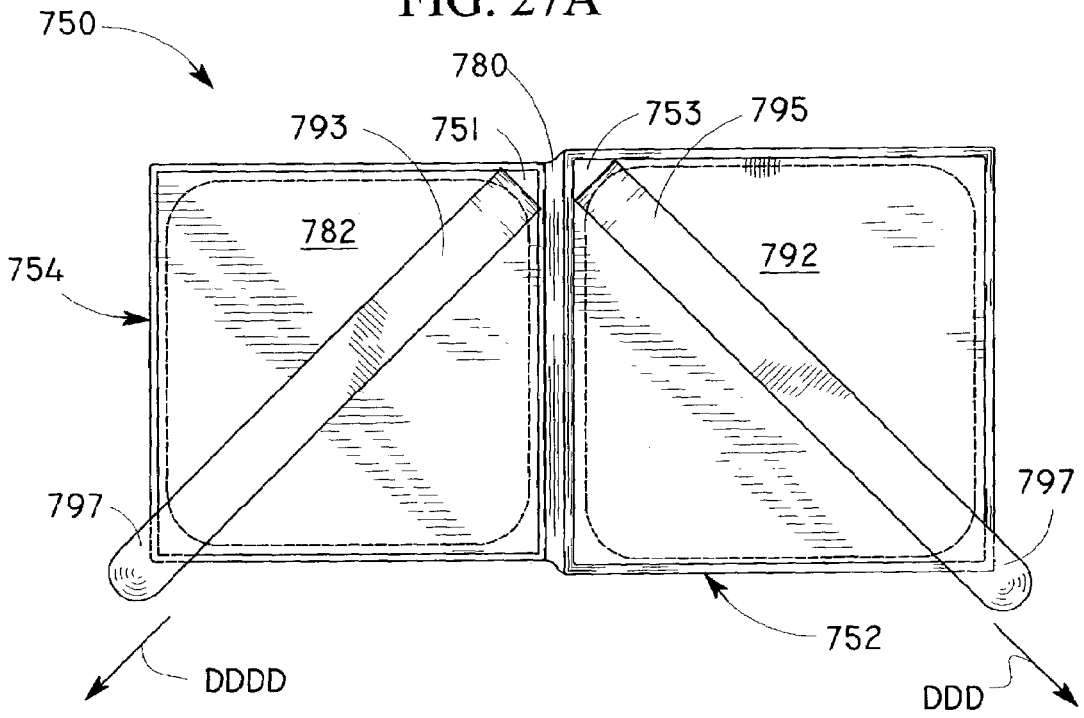
FIG. 27B is a top-view illustration of the outer container of FIG. 27A seen with pull transmitting members which are arranged diagonally across the cavities.

A top-view illustration of the outer container of FIG. 27A seen with pull transmitting members which are arranged diagonally across the cavities is shown in FIG. 27B. The force transmitting members are pulled in the direction indicated by arrows DDD and DDDD, which are shown relative to the upper portion and the lower portion so that when the outer container is closed the arrows DDD and DDDD are superimposed upon each other.

Figure 27C:
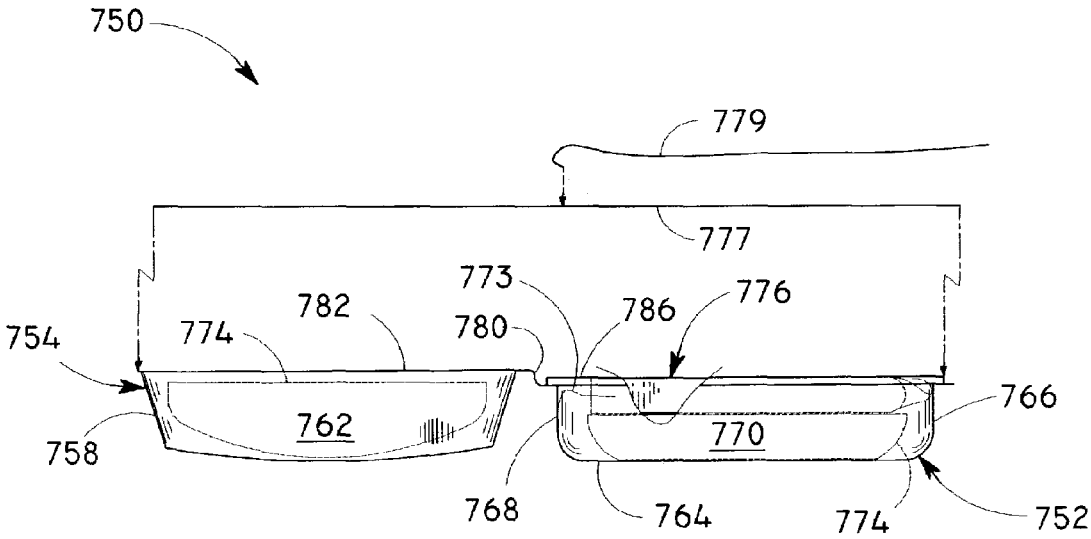
FIG. 27C is a side-view illustration of the outer container of FIG. 27A seen with a single pull transmitting member and a single-piece cavity seal.

A side-view illustration of the outer container of FIG. 27A seen with a single pull transmitting member and a single-piece cavity seal is shown in FIG. 27C. The pull transmitting member 779 is substantially as wide as the cavity seal 777 and is attached to the cavity seal at a location which is between the first and second cavities and adjacent to the hinge. In use, the pull transmitting member is pulled in a direction which is perpendicular to the hinge (rather than diagonally across as in the embodiments shown in FIGS. 27A and 27B).

Figure 28A:
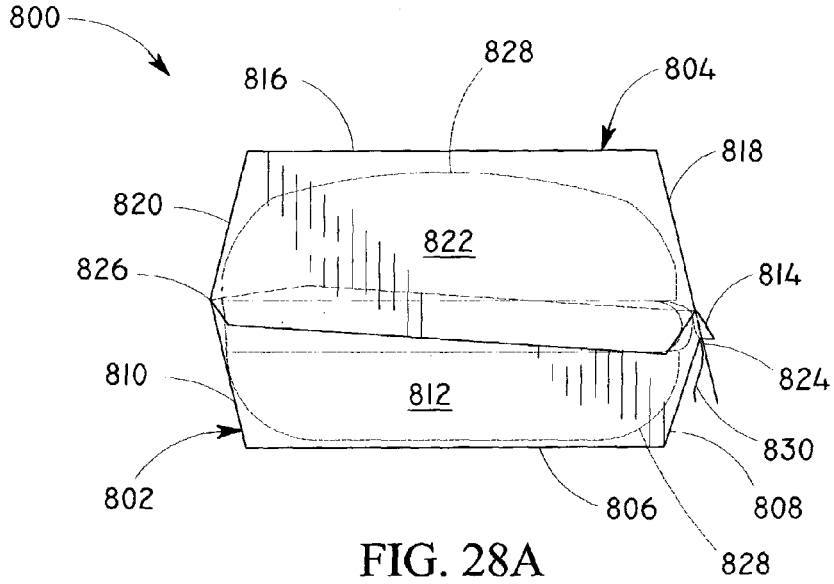
FIG. 28A is a side-view illustration of a fourth alternative embodiment of an outer container incorporating a clamshell-type box in the closed position.

A side-view illustration of a fourth alternative embodiment of an outer container incorporating a clamshell-type box in the closed position is shown FIG. 28A. The clamshell-type outer container (hereafter outer container) 800 comprises a tray portion 802, a lid portion (or cover portion) 804, and one or more inner containers. The tray portion comprises a bottom wall 806, a front wall 808, a rear wall 810, two side walls 812, and a pair of latching detents 814. The cover portion comprises a top wall 816, a front wall 818, a rear wall 820, two side walls 822, and a pair of engaging tabs 824. The tray portion and the cover portion are hingedly located relative to each other via a hinge 826. The inner container(s) is (are) attached to the outer container via a holding means (e.g., a flexible holding member) which is attached to the outer container using an adhesive (or a friction/interference or other suitable method). The inner container is placed within the outer container such that the sandwich halves 828 can be placed on either side of the inner container when the outer container is closed (as shown) and such that the outer cover can be easily removed from the inner container. A common tab 830 optionally extends beyond the perimeter of the front wall of the tray portion but is located under the front wall of the cover portion so that it is not mistakenly pulled. A front wall fold line 834 extends across the front panel of the cover portion.

The clamshell-type container and its structure are well known in the art. See, for example, U.S. Pat. No. 5,205,476, to Sorenson, entitled "Clamshell carton having an improved latching mechanism," and U.S. Pat. No. 4,877,178, to Eisman, entitled "Paperboard foldable carton," both of which are incorporated herein by reference in their entirety.

Figure 28B:
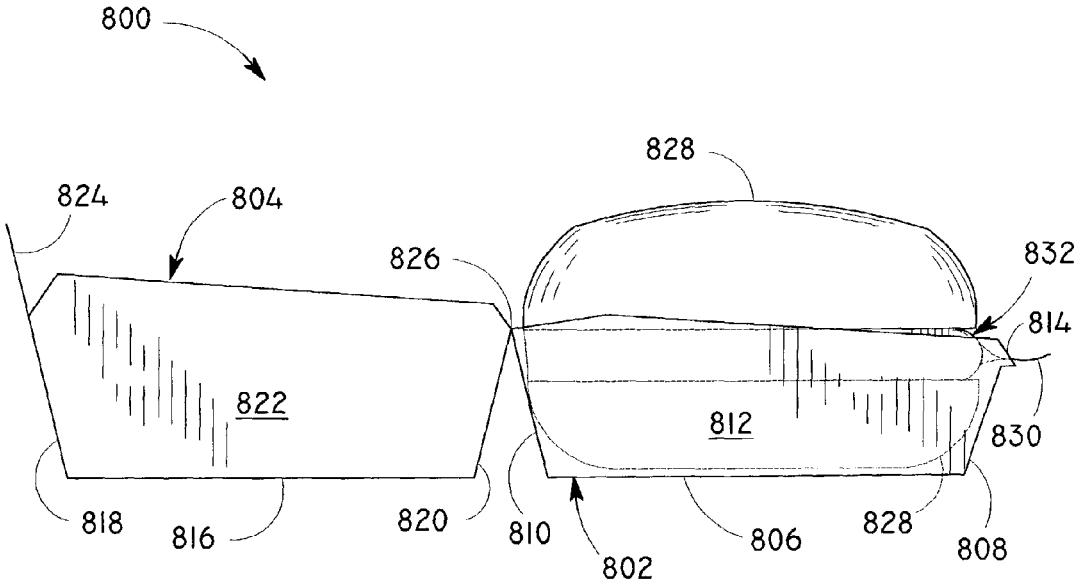
FIG. 28B is a side-view illustration of the outer container of FIG. 28A with the cover portion opened.

A side-view illustration of the outer container of FIG. 28A with the cover portion opened is shown in FIG. 28B. The sandwich halves are located adjacent to, and on each side of, the inner container 832. The inner container is flexibly attached to the outer container so that the completed sandwich can be removed from the combination formed by the inner container and the outer container after the outer cover is removed. The inner container can optionally fit within the cavity formed within the tray portion so that the completed sandwich can be stored above the inner container and so that the outer container with the attached inner container may be stacked prior to inserting the sandwich halves.

Figure 28C:
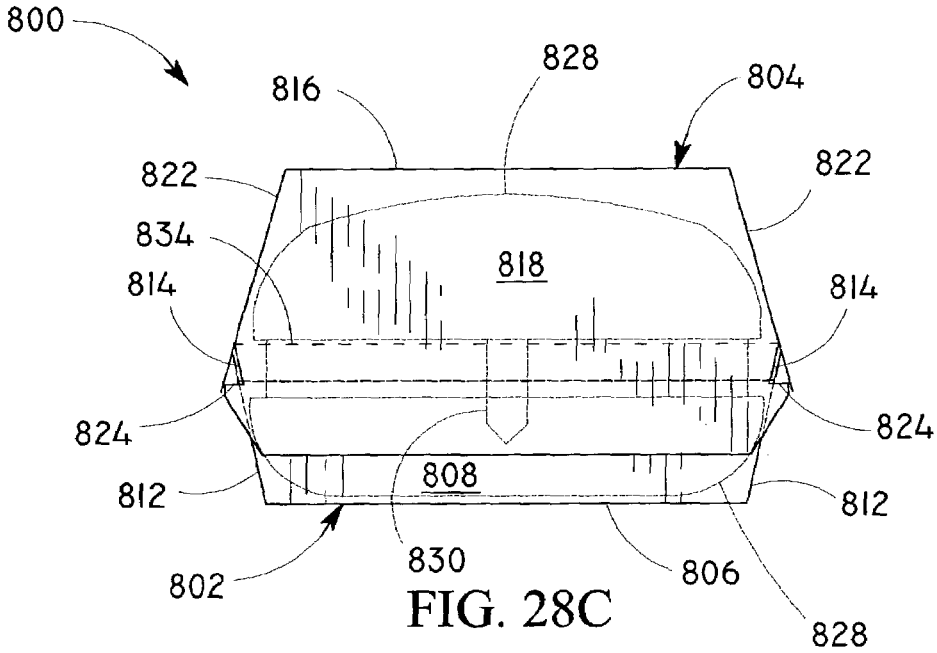
FIG. 28C is a front-view illustration of the outer container of FIG. 28A with the cover portion in the closed position.

A front-view illustration of the outer container of FIG. 28A with the cover portion in the closed position is shown in FIG. 28C. The optional common tab is centrally located under the front wall.

Figure 28D:
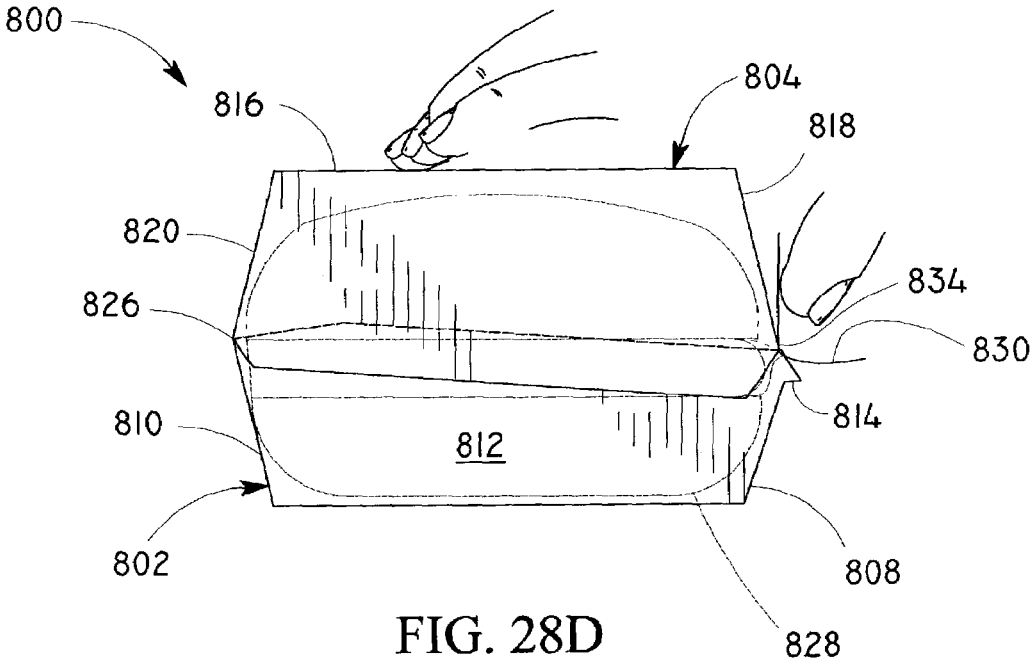
FIG. 28D is a side-view illustration of the outer container of FIG. 28A with the front wall of the tray portion pulled back to expose the common tab.

A side-view illustration of the outer container of FIG. 28A with the front wall of the tray portion pulled back to expose the common tab is shown in FIG. 28D. In use, the user pulls up on the bottom edge of the front wall of the tray portion so that the front wall of the cover portion folds over itself at the front wall fold line and exposes the optional common tab. This also creates an opening which is shaped and sized such that it is large enough to allow the outer cover of the inner container to pass through it as the outer cover is removed from the inner container, but small enough so that the front walls retain the sandwich halves in position when the outer cover is removed from the inner container. After the outer cover is removed, the user opens the cover portion to expose the completed sandwich. The user then tilts the sandwich and removes it from the inner container, thus forming a complete sandwich.

Figure 29A:
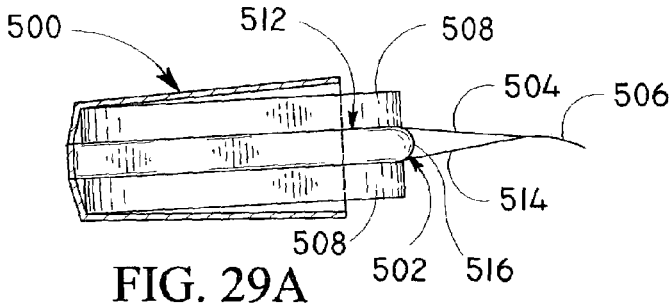
FIG. 29A is a partial-cutaway side-view illustration of the inner container and outer container of the present invention, with sandwich halves inserted.

A partial cutaway side-view illustration of the inner container and outer container of the present invention, with sandwich halves inserted, is shown in FIG. 29A. This embodiment is similar to the embodiment shown in FIGS. 21 through 23 supra. The outer container 500 is partially cut away to illustrate the inner container 502 and the sandwich halves 508. The outer container is constructed from a semi-rigid material (e.g., foam, cardboard, plastic, laminates, etc.). The first and second draw members 504 and 514 respectively, extend beyond the perimeter of the inner container. The outer cover mid fold 516 is shown for illustration. In the embodiment shown, the draw members are attached to each other adjacent to their first ends so that the first and second tabs form a common tab 506.

Figure 29B:
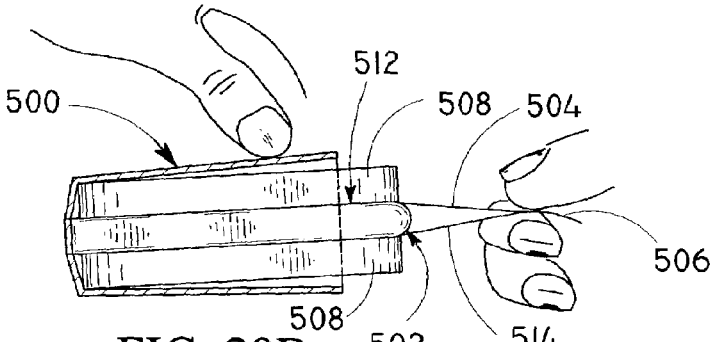
FIG. 29B is a partial-cutaway side-view illustration of an inner container and outer container of FIG. 29A, as the inner container is opened and the outer cover removed.

A partial cutaway side-view illustration of an inner container and outer container of FIG. 29A, as the inner container is opened and the outer cover removed, is shown in FIG. 29B. The outer container is held by the user. The user then pulls the common tab away from the inner container, which causes the outer cover to peel away from the center member. The outer cover separates from the center member beginning at the base member and continues separating until the outer cover fully detaches from the center member. During the separation of the outer cover from the center member, the outer cover folds over itself. In optional embodiments where the first ends of the pull members are not attached to each other, the user may remove one side of the outer cover and then remove the other side.

Figure 29C:
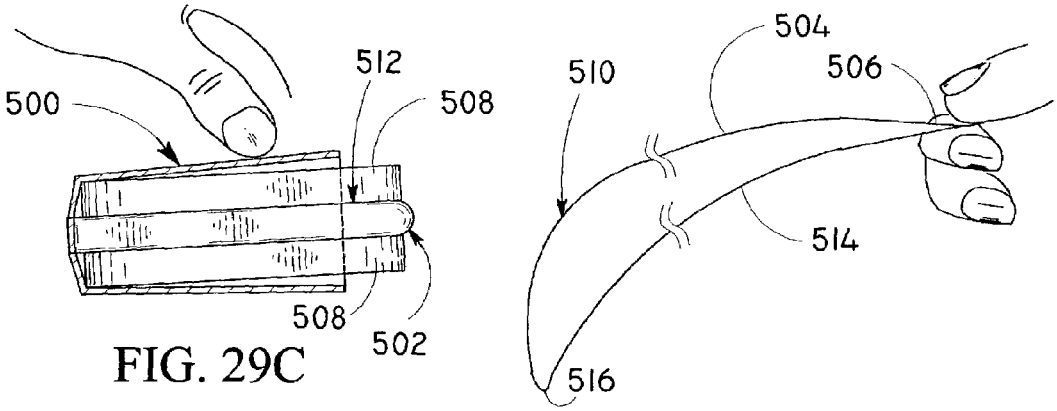
FIG. 29C is a partial-cutaway side-view illustration of the inner container and attached outer container of FIG. 29B, with the outer cover removed.

A partial cutaway side-view illustration of the inner container and attached outer container of FIG. 29B, with the outer cover removed, is shown in FIG. 29C. After the outer cover 510 and the attached draw members are removed from the center member, they are discarded. Because the outer cover folds over itself and scrapes the sandwich halves as it is removed from the center member, it tends to clean itself upon the sandwich halves, thus preventing the filler 518 from sticking to the outer cover. This minimizes wasted filler, minimizes the possibility of the filler soiling the user, and also makes it easier for the user to dispose of the outer cover. Additionally, because the outer cover peels away from the filler, the outer cover tends not to pull the filler apart.

Figure 29D:
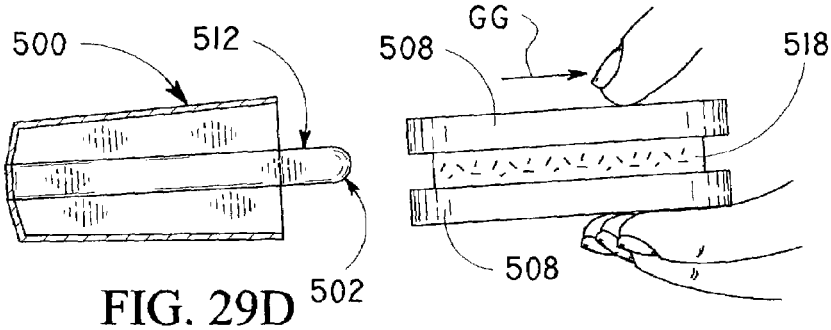
FIG. 29D is a partial-cutaway side-view illustration of the inner container and attached outer container of FIG. 29C, as the sandwich halves and filler are pulled from the opened inner container.

A partial cutaway side-view illustration of the inner container and attached outer container of FIG. 29C, as the sandwich halves and filler are pulled from the opened inner container, is shown in FIG. 29D. The sandwich halves and filler (i.e., the completed sandwich) are pulled (in the direction as indicated by arrow GG,) from the outer container and the opened inner container contained therein.

Figure 30A:
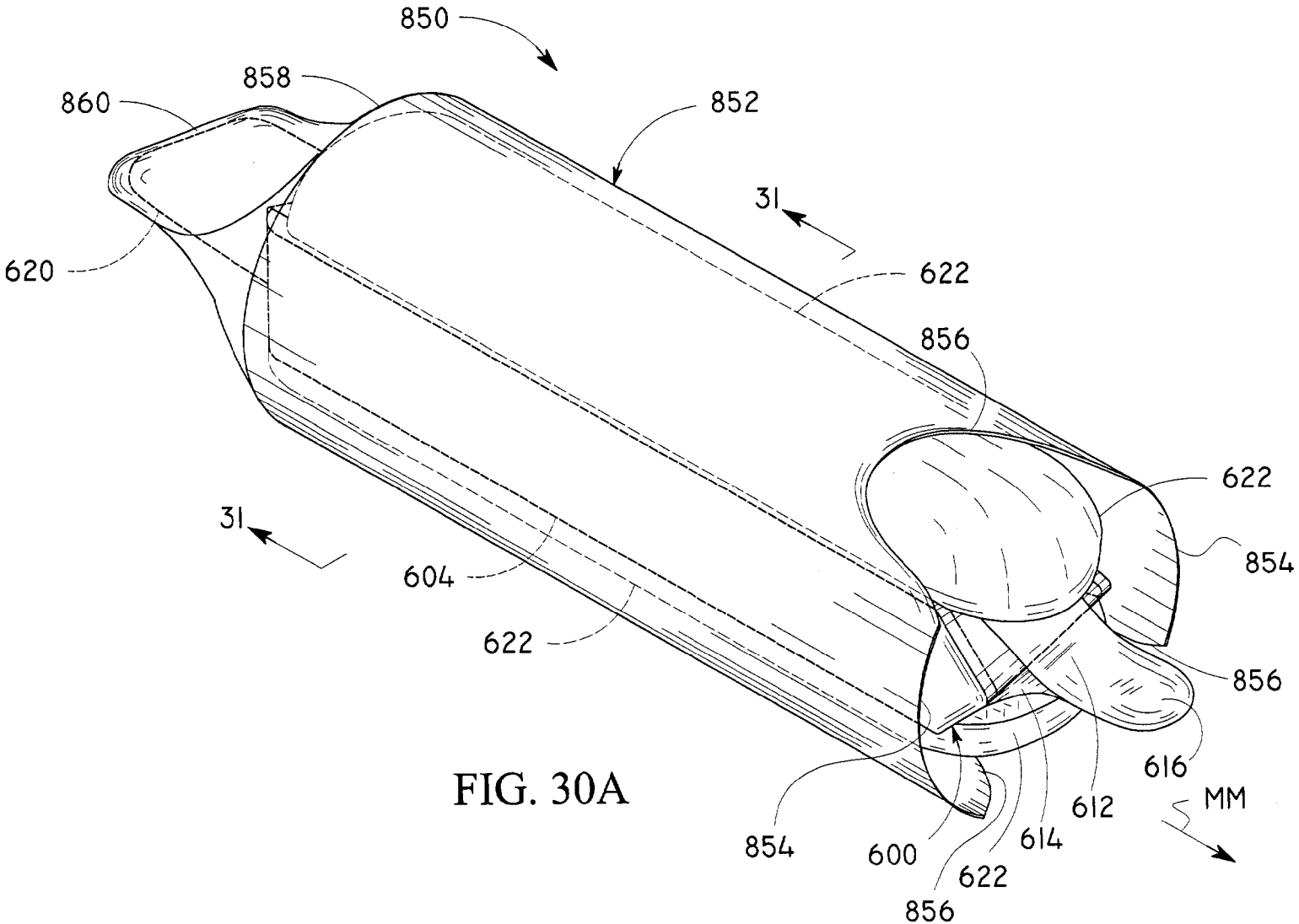
FIG. 30A is a perspective-view illustration of a fifth alternative embodiment of an outer container incorporating a tubular body.

A perspective-view illustration of a fifth alternative embodiment of an outer container incorporating a tubular body is shown in FIG. 30A. The outer container, generally referenced 850, is tubular in shape with at least one opening, and is constructed from a flexible material (e.g., aluminum foil, paper, cardboard, other solid polymers, etc.). The outer container comprises a body portion 852, a first side free edge 854, a second free edge 858, an optional exterior holding portion 860, and a major opening. The exterior holding portion is suitable for grasping, and is attached to the inner container's holding member 620 using an adhesive or other suitable method as discussed elsewhere in this document. In alternative embodiments, the holding member 620 is optional as the outer container is attached directly to the side members and/or the base member of the inner container using an adhesive or other suitable bonding method as discussed elsewhere in this document. The first side free edge has two optional indentations 856 which are sized such that the user can grasp the sandwich halves 622 while opening the inner container as well as remove the completed sandwich once the outer cover has been removed. The completed sandwich is removed from the outer container through the outer container's major opening. The outer cover and the completed sandwich are removed from the outer container by pulling the completed sandwich in the direction indicated by arrow MM. In alternative embodiments, the outer container is extended so that a beverage or other desired object can be contained within the outer container. In yet other alternative embodiments, a heating pad (such as discussed supra) or other portable heating device can be placed proximate to the inner container and provide a thermal source for heating the filler. For example, a heating pad can be placed on the exterior side of either or both side members.

In alternative embodiments, the outer container further includes a minor opening located adjacent to the major opening. The minor opening is shaped and sized such that the outer cover and the attached draw members can pass through it when the package is opened, but small enough so that the sandwich halves cannot pass though it. The minor opening is removed or opened so that the completed sandwich can pass through the major opening when the sandwich halves are removed from the outer container. In yet other alternative embodiments, the outer container is constructed from a rigid or semi-rigid material.

Figure 30B:
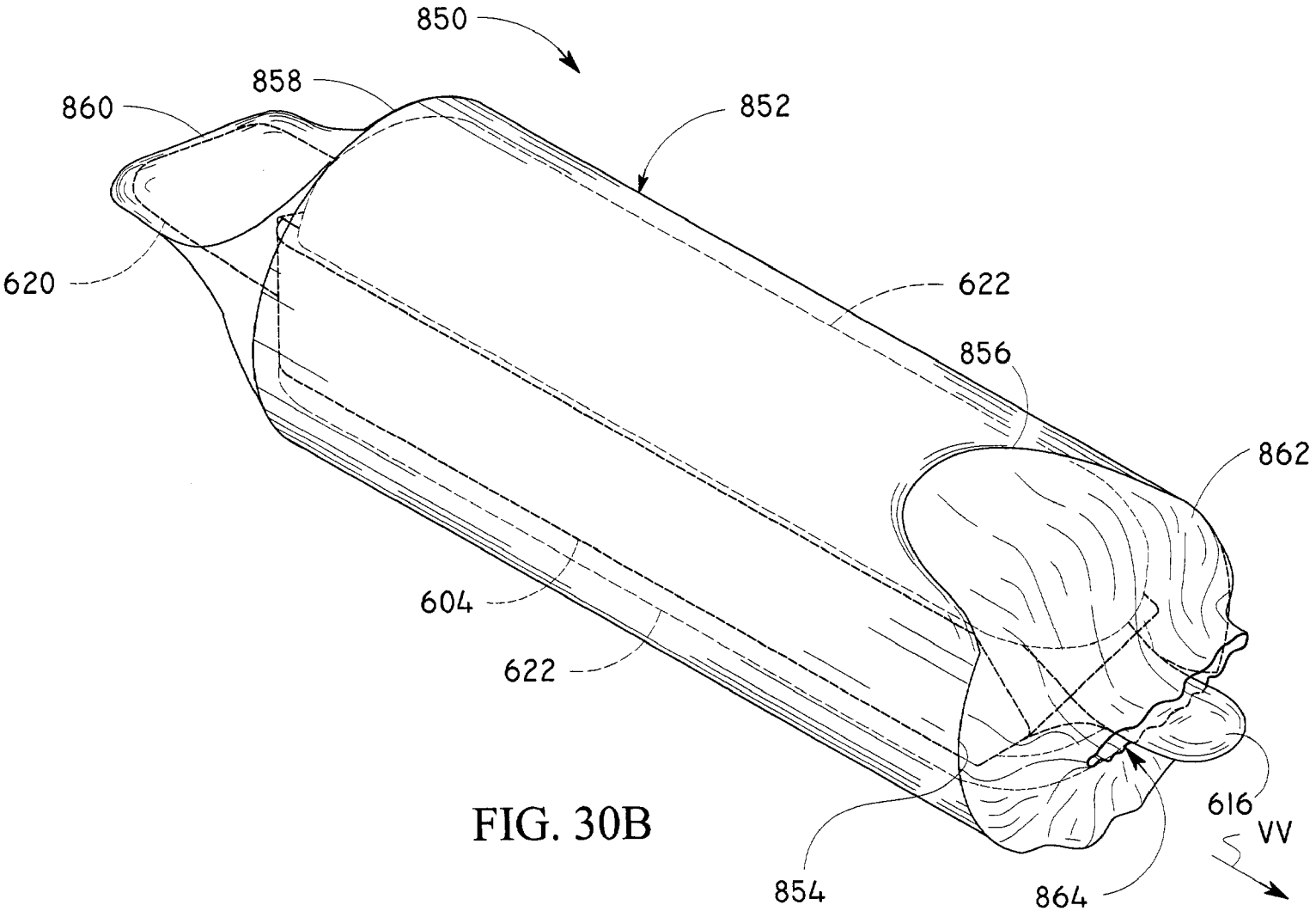
FIG. 30B is a perspective-view illustration of the fifth alternative embodiment of the outer container as seen in FIG. 30A, incorporating a tubular body and a cover portion.

A perspective-view illustration of the outer container with a removable cover portion as shown in FIG. 30A is seen in FIG. 30B. The removable cover portion 862 is attached to the body portion 852 and includes a minor opening 864 through which the tab means 616, the draw members, and the attached outer cover can pass when the inner container is opened, but which is small enough so that the sandwich halves cannot pass through it as the inner container is being opened. After opening the inner container (by pulling the common tab 616 in the direction of line VV), the cover portion is either torn open or fully removed from the body portion. The cover portion is preferably made integrally with the body portion from the same material as the body portion and is attached to the tubular body portion using a weakened line (e.g., a weakened line which coincides with the first side free edge, which defines the major opening) or other suitable attachment means. Alternatively, the removable cover portion can be slightly larger in diameter than the tubular body portion, and secured to the body portion by sliding it over the body portion and using an optional adhesive. In other alternative embodiments, the minor opening of the cover portion is sealed using an adhesive, a flap, etc.

Figure 31:
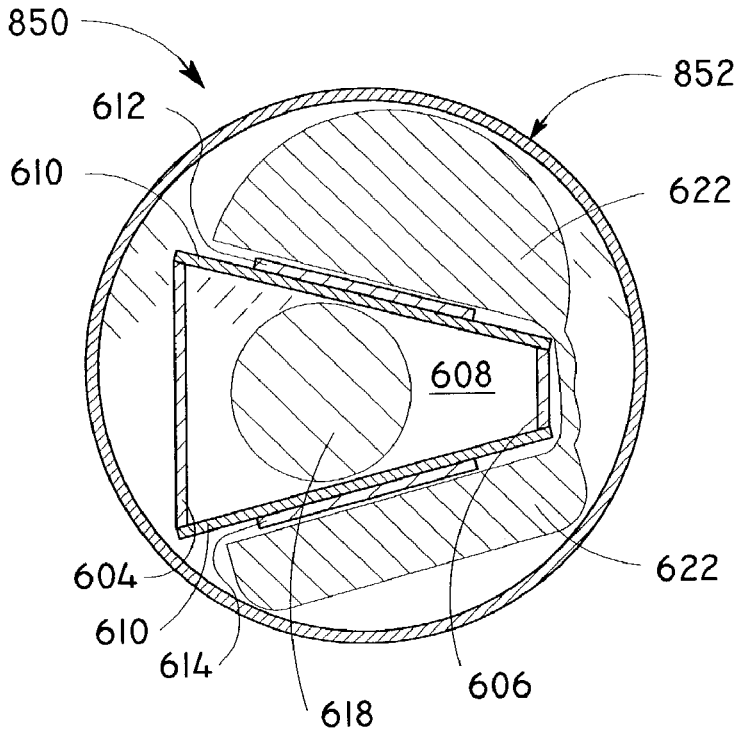
FIG. 31 is a cutaway side-view illustration taken along line 31—31 of the tubular outer container shown in FIG. 30A.

A cutaway side-view illustration of the tubular outer container shown in FIG. 30A is shown in FIG. 31. The outer container should be shaped and sized such that the sandwich halves are held within the inner container by friction but can be readily removed from the outer container when desired. Although the tubular outer container is shown as a substantially cylindrical shape, in alternative embodiments it can be oval, square, or formed in other shapes as desired.

Figure 32:
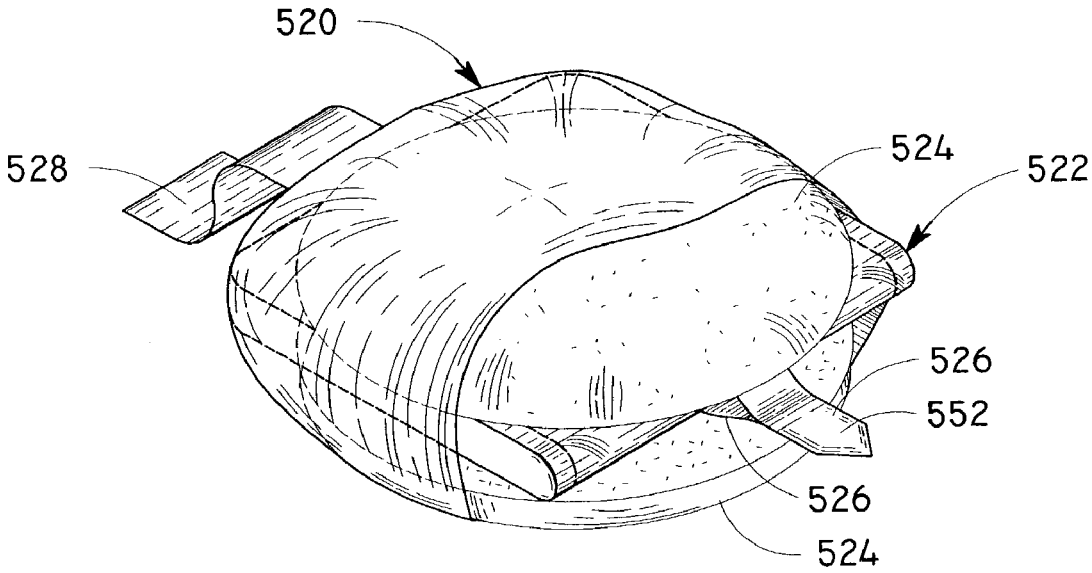
FIG. 32 is a perspective-view illustration of the inner container of FIG. 7 contained within a flexible outer container.

A perspective-view illustration of the inner container of FIG. 7 contained within a flexible outer container is shown in FIG. 32. The outer container 520 is constructed from a flexible material (e.g., Mylar, plastic, paper, foil, cellophane, laminates, etc.) and is attached to the inner container 522 via the holding member. The holding member 528 is slid through an optional slot (not shown) in the outer container before the outer container is folded and wrapped around both the inner container and the sandwich halves 524. An optional adhesive or other suitable sealing method (e.g., thermal bonding, pressure bonding, tape, adhesive, etc.) is used to hold the outer cover in position around the combination formed by the sandwich halves and the inner container. The draw members 526 are attached to each other adjacent to their first ends so that the first and second tabs form a common tab 552.

In alternative embodiments the outer container forms a hermetic seal around the sandwich halves and optionally the inner container, and has a removable cover section. In yet other alternative embodiments, the outer container includes a cover portion so as to fully conceal the sandwich halves contained within. The cover portion is attached to the outer container via a weakened line (e.g., scoring, perforating, adhesives, etc.). Before the inner container is opened, the outer cover portion of the outer container is removed. The outer cover should be shaped and sized such that the sandwich can be readily removed from within.

Figure 33:
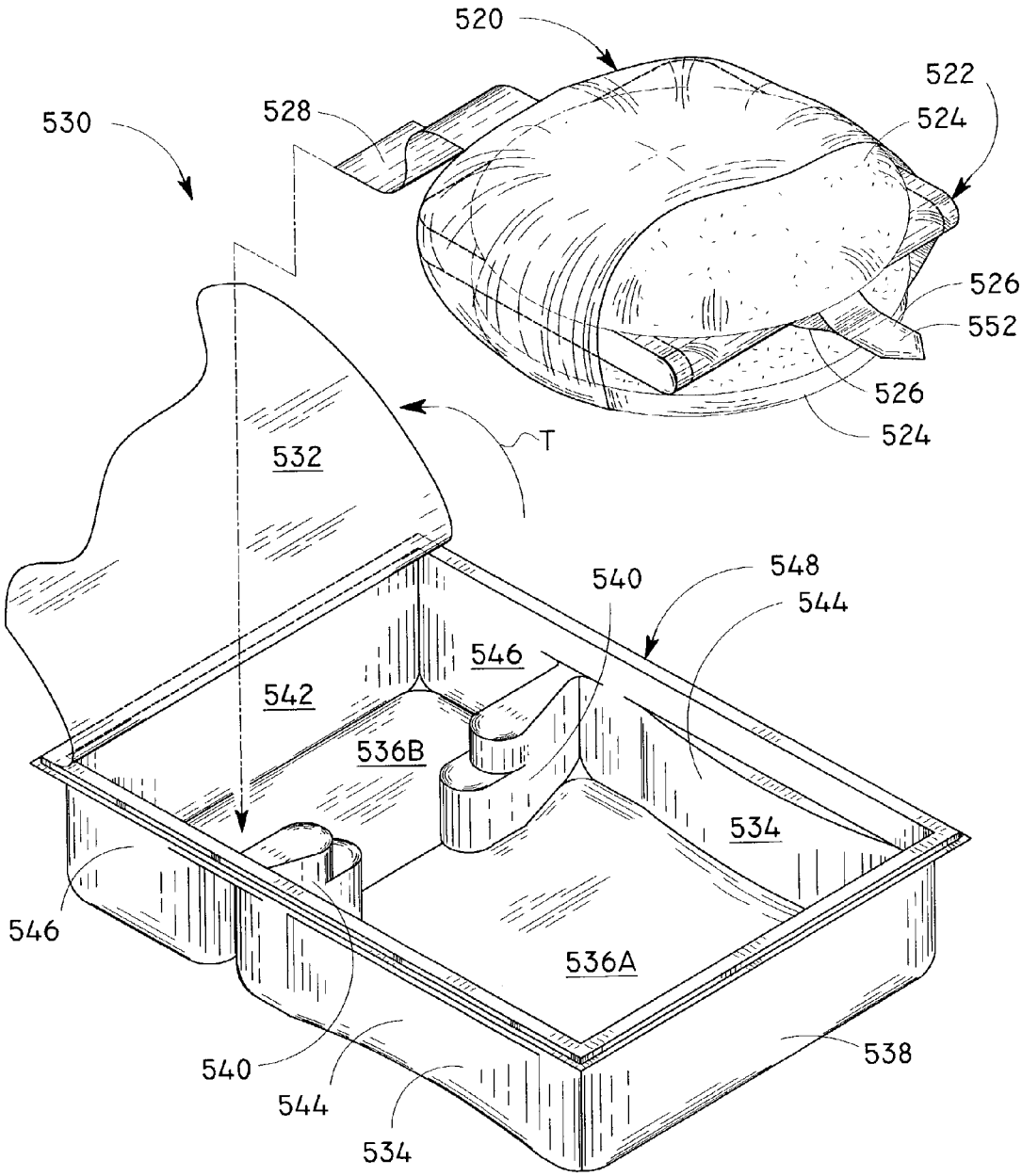
FIG. 33 is an exploded perspective-view illustration of the inner container and flexible outer container of FIG. 32 and an outer box means with the cover peeled back.

An exploded perspective-view illustration of the inner container and flexible outer container of FIG. 32 and an outer box means with the cover peeled back is shown in FIG. 33. The outer box means 530 comprises a box portion 548 and a box cover 532. The box portion 548 comprises a primary cavity suitable for holding the combination formed by the inner container, the optional outer container, and the optional sandwich halves. The primary cavity is defined, for the most part, by a first end wall 538, side walls 534, divider walls 540, and bottom wall 536A. The optional secondary cavity is defined, for the most part, by second end wall 542, the divider walls 540, secondary side walls 546, and the bottom wall 536B. The box portion 548 is constructed from a semi-rigid material (e.g., polypropylene, cardboard, paper, polystyrene, foamed polymers etc.) or other suitable material. The secondary cavity is used for containing other food items (e.g., drinks, desserts, etc). The primary cavity should be shaped and sized such that it is large enough so that a user can readily grasp the sandwich for consumption.

The side walls 534 have optional concavities 544 which protrude within the cavity so as to hold the sandwich firmly in place within the cavity during shipping. The concavities allow the user to readily grasp the sandwich by the sides for consumption. In alternative embodiments, any suitable protrusion is used so as to prevent the sandwich from moving substantially within the cavity during shipping. Likewise, the bottom wall has one or more optional concave regions which protrude within the cavity to hold the sandwich in place during shipping but allow the user to readily grasp the sandwich for consumption.

The inner container 520 is attached to the bottom wall 536 of the box means via the holding member 528 using an adhesive or other suitable bonding method (e.g., pressure bonding, thermal bonding, locking mechanisms, latches, notches, friction fit, etc.). The holding member should allow the inner container and the optionally attached outer container to move sufficiently so that the outer cover can be removed from the inner container and so that the sandwich can be removed for consumption. Alternatively, the inner container can be (hingedly) attached to the box means using hinges, tabs or other suitable friction-fit methods, or can be formed integrally with the box means. The draw members are placed within the cavity but, in alternative embodiments, the draw members may extend through a slot in one of the adjacent side walls of the cavity such that the draw members and the attached outer cover can be removed from the inner container before the box means is opened. Alternatively, a take-up-spool mechanism can be employed to accept the draw members and the outer cover.

The box cover (only a partial section is shown) is releasably attached to, or formed integrally with, the box portion 548 and hermetically seals the interior (e.g., the primary and the secondary cavities) of the container. To open the outer box means, the box cover is peeled away (e.g., as indicated by arrow T) from the box portion to expose the outer container (and inner container and sandwich halves) contained therein. The box cover is constructed from a flexible material (e.g., Mylar, plastic, cellophane, paper, foil, laminates, etc.) and is attached to the outer box means using pressure bonding or other suitable methods (e.g., thermal bonding, pressure bonding, adhesive bonding, etc.). In alternative embodiments, the box cover can be constructed from a semi-rigid or rigid material. In alternative embodiments, the draw members are releasably attached to a take-up spool so that the draw members and the attached outer cover can be taken up on the spool.

Figure 34A:
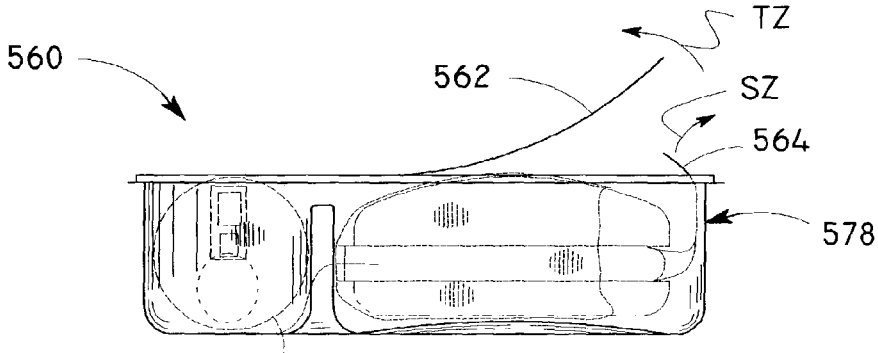
FIG. 34A is a side-view illustration of the outer box means and inner container and flexible outer container of FIG. 33, with the outer box means' cover partially opened.

A side-view illustration of the outer box means and inner container and flexible outer container of FIG. 33, with the outer box means' cover partially opened, is shown in FIG. 34A. The outer box means 560 comprises a box portion 578 which is constructed from a semi-rigid material as described elsewhere in this document and a box cover 562 which is constructed from a flexible material as described elsewhere in this document. The box portion comprises two compartments: a primary compartment and an optional secondary compartment. The primary compartment contains the combination formed by the inner container, the sandwich halves, and the outer container, while the secondary compartment contains one or more optional condiments 574 (e.g., drink, snack, etc.). The outer container is constructed from a flexible material (e.g., plastic, Mylar, cellophane, paper, aluminum, laminates, etc.) which partially encloses the combination formed by the inner container and the sandwich halves contained therein. In use, the box cover is peeled away from the box portion (as indicated by arrow TZ) to expose the cavities and the optional common tab 564, which extends (as indicated by arrow SZ), beyond the perimeter of the inner container and the box portion.

Figure 34B:
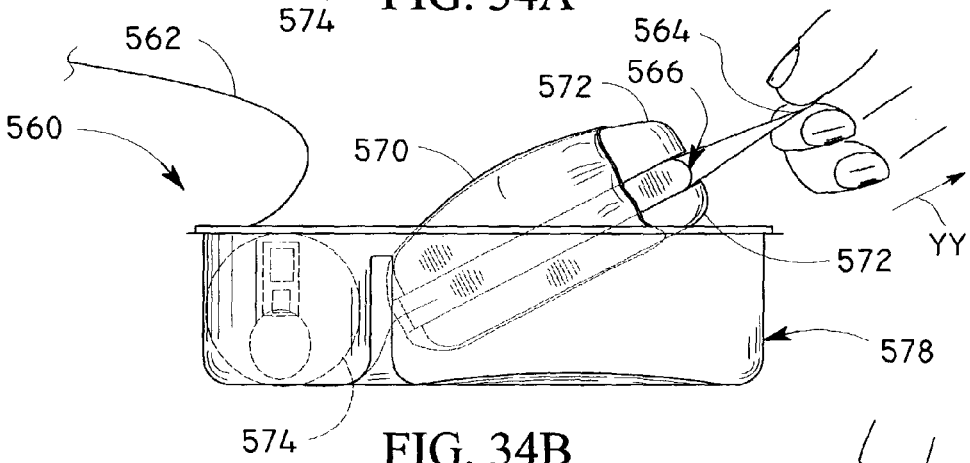
FIG. 34B is a side-view illustration of the box means of FIG. 34A with the cover opened, and the user pulling on the draw members of the inner container.

A side-view illustration of the box means of FIG. 34A with the cover opened, and the user pulling on the draw members of the inner container, is shown in FIG. 34B. The common tab is pulled away from the inner container 566 in the direction indicated by arrow YY, which causes the outer cover to peel away from the center member. The outer cover separates from the center member beginning at the base member and continues separating until the outer cover fully detaches from the center member. During the separation of the outer cover from the center member, the outer cover folds over itself. In alternative embodiments where the first ends of the pull members are not attached to each other, the user may remove one side of the outer cover (i.e., the upper sheet) and then remove the other side (i.e., the lower sheet), which would reduce the amount of force necessary to remove the outer cover from the center member.

The primary cavity is large enough so that the inner container, the outer container 570, and the sandwich halves 572 can be positioned properly to remove the outer cover. After the outer cover and the attached draw members are removed from the center member, they are discarded.

Figure 34C:
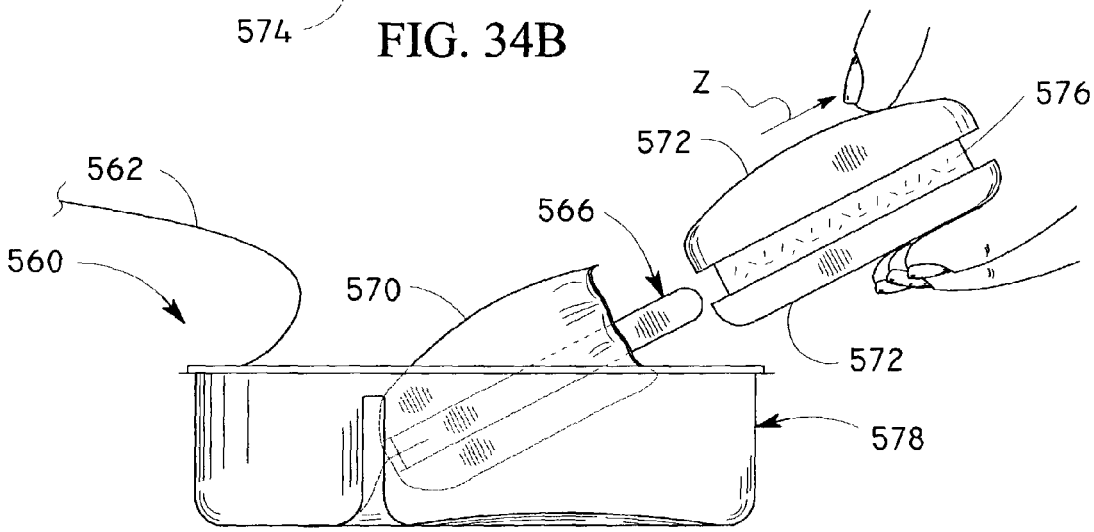
FIG. 34C is a side-view illustration of the box means of FIG. 34B with the cover opened and the outer cover removed and discarded, as the completed sandwich is being removed from the inner container.

A side-view illustration of the box means of FIG. 34B with the cover opened and the outer cover removed and discarded, as the completed sandwich is being removed from the inner container, is shown in FIG. 34C.

The sandwich halves and filler 576 (i.e., the completed sandwich) are pulled (in a direction indicated by arrow Z) from the outer container and the opened inner container 566 contained therein. The inner container 566 and the outer container 570 are then left alone or folded into the cavity so that the user may place the completed sandwich back into the primary cavity for temporary storage. The optional condiments have been removed.

Figure 35A:
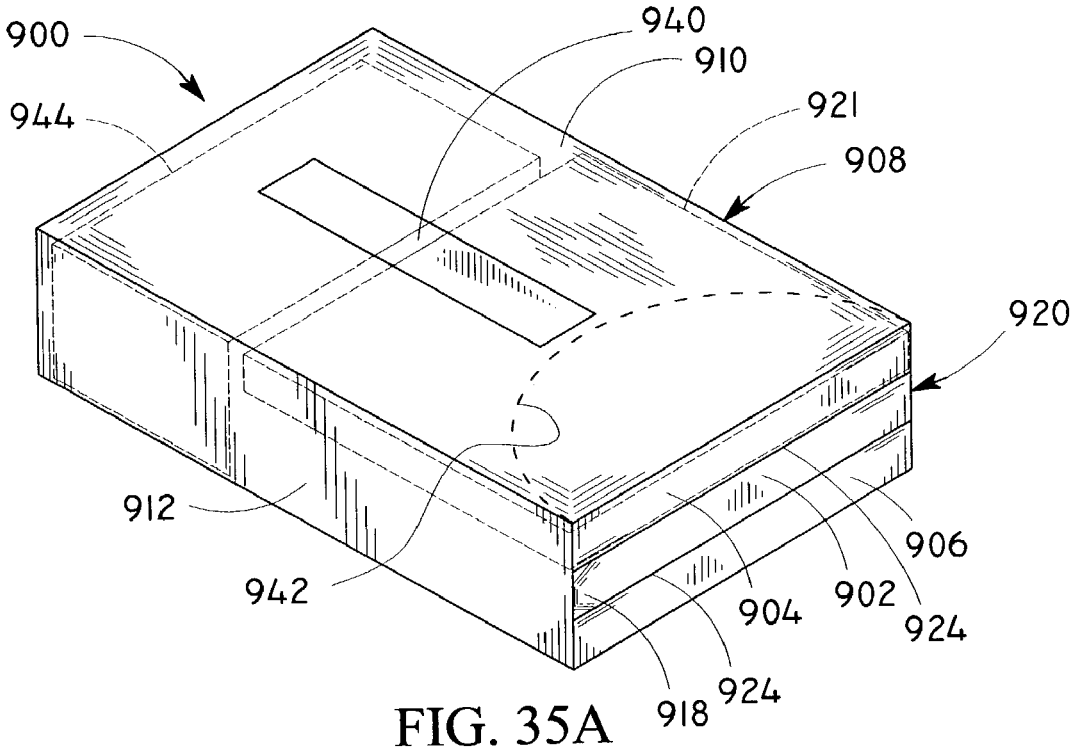
FIG. 35A is a perspective-view illustration of a sixth alternative embodiment of an outer container incorporating a box-type container.

A perspective-view illustration of a sixth alternative embodiment of an outer container incorporating a box-type container is shown FIG. 35A. This embodiment is essentially similar to the embodiment shown and described in FIG. 24A and the accompanying text, a difference being that the body portion 908 is extended so that optional objects (e.g., a beverage container 944, snacks, and/or other desired objects) can be contained within the body portion. The outer container 900 is a box-type outer container which comprises a body portion 908 and a front portion 920, and is constructed from a unitary blank of a semi-rigid material (e.g., cardboard, treated-paper, paperboard, polypropylene, foamed or other types of solid polymers, plastics, laminates, etc.). The body portion comprises a top panel 910, a bottom panel, side panels 912, a rear panel, and a plurality of cavities. The front portion comprises a first flap 904, a second flap 906, a third flap (which is located directly behind the second flap), a removable flap 902, and optional side flaps. The inner cavity comprises a primary cavity and an optional secondary cavity which are not delineated by any walls but, in optional embodiments, can be separated by interior walls, etc. as desired. The inner container and sandwich halves (the upper sandwich half 921 is shown) are contained within the primary cavity of the outer container, while the optional condiments (e.g., drinks, snacks, etc.) are contained within the secondary cavity. The removable flap is constructed from the same sheet of material as the outer container and is connected to the first and second flaps via weakened lines 924 (e.g. perforated, scored, adhesives, peel strip, etc.). Alternatively, the removable flap is constructed from a separate sheet of material and is releasably bonded to the body portion to seal the cavity. The removable flap further comprises a removal tab 918 which is suitable for grasping. An optional window 940 is located in the top panel and allows for viewing of the contents of the package. An optional weakened line 942 is located on the top panel and allows the top panel (and the attached first flap) to be partially peeled back and/or removed from the body portion so as to allow for more convenient access to the sandwich contained within the body. An optional beverage container (e.g., a Tetra Brick™ container manufactured by the Tetra Pack Corp, Vernon Hills, Ill., a can, and/or other desired object) is contained within the secondary cavity. The beverage container is accessed and removed by opening the rear panel. Alternatively, the beverage container is removed by peeling back the top panel so as to provide access to the beverage container.

Figure 35B:
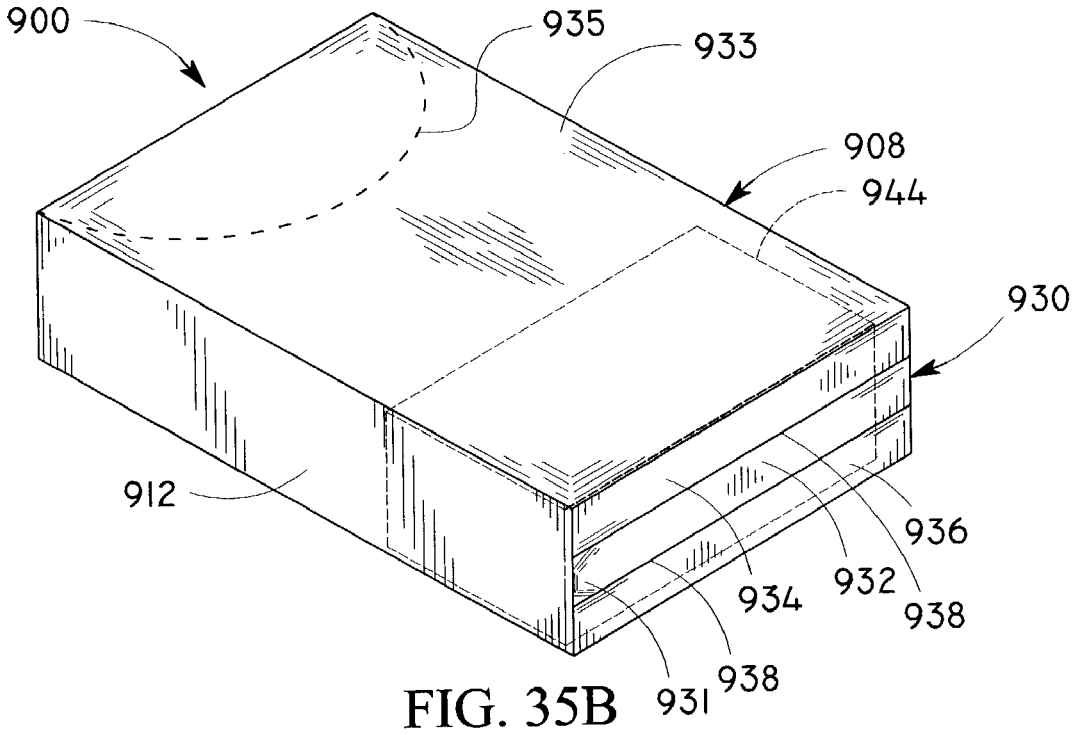
FIG. 35B is a rear perspective-view illustration of the outer container of FIG. 35A.

A rear perspective-view illustration of the outer container of FIG. 35A is shown in FIG. 35B. The rear portion 930 is constructed similarly to the front portion and comprises a first flap 934, a second flap 936, a third flap (which is located directly behind the second flap), a removable flap 932, and optional side flaps. Additionally, an optional weakened line 935 is located on the bottom panel 933 and provides for easier access to the sandwich contained within the body. In alternative embodiments, the rear portion is constructed of a single flap which is releasably attached to the body portion via weakened lines.

In alternative embodiments, the outer cover includes one or more pockets which are formed integrally with it or are attached thereto. The pockets are opened either before or during removal of the outer cover from the center member such that the contents of the pockets (e.g., salt, ketchup, etc.) are dispensed upon the filler or other desired object. The pockets include weakened lines which tear the pockets, thus opening them due to pressure within the pockets as the outer cover is peeled back over itself.

There are numerous cohesive coatings which may be employed in the practice of this invention to releasably cohere the numerous elements of this invention to each other and especially the outer cover to the center member and the box cover to the box portion. The bond between the outer cover and the center member may be continuous or interrupted.

In embodiments where it is desired to reduce friction between the outer cover and/or the draw members and the sandwich halves, a sheet of material which superposes the outer cover may be placed between the outer cover, the draw member and the adjacent sandwich half.

In all embodiments, the outer cover can be constructed from a transparent material to allow the handler and/or consumer easily to view and select the desired item. Similarly, the outer container and/or the outer box can also be constructed from transparent material. Moreover, the inner container can be provided with a venting means so that the inner container can be vented if desired during heating.

The packaging and dispensing system of the present invention may be provided with any number of configurations and sizes. The size and configuration will typically be determined by the particular food product(s) contained within the inner container, the optional sandwich halves, the outer container, and the box means.

The materials used for the invention include, but are not limited to, papers, foils, cellophane, Mylar, polyethylene, polypropylene, polyester, foams, other types of polymers, or composites of these or other suitable materials. The primary requirements for the packaging materials are the ability to provide a sealable package and compatibility with food products. If desired, the materials should be compatible with optional sterilization techniques and methods employed. Additionally, the materials used for the package must, if required, be easily ripped or torn, and the line of tearing must propagate in a desired direction. In some instances, it might be desirable to add tear strips or other guiding devices/coatings on or in the packaging material to assist in a clean, linear tearing of the package material. It will also be desirable to use materials such as oriented fiber papers to assist in providing clean, linear edges in the packaging material to be torn.

If desired, the cavity can be flushed using any known means (as is known in the art) so as to reduce the oxygen content contained within the cavity and thus extend the life of the filler.

In various embodiments of the present invention, without limitation, to enable the user more easily to use the present invention, the first tab and the second tab (as well as the draw members and other elements) may be colored to contrast with the rest of the package, may be embossed to enhance user touch, feel, and sight, may be cut in a way to indicate direction, and may be numbered, embellished with arrows, or printed with directions to indicate proper use.

It is intended that the appended claims cover all such features and advantages of the invention that fall within the spirit and scope of the present invention. As numerous modifications and changes will readily occur to those skilled in the art, it is intended that the invention not be limited to the limited number of embodiments described herein. Accordingly, it will be appreciated that all suitable variations, modifications and equivalents may be resorted to, falling within the spirit and scope of the present invention.

What is claimed is:

1. An apparatus for packaging a sandwich filler, comprising:

a center member adapted to provide space for said sandwich filler;

an outer cover having a first end and a second end, said outer cover releasably attached to said center member so as to form a cavity for said sandwich filler; and draw means attached to said first end and said second end of said outer cover, whereby a pulling force applied to said draw means is transferred to said first end and said second end of said outer cover thereby peeling said outer cover from said center member starting from said first end and said second end such that said outer cover is slideably peeled back over itself thus causing the separation and removal of said outer cover from said center member and exposing said sandwich filler contained therein.

2. The apparatus according to claim 1, further comprising holding means adapted to retain said center member during the pulling of said draw means.

3. The apparatus according to claim 2, wherein said holding means is formed integrally with said center member.

4. The apparatus according to claim 1, further comprising holding means attached to an outer periphery of said outer cover and adapted to retain said center member during the pulling of said draw means.

5. The apparatus according to claim 1, wherein said draw means comprises a single pull tab.

6. The apparatus according to claim 1, wherein said draw means comprises a plurality of draw members attached to said first end and said second end of said outer cover, each said draw member having a separate tab member.

7. The apparatus according to claim 1, further comprising holding means adapted to retain said center member during pulling of said draw means.

8. The apparatus according to claim 1, wherein said draw means comprises:

a first draw member having a first end, a second end and a first tab, said second end being attached to said first end of said outer cover; and a second draw member having a first end, a second end and a second tab, said second end being attached to said second end of said outer cover.

9. The apparatus according to claim 8, wherein said first tab and said second tab are attached so as to form a common tab.

10. The apparatus according to claim 1, wherein said draw means is formed integrally with said outer cover.

11. The apparatus according to claim 1, wherein said outer cover comprises a single sheet having weakened line means on one or more outer edges for promoting the tearing of said outer cover when said draw means is pulled.

12. The apparatus according to claim 1, further comprising:

an outer container for housing sandwich halves, said center member, said outer cover and said draw means; and holding means for anchoring said center member to said outer container.

13. The apparatus according to claim 12, wherein said outer container comprises a pop open box.

14. The apparatus according to claim 1, wherein said cavity is flushed to reduce the oxygen content contained therein.

15. An apparatus for packaging a filler, comprising:

a center member adapted to provide space for said filler;

an outer cover having a first end and a second end, said outer cover releasably attached to said center member so as to form a cavity for said filler; and draw means attached to said first end and said second end of said outer cover, whereby a pulling force applied to said draw means is transferred to said first end and said second end of said outer cover thereby peeling said outer cover from said center member starting from said first end and said second end such that said outer cover is slideably peeled back over itself thus causing the separation and removal of said outer cover from said center member and exposing said filler contained therein.

16. The apparatus according to claim 15, further comprising holding means adapted to retain said center member during the pulling of said draw means.

17. The apparatus according to claim 15, wherein said outer cover comprises a single sheet having score means on each outer edge for promoting the tearing of said outer cover when said draw means is pulled.

* * * * *